US010711580B2

(12) United States Patent
Deutch et al.

(10) Patent No.: US 10,711,580 B2
(45) **Date of Patent: *Jul. 14, 2020**

(54) HIGH POWER LASER DECOMMISSIONING OF MULTISTRING AND DAMAGED WELLS

(71) Applicant: Foro Energy, Inc., Houston, TX (US)

(72) Inventors: Paul D. Deutch, Houston, TX (US); Scott A. Marshall, Houston, TX (US); Daryl L. Grubb, Houston, TX (US); Ronald A. De Witt, Katy, TX (US); Mark S. Zediker, Castle Rock, CO (US); Brian O. Faircloth, Evergreen, CO (US)

(73) Assignee: Foro Energy, Inc., Houston, TX (US)

( * ) Notice: Subject to any disclaimer, the term of this patent is extended or adjusted under 35 U.S.C. 154(b) by 34 days.

This patent is subject to a terminal disclaimer.

(21) Appl. No.: 15/603,192

(22) Filed: May 23, 2017

(65) Prior Publication Data

US 2018/0045024 A1 Feb. 15, 2018

Related U.S. Application Data

(60) Division of application No. 14/105,949, filed on Dec. 13, 2013, now Pat. No. 9,664,012, which is a (Continued)

(51) Int. Cl.

| | |
|---|---|
| ***E21B 29/02*** | (2006.01) |
| ***E21B 33/13*** | (2006.01) |
| ***E21B 43/11*** | (2006.01) |
| ***E21B 29/00*** | (2006.01) |
| ***E21B 33/12*** | (2006.01) |

(52) U.S. Cl.
CPC ..... *E21B 43/11* (2013.01); *E21B 29/00* (2013.01); *E21B 33/1204* (2013.01); *E21B 33/13* (2013.01)

(58) Field of Classification Search
CPC ... E21B 7/061; E21B 7/14; E21B 7/15; E21B 29/02; E21B 29/04; E21B 29/06; E21B 33/13; E21B 33/138
See application file for complete search history.

(56) References Cited

U.S. PATENT DOCUMENTS 5,790,620 A 8/1998 Kabushiki
7,422,068 B2 * 9/2008 Lynde ..... E21B 29/10 166/207

(Continued)

OTHER PUBLICATIONS

Dec. 7, 2018, EPO, Examination Report Appl. No. 12820 743.8.

(Continued)

*Primary Examiner* — Kenneth L Thompson
(74) *Attorney, Agent, or Firm* — Glen P. Belvis; Belvis Law, LLC.

(57) ABSTRACT

High power laser systems, high power laser tools, and methods of using these tools and systems for opening up damaged wells and for cutting, sectioning and removing structures objects, and materials, and in particular, for doing so in difficult to access locations and environments, such as offshore, underwater, or in hazardous environments, such as nuclear and chemical facilities. And, high power laser systems, high power laser tools, and methods of using these systems and tools for providing rock-to-rock plugs for decommissioning of wells.

8 Claims, 34 Drawing Sheets

Related U.S. Application Data continuation-in-part of application No. 13/966,969, filed on Aug. 14, 2013, now Pat. No. 9,669,492, and a continuation-in-part of application No. 13/565,345, filed on Aug. 2, 2012, now Pat. No. 9,089,928, said application No. 14/105,949 is a continuation-in-part of application No. 13/222,931, filed on Aug. 31, 2011, now abandoned, and a continuation-in-part of application No. 13/211,729, filed on Aug. 17, 2011, now abandoned, and a continuation-in-part of application No. 13/347,445, filed on Jan. 10, 2012, now Pat. No. 9,080,425, and a continuation-in-part of application No. 13/210,581, filed on Aug. 16, 2011, now Pat. No. 8,662,160, and a continuation-in-part of application No. 13/403,741, filed on Feb. 23, 2012, now abandoned, and a continuation-in-part of application No. 12/543,986, filed on Aug. 19, 2009, now Pat. No. 8,826,973, and a continuation-in-part of application No. 12/544,136, filed on Aug. 19, 2009, now Pat. No. 8,511,401, and a continuation-in-part of application No. 12/840,978, filed on Jul. 21, 2010, now Pat. No. 8,571,368, and a continuation-in-part of application No. 12/706,576, filed on Feb. 16, 2010, now Pat. No. 9,347,271, and a continuation-in-part of application No. 13/403,615, filed on Feb. 23, 2012, now Pat. No. 9,562,395, and a continuation-in-part of application No. 13/403,287, filed on Feb. 23, 2012, now Pat. No. 9,074,422.

(60) Provisional application No. 61/514,391, filed on Aug. 2, 2011, provisional application No. 61/605,422, filed on Mar. 1, 2012, provisional application No. 61/605,429, filed on Mar. 1, 2012, provisional application No. 61/605,434, filed on Mar. 1, 2012, provisional application No. 61/378,910, filed on Aug. 31, 2010, provisional application No. 61/374,594, filed on Aug. 17, 2010, provisional application No. 61/431,827, filed on Jan. 11, 2011, provisional application No. 61/431,830, filed on Feb. 7, 2011, provisional application No. 61/446,312, filed on Feb. 24, 2011, provisional application No. 61/090,384, filed on Aug. 20, 2008, provisional application No. 61/102,730, filed on Oct. 30, 2008, provisional application No. 61/106,472, filed on Oct. 17, 2008, provisional application No. 61/153,271, filed on Feb. 17, 2009, provisional application No. 61/295,562, filed on Jan. 15, 2010, provisional application No. 61/446,043, filed on Feb. 24, 2011, provisional application No. 61/446,042, filed on Feb. 24, 2011.

(56) References Cited

U.S. PATENT DOCUMENTS

| | | | | |
|---|---|---|---|---|
| 7,490,664 | B2 * | 2/2009 | Skinner | E21B 7/15 166/250.16 |
| 7,537,055 | B2 * | 5/2009 | Head | E21B 7/067 166/117.6 |
| 8,020,619 | B1 * | 9/2011 | Robertson | E21B 17/026 166/297 |
| 9,089,928 | B2 | 7/2015 | Foro | |
| 9,242,309 | B2 | 1/2016 | Foro | |
| 9,399,269 | B2 | 7/2016 | Foro | |
| 9,492,885 | B2 | 11/2016 | Foro | |
| 9,664,012 | B2 * | 5/2017 | Deutch | E21B 29/00 |
| 9,669,492 | B2 | 6/2017 | Foro | |
| 9,719,302 | B2 | 8/2017 | Foro | |
| 2016/0010415 | A1 * | 1/2016 | Myhre | E21B 33/13 166/290 |
| 2017/0016299 | A1 | 1/2017 | Foro | |
| 2017/0252858 | A1 | 9/2017 | Foro | |
| 2017/0266760 | A1 | 9/2017 | Foro | |
| 2017/0321486 | A1 | 11/2017 | Foro | |
| 2018/0045024 | A1 | 2/2018 | Foro | |

OTHER PUBLICATIONS

Sep. 4, 2017, EPO, Examination Report Appl. No. 12820 743.9.
Jun. 27, 2018, EPO, Third Party Observations Appl. No. 12820 743.10.
Jul. 18, 2018, EPO, Exam Report Appl. No. 12820 743.11.
Jul. 1999, Oka, Development of Pipe Welding, Cutting & Inspection Tools for the Iter Blanket (JARI-Tech 99-048).
Mar. 3, 2003, Chida, Underwater cutting technology of thick stainless steel YAG laser (SPIE.

* cited by examiner

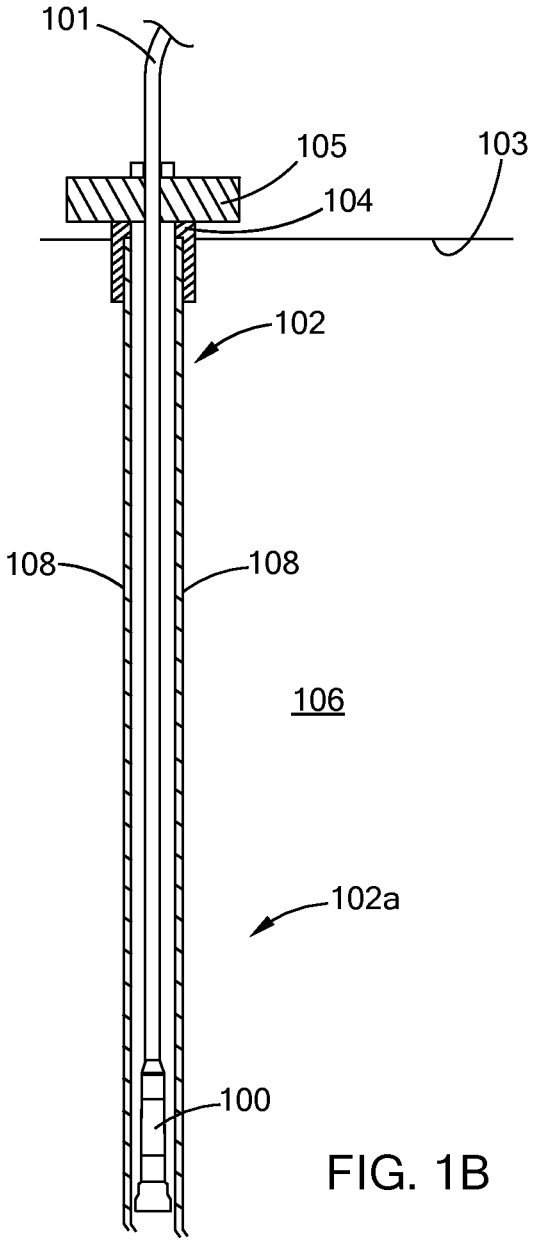
FIG. 1B
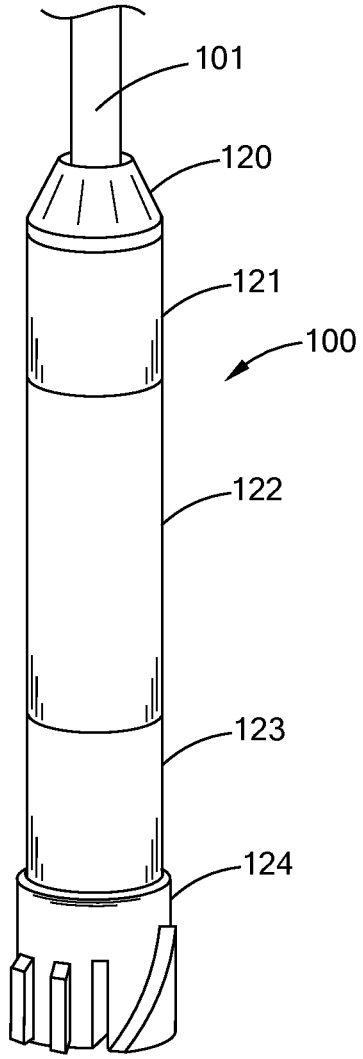
FIG. 1A
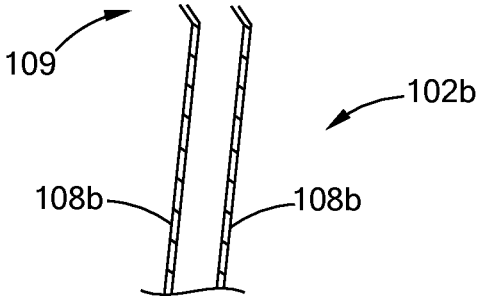

HIGH POWER LASER DECOMMISSIONING OF MULTISTRING AND DAMAGED WELLS

This application is a divisional of U.S. patent application Ser. No. 14/105,949, filed Dec. 13, 2013, which: (i) is a continuation-in-part of U.S. patent application Ser. No. 13/966,969, filed Aug. 14, 2013; (ii) is a continuation-in-part of U.S. patent application Ser. No. 13/565,345, filed Aug. 2, 2012, which claims, under 35 U.S.C. § 119(e)(1), the benefit of the filing date of Aug. 2, 2011 of provisional application Ser. No. 61/514,391, the benefit of the filing date of Mar. 1, 2012 of provisional application Ser. No. 61/605,422, the benefit of the filing date of Mar. 1, 2012 of provisional application Ser. No. 61/605,429, the benefit of the filing date of Mar. 1, 2012 of provisional application Ser. No. 61/605,434; (iii) is a continuation-in-part of U.S. patent application Ser. No. 13/222,931, filed Aug. 31, 2011, which claims, under 35 U.S.C. § 119(e)(1), the benefit of the filing date of Aug. 31, 2010 of provisional application Ser. No. 61/378,910; (iv) is a continuation-in-part of U.S. patent application Ser. No. 13/211,729, filed Aug. 17, 2011, which claims, under 35 U.S.C. § 119(e)(1), the benefit of the filing date of Aug. 17, 2010 of provisional application Ser. No. 61/374,594; (v) is a continuation-in-part of U.S. patent application Ser. No. 13/347,445, filed Jan. 10, 2012, which claims, under 35 U.S.C. § 119(e)(1), the benefit of the filing date of Jan. 11, 2011 of provisional application Ser. No. 61/431,827 and the benefit of the filing date of Feb. 7, 2011 of provisional application Ser. No. 61/431,830; (vi) is a continuation-in-part of U.S. patent application Ser. No. 13/210,581, filed Aug. 16, 2011; (vii) is a continuation-in-part of U.S. patent application Ser. No. 13/403,741, filed Feb. 23, 2012, which claims, under 35 U.S.C. § 119(e)(1), the benefit of the filing date of Feb. 24, 2011 of provisional application Ser. No. 61/446,312; (viii) is a continuation-in-part of U.S. patent application Ser. No. 12/543,986, filed Aug. 19, 2009, which claims, under 35 U.S.C. § 119(e)(1), the benefit of the filing date of Aug. 20, 2008 of provisional application Ser. No. 61/090,384, the benefit of the filing date of Oct. 3, 2008 of provisional application Ser. No. 61/102,730, the benefit of the filing date of Oct. 17, 2008 of provisional application Ser. No. 61/106,472 and the benefit of the filing date of Feb. 17, 2009 of provisional application Ser. No. 61/153,271; (ix) is a continuation-in-part of U.S. patent application Ser. No. 12/544,136, filed Aug. 19, 2009, which claims, under 35 U.S.C. § 119(e)(1), the benefit of the filing date of Aug. 20, 2008 of provisional application Ser. No. 61/090,384, the benefit of the filing date of Oct. 3, 2008 of provisional application Ser. No. 61/102,730, the benefit of the filing date of Oct. 17, 2008 of provisional application Ser. No. 61/106,472 and the benefit of the filing date of Feb. 17, 2009 of provisional application Ser. No. 61/153,271; (x) is a continuation-in-part of U.S. patent application Ser. No. 12/840,978, filed Jul. 21, 2010; and (xi) is a continuation-in-part of U.S. patent application Ser. No. 12/706,576 filed Feb. 16, 2010 which claims, under 35 U.S.C. § 119(e)(1), the benefit of the filing date of Jan. 15, 2010 of provisional application Ser. No. 61/295,562; (xii) is a continuation-in-part of U.S. patent application Ser. No. 13/403,615 filed Feb. 23, 2012, which claims, under 35 U.S.C. § 119(e)(1), the benefit of the filing date of Feb. 24, 2011 of provisional application Ser. No. 61/446,043; and, (xiii) is a continuation-in-part of U.S. patent application Ser. No. 13/403,287 filed Feb. 23, 2012, which claims, under 35 U.S.C. § 119(e)(1), the benefit of the filing date of Feb. 24, 2011 of provisional application Ser. No. 61/446,042, the entire disclosures of each of which are incorporated herein by reference.

BACKGROUND OF THE INVENTION

Field of the Invention

The present inventions relate to high power laser systems, high power laser tools, and methods of using these systems and tools for removing structures objects, and materials, and in particular, structures, objects, and materials in difficult to access damaged, aged, deteriorated or obstructed locations and environments, such as offshore, in the earth, underwater, or in hazardous environments, such as damaged, aged, deteriorated or obstructed boreholes, pipelines, nuclear and chemical facilities. The present inventions further relate to the making of cuts, or holes in borehole tubulars to provide improved plugs, and in particular, rock-to-rock plugs, as well as improving an existing formation or downhole reservoir flow to surface by removing a borehole restriction. Thus, for example, the present inventions relate to high power laser systems, high power laser tools, and methods of using these systems and tools for removing, decommissioning, plugging abandoning, and combinations and variations of these, in wells that have been damaged.

As used herein, unless specified otherwise "offshore," "offshore activities" and "offshore drilling activities" and similar such terms are used in their broadest sense and would include drilling and other activities on, or in, any body of water, whether fresh or salt water, whether manmade or naturally occurring, such as for example rivers, lakes, canals, inland seas, oceans, seas, such as the North Sea, bays and gulfs, such as the Gulf of Mexico. As used herein, unless specified otherwise the term "offshore drilling rig" is to be given its broadest possible meaning and would include fixed platforms, tenders, platforms, barges, dynamically positioned multiservice vessels, lift boats, jack-ups, floating platforms, drill ships, dynamically positioned drill ships, semi-submersibles and dynamically positioned semi-submersibles.

As used herein, unless specified otherwise the term "fixed platform," would include any structure that has at least a portion of its weight supported by the seafloor. Fixed platforms would include structures such as: free-standing caissons, monopiles, well-protector jackets, pylons, braced caissons, piled-jackets, skirted piled-jackets, compliant towers, gravity structures, gravity based structures, skirted gravity structures, concrete gravity structures, concrete deep water structures and other combinations and variations of these. Fixed platforms extend from at or below the seafloor to and above the surface of the body of water, e.g., sea level. Deck structures are positioned above the surface of the body of water on top of vertical support members that extend down into the water to the seafloor and into the seabed. Fixed platforms may have a single vertical support, or multiple vertical supports, or vertical diagonal supports, e.g., pylons, legs, braced caissons, etc., such as a three, four, or more support members, which may be made from steel, such as large hollow tubular structures, concrete, such as concrete reinforced with metal such as rebar, and combinations and variations of these. These vertical support members are joined together by horizontal, diagonal and other support members. In a piled-jacket platform the jacket is a derrick like structure having hollow essentially vertical members near its bottom. Piles extend out from these hollow bottom members into the seabed to anchor the platform to the seabed.

The construction and configuration of fixed platforms can vary greatly depending upon several factors, including the intended use for the platform, load and weight requirements, seafloor conditions and geology, location and sea conditions, such as currents, storms, and wave heights. Various types of fixed platforms can be used over a great range of depths from a few feet to several thousands of feet. For example, they may be used in water depths that are very shallow, i.e., less than 50 feet, a few hundred feet, e.g., 100 to 300 feet, and a few thousand feet, e.g., up to about 3,000 feet or even greater depths may be obtained. These structures can be extremely complex and heavy, having a total assembled weight of more than 100,000 tons. They can extend many feet into the seafloor, as deep as 100 feet or more below the seafloor.

As used herein, unless specified otherwise the terms "seafloor," "seabed" and similar terms are to be given their broadest possible meaning and would include any surface of the earth, including for example the mud line, that lies under, or is at the bottom of, any body of water, whether fresh or salt water, whether manmade or naturally occurring.

As used herein, unless specified otherwise the terms "well" and "borehole" are to be given their broadest possible meaning and include any hole that is bored or otherwise made into the earth's surface, e.g., the seafloor or seabed, and would further include exploratory, production, abandoned, reentered, reworked, and injection wells.

As used herein, unless specified otherwise the term "drill pipe" is to be given its broadest possible meaning and includes all forms of pipe used for drilling activities; and refers to a single section or piece of pipe. As used herein, unless specified otherwise the terms "stand of drill pipe," "drill pipe stand," "stand of pipe," "stand" and similar type terms are to be given their broadest possible meaning and include two, three or four sections of drill pipe that have been connected, e.g., joined together, typically by joints having threaded connections. As used herein, unless specified otherwise the terms "drill string," "string," "string of drill pipe," string of pipe" and similar type terms are to be given their broadest definition and would include a stand or stands joined together for the purpose of being employed in a borehole. Thus, a drill string could include many stands and many hundreds of sections of drill pipe.

As used herein, unless specified otherwise the term "tubular" is to be given its broadest possible meaning and includes conductor, drill pipe, casing, riser, coiled tube, composite tube, vacuum insulated tube ("VIT"), production tubing, piles, jacket components, offshore platform components, production liners, pipeline, and any similar structures having at least one channel therein that are, or could be used, in the drilling, production, refining, hydrocarbon, hydroelectric, water processing, chemical and related industries. As used herein the term "joint" is to be given its broadest possible meaning and includes all types of devices, systems, methods, structures and components used to connect tubulars together, such as for example, threaded pipe joints and bolted flanges. For drill pipe joints, the joint section typically has a thicker wall than the rest of the drill pipe. As used herein the thickness of the wall of a tubular is the thickness of the material between the internal diameter of the tubular and the external diameter of the tubular.

As used herein, unless specified otherwise the term "pipeline" should be given its broadest possible meaning, and includes any structure that contains a channel having a length that is many orders of magnitude greater than its cross-sectional area and which is for, or capable of, transporting a material along at least a portion of the length of the channel. Pipelines may be many miles long and may be many hundreds of miles long or they may be shorter. Pipelines may be located below the earth, above the earth, under water, within a structure, or combinations of these and other locations. Pipelines may be made from metal, steel, plastics, ceramics, composite materials, or other materials and compositions know to the pipeline arts and may have external and internal coatings, known to the pipeline arts. In general, pipelines may have internal diameters that range from about 2 to about 60 inches although larger and smaller diameters may be utilized. In general natural gas pipelines may have internal diameters ranging from about 2 to 60 inches and oil pipelines have internal diameters ranging from about 4 to 48 inches. Pipelines may be used to transmit numerous types of materials, in the form of a liquid, gas, fluidized solid, slurry or combinations thereof. Thus, for example pipelines may carry hydrocarbons; chemicals; oil; petroleum products; gasoline; ethanol; biofuels; water; drinking water; irrigation water; cooling water; water for hydroelectric power generation; water, or other fluids for geothermal power generation; natural gas; paints; slurries, such as mineral slurries, coal slurries, pulp slurries; and ore slurries; gases, such as nitrogen and hydrogen; cosmetics; pharmaceuticals; and food products, such as beer.

Pipelines may be, in part, characterized as gathering pipelines, transportation pipelines and distribution pipelines, although these characterizations may be blurred and may not cover all potential types of pipelines. Gathering pipelines are a number of smaller interconnected pipelines that form a network of pipelines for bringing together a number of sources, such as for example bringing together hydrocarbons being produced from a number of wells. Transportation pipelines are what can be considered as a traditional pipeline for moving products over longer distances for example between two cities, two countries, and a production location and a shipping, storage or distribution location. The Alaskan oil pipeline is an example of a transportation pipeline. Distribution pipelines can be small pipelines that are made up of several interconnected pipelines and are used for the distribution to, for example, an end user, of the material that is being delivered by the pipeline, such as for example the feeder lines used to provide natural gas to individual homes. Pipelines would also include, for example, j-tubes that interconnect subsea pipelines with producing structures, pipeline end manifolds (PLEM), and similar sub-sea structures; and would also include flowlines connecting to, for example, wellheads. As used herein, the term pipeline includes all of these and other characterizations of pipelines that are known to or used in the pipeline arts.

As used herein unless specified otherwise the terms "damage", "damaged well", "damaged borehole", "casing damage", "damaged" and similar such terms are used in the broadest sense possible, and would include: broken casings, tubulars or wells; pinched casing or tubulars or wells; crushed casing, tubulars or wells; deformed casing, tubulars or wells; deteriorated casing, tubulars or wells; wells having casing or tubulars that are displaced by, for example, shifting of the formation; weakened casing, tubulars or wells; well components, sections or areas that are degraded from environment sources or conductions such as from, rust, corrosion or fatigue; collapsed bore holes or formations; blocked or occluded casing, tubulars or wells, e.g., having a deposited material that obstructs flow or movement of a tool; and combinations and variations of these, and other problems that are known to the art to arise, or that may occur, within a well.

As used herein, unless specified otherwise "high power laser energy" means a laser beam having at least about 1 kW (kilowatt) of power. As used herein, unless specified otherwise "great distances" means at least about 500 m (meter).

As used herein the term "substantial loss of power," "substantial power loss" and similar such phrases, mean a loss of power of more than about 3.0 dB/km (decibel/kilometer) for a selected wavelength. As used herein the term "substantial power transmission" means at least about 50% transmittance.

Discussion of Related Arts

Sub-Sea Drilling

Typically, and by way of general illustration, in drilling a subsea well an initial borehole is made into the seabed and then subsequent and smaller diameter boreholes are drilled to extend the overall depth of the borehole. Thus, as the overall borehole gets deeper its diameter becomes smaller; resulting in what can be envisioned as a telescoping assembly of holes with the largest diameter hole being at the top of the borehole closest to the surface of the earth. As the borehole is being extended, in this telescoping fashion, casing may be inserted into the borehole, and also may be cemented in place. Smaller and smaller diameter casing will be used as the depth of the borehole increases.

Thus, by way of example, the starting phases of a subsea drill process may be explained in general as follows. In the case of a floating rig, once the drilling rig is positioned on the surface of the water over the area where drilling is to take place, an initial borehole is made by drilling a 36" hole in the earth to a depth of about 200-300 ft. below the seafloor. A 30" casing is inserted into this initial borehole. This 30" casing may also be called a conductor. The 30" conductor may or may not be cemented into place. During this drilling operation a riser is generally not used and the cuttings from the borehole, e.g., the earth and other material removed from the borehole by the drilling activity are returned to the seafloor. Next, a 26" diameter borehole is drilled within the 30" casing, extending the depth of the borehole to about 1,000-1,500 ft. This drilling operation may also be conducted without using a riser. A 20" casing is then inserted into the 30" conductor and 26" borehole. This 20" casing is cemented into place. The 20" casing has a wellhead, or casing head, secured to it. (In other operations an additional smaller diameter borehole may be drilled, and a smaller diameter casing inserted into that borehole with the wellhead being secured to that smaller diameter casing.) The wellhead, or casing head, would be located at the seafloor. A blowout preventer ("BOP") is then secured to a riser and lowered by the riser to the sea floor; where the BOP is secured to the wellhead, or casing head. From this point forward, in general, all drilling activity in the borehole takes place through the riser and the BOP.

In the case of a fixed platform rig, once the drilling rig is positioned on the seafloor over the area where drilling is to take place, an initial borehole is made by drilling a 36" hole in the earth to a depth of about 200-300 ft. below the seafloor. A 30" casing is inserted into this initial borehole. This 30" casing may also be called a conductor. The 30" conductor may or may not be cemented into place. During this drilling operation a riser is generally not used and the cuttings from the borehole, e.g., the earth and other material removed from the borehole by the drilling activity, are returned to the seafloor. In the case of a fixed platform, the conductor extends from below the seafloor to above the surface of the water, and generally to the platform decking. Next, a 26" diameter borehole is drilled within the 30" casing, extending the depth of the borehole to about 1,000-1,500 ft. This drilling operation is conducted within the conductor. A 20" casing is then inserted into the 30" conductor and 26" borehole. This 20" casing is cemented into place and extends from below the seafloor to the above the surface of the sea. The 20" casing has a wellhead, or casing head, secured to it. (In other operations, an additional smaller diameter borehole may be drilled, and a smaller diameter casing inserted into that borehole with the wellhead being secured to that smaller diameter casing.) With a fixed platform, the wellhead or casing head, is located above the surface of the body of water and generally in the decking area of the platform. A BOP is then secured to the wellhead or casing head. From this point forward, in general, all drilling activity in the borehole takes place through the BOP.

During completion of the well a production liner and within the production liner a production pipe are inserted into the borehole. These tubulars extend from deep within the borehole to a structure referred to as a Christmas tree, which is secured to the wellhead or casing head. (Other structures, in addition to, including, or encompassed by a Christmas tree, such as a tree, production tree, manifold and similar types of devices may be secured to or associated with the wellhead, casing head or conductor.) In sub-sea completions, the Christmas tree is located on the sea floor. In completions using a fixed platform, the Christmas tree is located above the surface of the body of water, in the platforms deck, atop the conductor. During production, hydrocarbons flow into and up the production pipe to the Christmas tree and from the Christmas tree flow to collection points where they are stored, processed, transferred and combinations of these. Depending upon the particular well, a conductor may have many concentric tubulars within it and may have multiple production pipes. These concentric tubulars may or may not be on the same axis. Further, these concentric tubulars may have the annulus between them filled with cement. A single platform may have many conductors and for example may have as many as 60 or more, which extend from the deck to and into the seafloor.

The forgoing illustrative examples have been greatly simplified. Many additional steps, procedures, tubulars and equipment (including additional equipment, power lines and pipelines on or below the seafloor) maybe utilized to proceed from the initial exploratory drilling of a well to the actual production of hydrocarbons from a field. At some point in time, a well or a collection of wells, will no longer be economically producing hydrocarbons. At which point in time the decision may be made to plug and abandon the well, several wells, and to additionally decommission the structures associated with such wells. As with the steps to drill for and produce hydrocarbons, the steps for plugging, abandoning and decommissioning are complex and varied.

Prior Methodologies to Remove Subsea Structures

There are generally several methodologies that have been used to remove structures from the earth and in particular from the seafloor. These methodologies may generally be categorized as: complex saws, such as diamond saws: large mechanical cutters or shears; oxygen-arc or torch cutters; abrasive water jets; mills; and explosives. Additionally, there may be other methodologies, including the use of divers and ROVs to physically scrap, chip, cut or otherwise remove material. All of these methodologies have health, safety, environmental, and reliability drawbacks. Moreover, these methodologies are severely lacking, limited and believed to be essentially inadequate, if operable at all, in addressing situations where the down hole casing, tubulars or well bore has been damaged, crushed, displaced, obstructed, collapsed or otherwise rendered difficult or impossible to pass tools through.

High Power Laser Transmission

Prior to the breakthroughs of Foro Energy co-inventors it was believed that the transmission of high power laser energy over great distances without substantial loss of power was unobtainable. Their breakthroughs in the transmission of high power laser energy, in particular power levels greater than 5 kW, are set forth, in part, in the novel and innovative teachings contained in the following US Patent Application Publications: Publication No. 2010/0044106; Publication No. 2010/0044104; Publication No. 2010/0044103; Publication No. 2010/0215326; and, Publication No. 2012/0020631, the entire disclosures of each of which are incorporated herein by reference.

SUMMARY

In the removal, abandonment, decommissioning and plugging of complex, damaged or obstructed structures located in difficult to access, harsh or hazardous environments, such as offshore structures and nuclear facilities, it has long been desirable to have the ability to open those structures sufficiently, and reliably and safely cut, section, bridge, remove and plug them, and to do so in a controlled and predetermined manner. The present inventions, among other things, solve these needs by providing the articles of manufacture, devices and processes taught herein.

Thus, there is provided a method of decommissioning a well, including: positioning a high power laser cutting tool in a borehole to be decommissioned; delivering a high power laser beam from the high power laser tool in a predetermined pattern to the borehole, whereby the laser beam volumetrically removes material in the borehole; and, forming a plugging material channel, the plugging material channel essentially corresponding to the predetermined laser beam delivery pattern.

Yet further the methods, systems or tools may further have one or more of the following features: wherein the laser beam has a power of at least about 5 kW; wherein the laser beam has a power of at least about 10 kW; wherein the laser beam has a power of at least about 20 kW; wherein the borehole has an axis and the plugging material channel has a length along the borehole axis of at least about 200 feet; wherein the borehole has an axis and the plugging material channel has a length along the borehole axis of at least about 100 feet; wherein the borehole has an axial length and the plugging material channel has a length along the borehole axis of at least about 50 feet; wherein the laser beam delivery pattern extends through a borehole wall and into a formation adjacent the borehole, whereby a portion of the plug material pathway extends to and into the formation defining a notch; wherein the laser beam delivery pattern extends through a borehole wall and into a formation adjacent the borehole, whereby a portion of the plug material pathway extends to and into the formation defining a notch; wherein the laser beam delivery pattern has a slot pattern that extends through a tubular within the well and extends through a borehole wall and into a formation adjacent the borehole, wherein the plug material pathway provides the capability for a rock to rock seal when filled with a plugging material; wherein the laser beam delivery pattern has a slot pattern that extends through a tubular within the well and extends through a borehole wall and into a formation adjacent the borehole, wherein the plug material pathway provides the capability for a rock to rock seal when filled with a plugging material; wherein the laser beam delivery pattern has a plurality of pie shaped patterns; wherein the laser beam delivery pattern has a plurality of disc shaped patterns; wherein the laser beam delivery pattern has a plurality of volumetric removal patterns spaced along an axial direction of the borehole, at least two of the volumetric removal patterns configured in a staggered overlying relationship, whereby at least one volumetric removal patterns intersects a control line in the well; wherein the laser beam delivery pattern has a plurality of volumetric removal patterns spaced along an axial direction of the borehole, at least two of the volumetric removal patterns configured in a staggered overlying relationship, whereby at least one volumetric removal patterns intersects a control line in the well; wherein a portion of the plug material pathway defines a notch; wherein the laser beam delivery pattern has a volumetric removal pattern that extends through a tubular and extends through a borehole wall, wherein the plug material pathway provides the capability for a rock to rock seal when filled with a plugging material; wherein the laser beam delivery pattern has an elliptical pattern that extends through a tubular within the well and extends through a borehole wall and into a formation adjacent the borehole; and, wherein the laser beam delivery pattern has a slot pattern that extends through a plurality of tubulars and extends through a borehole wall and into a formation adjacent the borehole; wherein the laser beam delivery pattern has a plurality of volumetric removal patterns, at least two of the volumetric removal patterns configured in an overlying relationship.

Still further there is provided a method of decommissioning a damaged well, including: locating a damaged section of a well; advancing a high power laser delivery tool to the damaged section of the well; and, directing a high power laser beam from the high power laser delivery tool toward the damaged section of the well and removing at least a portion of the damaged section of the well; wherein the damaged section of the well is sufficiently opened for an other decommission activity to take place below it.

Additionally the methods, systems or tools may further have one or more of the following features: wherein the laser beam removes a damaged tubular; wherein the laser beam has a power of at least about 5 kW; wherein the laser beam has a power of at least about 20 kW; wherein the other decommission activity has pulling a production tubing; wherein the other decommissioning activity having forming a rock to rock seal; wherein the laser beam removes a portion of the formation; wherein the damaged section is removed by an outside to inside cut; wherein the laser beam is delivered above and below a damaged section of pipe, whereby the damaged section can be removed from the well Moreover, there is provided a method of servicing a damaged well, the method including: advancing a high power laser delivery tool to a damaged section of the well, the damaged section of the well having a pinched casing and inner tubular; and, directing a high power laser beam from the high power laser delivery tool toward the damaged section of the well in a predetermined laser delivery pattern, the predetermined laser delivery pattern intersecting the pinched casing; whereby the laser beam removes the pinched casing.

Yet additionally, the methods, systems or tools may further have one or more of the following features: wherein the damaged section of the well is located between a first undamaged section of the well and a second undamaged section of the well, and the laser delivery pattern removes the pinched casing and any other material in its path, thereby bridging the first and second undamaged sections of the well; wherein the high power laser delivery tool has a bent sub; wherein the high power laser delivery tool has an optics assembly for use with the bent sub; wherein the high power laser delivery tool has a pair of prisms; wherein the high power laser delivery tool is an overshot laser tool; wherein the high power laser delivery tool is a laser mechanical bit; wherein the laser delivery pattern is a volumetric pattern selected from the group consisting of: a linear pattern, an elliptical patent, a conical pattern, a fan shaped pattern and a circular pattern; wherein the removed material is a tubular; wherein the removed material is a plurality of tubulars; wherein the removed material is a plurality of tubulars and the formation; wherein the removed material is a plurality of tubulars, the formation, and cement; wherein the removed material is a plurality of essentially concentric tubulars; wherein the concentric tubulars are coaxial; wherein the laser delivery pattern is configured to cut a control line; and, wherein the laser beam delivered along the delivery pattern cuts a control line.

Furthermore, the methods, systems or tools may further have one or more of the following features: A method of decommissioning a well, including: positioning a high power laser cutting tool in a borehole to be decommissioned; the borehole having a plurality of tubulars; and, delivering a high power laser beam from the high power laser tool in a predetermined pattern, whereby the laser beam volumetrically removes material in the borehole; and, thereby forming a rock to rock plugging material channel, the plugging material channel essentially corresponding to the predetermined laser beam delivery pattern.

Still further the methods, systems or tools may further have one or more of the following features: wherein the laser beam delivery pattern has a slot pattern that extends through a tubular within the well and extends through a borehole wall and into a formation adjacent the borehole, wherein the plug material pathway provides the capability for a rock to rock seal when filled with a plugging material; wherein the laser beam delivery pattern extends through a borehole wall and into a formation adjacent the borehole, whereby a portion of the plug material pathway extends to and into the formation defining a notch; wherein the laser beam delivery pattern has a plurality of volumetric removal patterns spaced along an axial direction of the borehole, at least two of the volumetric removal patterns configured in a staggered overlying relationship, whereby at least one volumetric removal patterns intersects a control line in the well; and, wherein the laser beam delivery pattern has an elliptical pattern that extends through a tubular within the well and extends through a borehole wall and into a formation adjacent the borehole.

There is also provided a method of decommissioning a damaged well, the method including: advancing a high power laser delivery tool to a damaged section of the well; directing a high power laser beam from the high power laser delivery tool toward the damaged section of the well in a predetermined laser delivery pattern; the laser beam delivered along the predetermined laser delivery pattern, at least in part, opens the damaged section of the well; advancing decommissioning equipment through the laser opened section of the well to a lower section of the well; and, performing an operation on the lower section of the well.

Moreover, the methods, systems or tools may further have one or more of the following features: wherein the damaged section of the well having a pinched casing; wherein the damaged section of the well has a pinched casing and inner tubular; wherein the damaged section of the well has a plurality of damaged tubulars; wherein the damaged section of the well is located between a first undamaged section of the well and a second undamaged section of the well, and the laser delivery pattern removes a pinched casing and any other material in its path, thereby bridging the first and second undamaged sections of the well; wherein the high power laser delivery tool has a bent sub; wherein the high power laser delivery tool has an instrument selected from the group consisting of an imaging instrument, sensing instrument, and an imaging and sensing instrument; wherein the high power laser delivery tool has an instrument selected from the group consisting of an imaging instrument, sensing instrument, and an imaging and sensing instrument; wherein the high power laser delivery tool has a instrument based upon components selected from the group consisting of a camera, a sonic device, a radiation device, a logging device, a measuring device, a log while drilling device, a measuring while drilling device, a magnetic device, a laser device, and an X-ray diagnostic and inspection-logging device, whereby the damaged selection of the well can be analyzed, and the tool, at least in part, is directed based upon the analysis; wherein the high power laser delivery tool has a instrument based upon components selected from the group consisting of a camera, a sonic device, a radiation device, a logging device, a measuring device, a log while drilling device, a measuring while drilling device, a magnetic device, a laser device, and an X-ray diagnostic and inspection-logging device; wherein the laser delivery pattern has a volumetric pattern selected from the group consisting of: a linear pattern, an elliptical patent, a conical pattern, a fan shaped pattern and a circular pattern; and, where in the operation performed on the lower section of the well has an operation selected from the group consisting of plugging, decommissioning, forming a rock to rock seal, laser cutting tubulars, forming a plurality of spaced apart plugs, and plug back to sidetrack.

Additionally there is provided a high power laser overshot tool, having: a motorized rotation assembly, operably associated with an overshot body, the overshot body having an axial length and an inner diameter; the overshot body having a high power optical fiber and an air channel extending substantially along the length of the overshot body; and, the overshot body having a laser cutting head in optical and fluid communication with the high power optical fiber and air channel; and, the length and diameter of the overshot body predetermined to encompass an inner tubular in a well.

Yet further the methods, systems or tools may further have one or more of the following features: wherein the laser cutting head in optical association with a laser; wherein the laser cutting head in optical association with a laser, having at least about 10 kW; wherein the laser cutting head in optical association with a laser, having at least about 20 kW; wherein the optical fiber is located adjacent an outer wall of the overshot body; wherein the air channel is located adjacent an outer wall of the overshot body; wherein the optical fiber is located adjacent an inner wall of the overshot body; wherein the optical fiber and air channel are located adjacent an inner wall of the overshot body; wherein the optical fiber and air channel are located in a conduit, the conduit located in the interior of the overshot body; wherein the optical fiber and air channel are located in a conduit, the conduit having a portion of a wall of the overshot body; wherein the laser delivery pattern has a slot essentially parallel to the axis of the borehole, the slot having a length or at least about 20 feet (a length of at least about 40 feet, a length of at least about 50 feet, a length of at least about 100 feet and more); wherein the laser delivery pattern has a plurality of slots essentially parallel to the axis of the borehole, the slots having a length or at least about 20 feet; and, wherein the slots are essentially evenly places around the walls of a tubular in the borehole; wherein the laser the laser delivery pattern has a plurality of circular slots extending transverse to the axis of the well and around the wall of the well.

Moreover there is provided a laser delivery tool, for cutting a pipe in a borehole into a plurality of smaller components, the laser delivery tool having: laser delivery delivery head; the laser delivery head having: a first, a second and a third laser cutter; each laser cutter having a laser jet nozzle; and, each laser cutter has a mechanical extension device.

Additionally there is provides a method of preforming a plug back to sidetrack operation on a well, the method including: in a lower section of a reservoir cementing a rock to rock plug; advancing a laser tool into the well; laser milling materials in the well to form a window; drilling a new borehole hole through the window; and, running a casing through the window into the new borehole.

Additionally the methods, systems or tools may further have one or more of the following features: wherein the rock to rock plug has a length of at least about 50 m, at least about 100 m and at least about 150 m; wherein the well is damaged and the laser beam is used to open the damaged section of the well, to provide access to cement the rock to rock plug; wherein the laser beam path forms an angle perpendicular to the well axis; wherein the laser beam pattern comprises sweeping the laser beam from an angle essentially perpendicular to the well axis to an angle essentially parallel to the well axis; wherein the well is damaged and is associated with a slot on a rig, whereby the slot on the rig is recovered to useful production; and, wherein the well comprises a plurality of concentric tubulars; the laser tool is lowered in the inner most tubular; and the laser beam cuts through all of the tubulars.

Still additionally there is provided a method of slot recovery, for a rig with a slot having a damaged well, the method including: the damaged well associated with a slot on the rig; cementing a rock to rock plug in a lower section of a reservoir associated with the well, whereby the lower section is isolated; laser cutting all tubulars in the well at a point above the plug; pulling the laser cut strings from the well; run a whipstock thru the existing well slot until a top of the well is tagged; orienting the whipstock slide in the correct direction; and, drilling a new borehole; whereby the slot on the rig has been recovered for use.

BRIEF DESCRIPTION OF THE DRAWINGS

FIG. 1A is a perspective view of an embodiment of a laser decommissioning and opening tool in accordance the present inventions.

FIGS. 1B to 1E are snap shot cross sectional views of an embodiment of a laser opening method in the damaged well of FIG. 1, with the the laser tool of FIG. 1A, in accordance with the present inventions.

DESCRIPTION OF THE PREFERRED EMBODIMENTS

Figure 1:
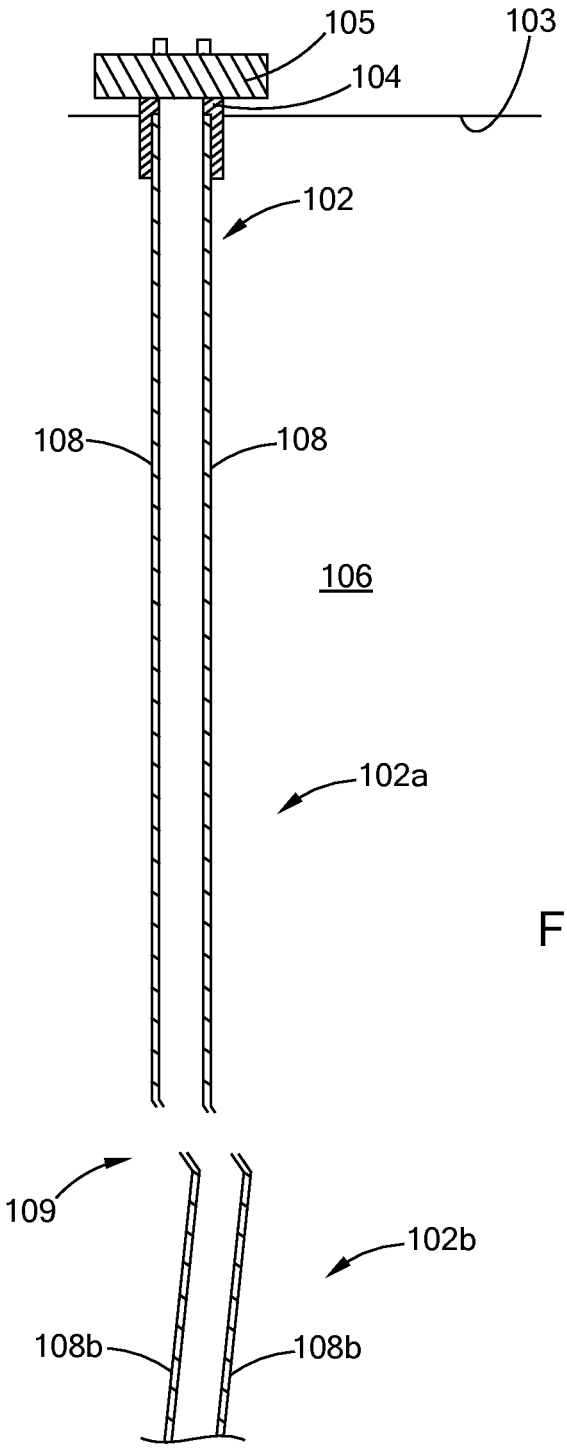
FIG. 1 is a cross sectional schematic view of a damaged well upon which laser operations in accordance with the present inventions are performed.

In general, the present inventions relate to the decommissioning of objects, structures, and materials in difficult to access, hazardous or harsh environments using high power laser energy to open, cut or section them, so that they are removable, more easily removed, more easily accessible to the reservoir zone below or more easily plugged. The present inventions further relate to systems, tools and methods for the removal of structures, objects, and materials, and in particular, structures, objects, and materials that are complex, multicomponent, damaged, aged, deteriorated or obstructed and that may be in harsh locations and environments, such as offshore, in wells, in the earth, or underwater. The present inventions further, and generally, relate to cutting or opening wells for passing tools and materials into the well, cutting or opening connecting channels or slots between multicomponent structures in wells for filling with a plugging material (e.g., cement or resin), such as for example a borehole having several casings that are positioned one within the other. This ability to quickly and reliably gain access to and cut such items into predetermined sizes and to cut or open predetermined channels, provides many advantages, including environmental, safety and cost benefits, as well as creating a better cement bond from formation to formation across the multiconductor well zone.

In should be noted that the present specification focuses generally on the plugging, abandonment and decommissioning of offshore oil wells and platforms, as an illustrative application for the present laser systems, methods and tools, in part, because they provide particular advantages, and solve long-standing needs, in such applications. The present inventions, however, should not be so limited. Thus, for example, the present inventions could also be used to decommission a land based well, or to repair a damaged structure, such as a deteriorated borehole.

In about 1946 the first exploratory oil well was drilled in the Gulf of Mexico. From that point forward, through the present time, there has been considerable activity to explore, develop and produce hydrocarbons from offshore fields in the Gulf of Mexico, the North Sea and in other offshore areas of the world. These efforts have resulted in many thousands of wells being constructed over the last fifty years. A large number of these wells have reached and are reaching the end of their useful lives, and more will be doing so in the future. Thus, the present inventions, among other things, find significant use and provide significant benefits to the plugging, abandonment and decommissioning of the ever increasing number of off shore wells that have reached and are reaching the end of their use full lives.

Once it has been determined that a well is not going to be used, the well will be plugged, and if there is no intention to return to the well, abandoned. By way of example, a laser plugging and abandonment procedure may generally involve some or all, of the following activities and equipment, as well as other and additional activities and equipment. Further, laser plugging and abandonment procedures and activities would include, by way of example, the use of high power laser tools, systems, cutters and cleaners to perform any and all of the type of activities that are set forth in BOEMRE 30 CFR 250, subpart Q, and including by way of example, activities such as permanent abandonment, temporary abandonment, plug back to sidetrack, bypass, site clearance and combinations and variations of these (or may include similar regulations that come into existence in the future or are applicable to other locations, such as to the North Sea). Such activities would further include, without limitation the cutting, removal and/or modification of any structures (below or above the surface of the earth and/or the sea floor) for the purpose of temporarily or permanently ceasing and/or idling activities. Laser plugging and abandonment activities would also include: new activities that were unable to be performed prior to the development of high power laser systems, equipment and procedures; existing procedures that prior to the development of the high power laser systems, equipment and procedures would have been unable to be performed in an economically, safely or environmentally viable manner; and combinations and variations of these, among other things.

After the valves on the wellhead and tree have been checked to ensure proper operability, an inspection unit, such as a wireline unit, slick line/electric line unit, slick line unit, or similar type of unit, may be used to check, inspect and measure, the borehole depth, gauge the internal diameter of the tubulars in the borehole and determine other needed information about the borehole. To the extent that there are any tools stuck down hole, valves jammed or stuck down hole, obstructions, or other downhole damaged areas, that are required or desirable to be opened, the unit may be used to lower a laser cutting tool and laser tool umbilical (or the umbilical may be used without the need for a separate or additional line, e.g., a wireline, depending upon the umbilical and laser module), to the location of the damaged area. For example, the laser tool can deliver a high power laser beam to the stuck downhole equipment, cutting the equipment to sufficiently free it for recovery, by the laser tool or the line; completely melting or vaporizing the stuck equipment, and thus, eliminating it as an obstruction; or combinations and variations of these. The well is then pressure tested and any fluid communication between tubular annular spaces is evaluated.

Upon this inspection it may be discovered, or it may otherwise already have been known, that the well is damaged. In some cases this damage may be significant enough that cuts through the casing(s) are required to assure a rock-to-rock seal. (It should be noted that the cutting of casing(s) to assure a rock-to-rock plug or seal, may also be beneficially, useful and, in some situations, necessary, even when the well has not been damaged.) In other cases, the well may be so severely damaged, or otherwise deteriorated, that it is difficult or impossible to pass tools below a certain point, e.g., the damaged location. Thus, creating problems in inspecting the well below this point and creating significant problems in removing tubulars and placing plugs below this point. Thus, a laser decommissioning and opening tool may be used to open the borehole and provide access below the damaged area.

As used herein, unless specified otherwise, "rock-to-rock seal", "rock-to-rock plug", "formation-to-formation seal" and "formation-to-formation plug" and similar such terms should be given their broadest possible meanings and include: a seal, material or plug that extends completely across, or fills all openings in, a borehole from the formation to the center of the borehole; a seal, material or plug, that extends completely into the formation, and across or fills all openings in, a borehole from the formation to the center of the borehole; a seal, material or plug that seals against all sides, walls, or surfaces of the borehole and fills the borehole or predetermined openings or spaces in the borehole, and preferably all annular spaces in the borehole; a seal, material or plug, that penetrates into the formation, that abuts against or is adjacent the borehole formation, and that completely fills all openings in the borehole, and in particular all annular space from or adjacent the formation.

The laser module and laser cutting tool, or tools, may then be used in conjunction with the platforms existing hoisting equipment, e.g., the derrick, and cementing, circulating and pumping equipment, to plug and abandon the well. If such equipment is not present on the platform, or for some other reason, other hoisting, circulating or pumping equipment may be used, as needed, in conjunction with, for example, a coil tubing rig having a laser unit (e.g., the laser coil tubing systems described in US Patent Application Publication No. 2012/0273470), or a laser work over and completion unit (e.g., the mobile laser unit described in US Patent Application Publication No. 2012/0273470) may be used. Additionally, a rig-less abandonment and decommissioning system may have a laser removal system of the present invention integrated into, or located on it. The laser removal system may be configured to have a very small foot print, and thus, take up only a small amount of deck space. The laser removal system may substantially enhance, or expand, the capabilities of the rig-less abandonment and decommissioning system by enabling it to perform decommissioning projects that it otherwise could not without the laser system's ability to cut and section materials.

In general, and by way of example, plugging and abandonment activities may involve the following activities, among others. A cement plug is placed at the deepest perforation zone and extends above that zone a predetermined distance, for example about 100 feet. After the plug has been placed and tested, the laser tool is lowered into the well and the production tubing and liner, if present, are cut above the plug and pulled. If there are other production zones, whether perforated or not, cement plugs may also be installed at those locations.

As the production tubing is pulled, it may be cut into segments by a laser cutting device, or it may have been removed before the decommissioning project began, and if jointed, its segments may be unscrewed by pipe handling equipment and laid down. The laser cutting device may be positioned on the rig floor, in which instance the pipe handling equipment associated with the rig floor can be used to raise and hold the tubing, while the laser cutting device cuts it, remove the upper section of the cut tubing, hold the lower section from falling, and then pull the lower section of tubing into position for the next laser cut. In general, for this type of pulling and cutting operation the laser cutting tool may be located above a clamping device to hold the pipe and below a hoisting device, such as a crane, top drive and drawworks, to lift the pipe. The laser cutting device may be movably positioned on the rig floor, for example in the manner in which an iron rough neck is positioned.

A second, or intermediate, cement plug is installed at a location above the first plug and in the general area of a shoe of an intermediate and surface casing. Additional intermediate plugs may also be installed. During the installation of these cement or resin plugs, or other cement plugs or activities, to the extent that circulation is needed to be established, or the annulus between tubulars is required to be filled with cement, the laser tool may be used to cut windows or perforations, at predetermined intervals and to predetermined radial depths to establish circulation or provide the ability to selectively fill an annulus with cement. It being understood that these various steps and procedures generally will be based at least in part on the well casing program.

Thus, for example, the laser tool may cut an opening through an 11¾ inch casing, at a depth of 10,000 feet, and expose the annulus between the 11¾ inch casing and a 13⅝ inch casing. The laser tool may then cut a second opening at a depth of 10,300 feet exposing the same annulus. This ability to selectively open tubulars and expose various annular spaces in a predetermined and controlled manner may find application in various cleaning, circulating, plugging and other activities required to safely and properly plug and abandoned a well. This ability may also provide benefits to meet future cleaning and plugging regulations or safety requirements.

For example, the ability to selectively expose annular spaces, using the laser tool, and then fill those spaces with cement provides the ability to insure that no open annular space, which extends to the sea floor, is left open to the borehole, and more preferably left open to the surface. The ability to selectively expose annular space additionally provides the ability to open or cut windows and perforations in a single piece of casing or multiple pieces of casing at precise sizes, angles, shapes and locations. Thus, this provides the ability to insure that a rock-to-rock seal, or zonal isolation barrier, is obtained by the plug, e.g., that for a specified area of the borehole, the cement flows into the formation, flows into any voids between casings, and flow into any voids between the casing and the formation, completely plugging and sealing the borehole in the entirety of that specified area. The specified area for a rock-to-rock plug or seal, may be at least about 10 feet, at least about 50 feet, at least about 100 feet or longer in length. Preferably, this length of the rock-to-rock plug meets all regulatory and safety requirements.

In general, any remaining uncemented casing strings, that are located above the top most intermediate plug, may be cut by the laser tool (using internal, external and combinations of both, cuts) and then pulled from the well. (These strings may be segmented by a laser cutting device, at the rig floor as they are being pulled). A top cement plug starting at a fixed depth below the sea floor (e.g., 50 to 100 feet) and extending down into the borehole (e.g., an additional 200-300 feet) is then placed in the well. It being recognized that the cement plug may be added (filled) by flowing from the lower position up, or the upper end position down.

Further, by using the present laser methods, systems and tools some or all of the strings, e.g., tubulars, in a well may not need to be pulled. Thus, the laser may be used to cut openings through all of the strings, up to and including the outermost casing. The laser may also cut openings through the outer most casing and into the formation. These openings may be spaced apart, connected, staggered, and ranging from only one, to a few, to very numerous, e.g., one, two, tens, hundreds or more, in the area to be plugged. These openings may be: elongated slots, e.g., from an inch in length to tens and hundreds of feet in length, and from fractions of an inch, e.g., about ⅛ inch to several inches in width; vertical slits, e.g., slits that are essentially parallel to the axis of the well; horizontal slits, e.g., slits that are essentially transverse to the axis of the well; holes, e.g., circular holes, square holes, any other shape hole; helical cuts; spray patterns, e.g., shot gun blast pattern of holes;

many small holes, e.g., hundreds of separate laser spots the size of the laser beam; spiral cuts; and combinations of these and other opens. The laser cut openings may preferably open at least about 0.5%, at least about 5%, at least about 15%, at least about 25% and more, of the surface area of the tubulars over the plugging distance within the well bore (e.g., "plugging distance" is the distance in the borehole from the location or depth between the intended position for the bottom of a plug or barrier to the top of a plug or barrier). These laser made openings may preferably create radially extending passages, channels or openings that extend from the central axis of the borehole out and through other annularly spaced tubulars and into the formation, by at least about ½ inch, at least about 1 inch, and at least about two inches, at least about five inches and more. These radially extending passages may also extend axially for shorter, the same or greater axial distances, as any axial openings, such as elongated slots. In this manner, any down hole tubulars and the formation may be cut in a predetermined laser delivery pattern, which pattern when delivered forms an opening or series of openings (preferably interconnected, e.g., in fluid communication), and which when filled with a plugging material, creates a predetermined plug configuration that seals the well, and preferably provides a rock-to-rock seal, which has superior safety, environment, cost and combinations of these advantages, over conventional down hole cutting methodologies.

These laser made openings, preferably are predetermined to provide the requisite exposure of the various strings and annuli between those strings, to enable cement, or another plug forming material, to be pumped into the well and provide for a plug, and preferably a rock-to-rock plug, filling the entire wellbore over a sufficient length, and to a sufficient volume, to meet regulatory requirements and more preferably to provide for the well to be safely contained and within, or exceeding, all regulatory requirements. Thus, the laser cuts can provide for, or create, a plug material pathway, or channel. More preferably, the laser cuts are predetermined to provide for a plug material pathway that when filled with the plugging material minimizes, and still more preferably, prevents any leaking from below the plugged area to locations above the plugged area. These plug material pathways can be made in a length of borehole that is, for example, at least about 10 feet, at least about 50 feet, at least about 100 feet, at least about 150 feet or longer. These plug material pathways then provide a channel or passageway for a plug material to be flowed or forced through and in this manner creating a plug that for example can extend across the entirety of the structures in borehole, and extend out and into the formation. For example, and preferably, the plug material pathways are cut in a predetermined manner to insure a complete plug across the entire internal diameter of the borehole for a length of about 164 feet (50 meters), e.g., a rock-to-rock plug of solid material with essentially no voids, and more preferably no voids, extending over about 164 feet (50 meters) of borehole.

In many wells shifts in the geological strata, formation or earth can pinch, crush, bend, shear, deform or otherwise damage the casing or other tubulars in the well. These damaged sections can present significant difficulties, including difficulties when it comes time to plug and abandon the well. The laser tools, systems and methods can be used to perform laser operations to remove the damaged material, open the well up, and in a laser decommissioning operation cut laser plug pathways in the area of the damage, above the area of damage, below the area of damage, across the area of damage and combinations and various of these. The laser tools, systems and techniques provide great flexibility in addressing the decommissioning problems associated with damaged wells, and damaged casing conductors and other tubulars associated with the well.

The conductor, and any casings or tubulars, or other materials, that may be remaining in the borehole, can be cut at a predetermined depth below the seafloor (e.g., from 5 to 20 feet, and preferably 15 feet) by the laser cutting tool. Once cut, the conductor, and any internal tubulars, are pulled from the seafloor and hoisted out of the body of water, where they may be cut into smaller segments by a laser cutting device at the rig floor, vessel deck, work platform, or an off-shore laser processing facility. Additionally, biological material, or other surface contamination or debris that may reduce the value of any scrap, or be undesirable for other reasons, may be removed by the laser system before cutting and removal, after cutting and removal or during those steps at the various locations that are provided in this specification for performing laser operations. Holes may be cut in the conductor (and its internal cemented tubulars) by a laser tool, large pins may then be inserted into these holes and the pins used as a lifting and attachment assembly for attachment to a hoist for pulling the conductor from the seafloor and out of the body of water. As the conductor is segmented on the surface additional hole and pin arrangements may be needed.

It is contemplated that internal, external and combinations of both types of cuts be made on multi-tubular configurations, e.g., one tubular located within the other. The tubulars in these multi-tubular configurations may be concentric, eccentric, concentrically touching, eccentrically touching at an area, have grout or cement partially or completely between them, have mud, water, or other materials partially or completely between them, and combinations and variations of these.

Additionally, the laser systems provide an advantage in crowded and tightly spaced conductor configurations, in that the precision and control of the laser cutting process permits the removal, or repair, of a single conductor, without damaging or effecting the adjacent conductors. For example, in addition to abandoning a damaged well, it may be plugged abandoned and recovered. Thus, in these damaged wells, laser tools, systems and methods can be used to plug back to sidetrack a damaged well. For example, in a plug back to sidetrack, the lower reservoir and/or producing zone would be cemented from "rock to rock" and plug length of 50 m to 100 m placed upwards into the wellbore. One or more reservoir zones and potential leak paths would also be cement and/or mechanically plugged. Upon complete lower isolation, the laser and laser system would be lowered into the wellbore or innermost string of the well and section or mill thru tubing, casing, or pipe with the laser beam path cutting either perpendicular, parallel or deviated angle until reaching out into the formation. Once the laser has cut a window or section of sufficient length and width to allow for new casing kickout angle, the drill rig would drill and run new casing program into new formation from surface and bring a new well onto production. Also, the same process may be done utilizing the same slot or conductor on the drilling rig that has the damaged well. In this case, the same plug back or lower reservoir zone would be cemented and isolated, possibly including a final surface plug being set in the innermost string, at which point the laser and laser system would sever all strings/conductors out to formation and utilizing a drill derrick or heavy lift crane would pull the multistring well conductor from the cut depth to top of wellhead. Once the multistring well has been removed, the drill program would run a "whipstock" and spear back thru the existing well conductor slot until the top of existing wellbore is tagged, for example top of wellbore is 85 feet below mudline. Once the whipstock is tagged and slide is oriented in the correct direction of the new well to be drilled, the drill program can begin and new hole is drilled in the deviated direction with new casing installation to follow. In this manner, the slot can be recovered and returned to production.

The forgoing discussions of high power laser plugging and abandonment activities is meant for illustration purposes only and is not limiting, as to either the sequence or general types of activities. Those of skill in the decommissioning, plugging and abandonment arts, may recognize that there are many more and varied steps that may occur and which may occur in different sequences during a decommissioning, plugging and abandonment process. For example, the borehole between cement plugs may be filled with appropriately weighted fluids or drilling muds. Many of these other activities, as well as, the foregoing cutting, segmenting, and plugging activities, are influenced by, and may be dictated, in whole or in part, by the particular and unique casing and cement profile of each well, seafloor conditions, regulations, and how the various tubulars have aged, degraded, been damaged, or changed over the life of the well, which could be 10, 20, or more years old.

The high power laser systems, methods, down hole tools and cutting devices, provide, among other things, improved abilities to quickly, safely and cost effectively address such varied and changing cutting, cleaning, and plugging requirements that may arise during the plugging and abandonment of a well, and in particular a damaged well. These high power laser systems, methods, down hole tools and cutting devices, can provided improved reliability, safety and flexibility over existing methodologies such as explosives, abrasive water jets, milling techniques or diamond band saws, in part, because of the ability of the laser systems to meet and address the various cutting conditions and requirements that may arise during a plugging and abandonment project. In particular, and by way of example, unlike these existing methodologies, high power laser systems of certain wavelengths and processes, will not be harmful to marine life, and they may ensure a complete and rapid cut through all types of material. Unlike an explosive charge, which sound and shock waves may travel many miles, the laser beam for specific wavelengths, even a very high power beam of 20 kW or more, has a very short distance, e.g., only a few feet, through which it can travel unaided through open water. Unlike abrasive water jets, which need abrasives that may be left on the sea floor, or dispersed in the water, the laser beam, even a very high power beam of 20 kW or more, is still only light; and uses no abrasives and needs no particles to cut with, or that may be left on the sea floor or dispersed in the water. Moreover, unlike convention methodologies, the present laser systems have greater, and substantially greater, capabilities, economics, and safety, in particular, when addressing damaged wells and and the need for a rock-to-rock seal.

The laser cuts to the vertical members of the jacket of a platform, or other members to be cut, may be made from the inside of the members to the outside, or from the outside of the member to the inside. In the inside-to-outside cut, the laser beam follows a laser beam path starting from inside the member, to the member's inner surface, through the member, and toward the body of water or seabed. For the outside-to-inside cut, the laser beam follows a laser beam path starting from the outside of the member, i.e., in the laser tool, going toward the outer surface of the member, through the member, and into its interior. For the inside-to-outside cut the laser cutting tool will be positioned inside of the member, below the seafloor, in the water column, above the body of water and combinations and variations of these. For the outside to inside cut, the laser cutting tool will be positioned adjacent to the outer surface of the member. In creating a section for removal from the body of water, only inside-out cuts, only outside-in cuts, and combinations of these cuts may be used. Thus, for example, because of wave action in the area of the intended cuts all cuts may be performed using the inside-outside beam path. Multiple laser cutting tools may be used, laser cutting tools having multiple laser cutting heads may be used, laser cutting tools or heads having multiple laser beam delivery paths may be used, and combinations of these. The sequence of the laser cuts to the members preferably should be predetermined. They may be done consecutively, simultaneously, and in combinations and various of these timing sequences, e.g., three members may be cut at the same time, follow by the cutting of a fourth, fifth and sixth member cut one after the other.

While it is preferable to have the cuts of the members be clean and complete, and be made with just one pass of the laser, the precision and control of the laser, laser cutting tools, and laser delivery heads, provides the ability to obtain many types of predetermined cuts. These complete laser cuts provide the ability to assure and to precisely determine and know the lifting requirements for, and the structural properties of the section being removed, as well as any remaining portions of the structure. Such predetermined cuts may have benefits for particular lifting and removal scenarios, and may create the opportunity for such scenarios that were desirable or cost effective, but which could not be obtained with existing removal methodologies. For example, the member may be cut in a manner that leaves predetermined "land" section remaining. This could be envisioned as a perforation with cuts (removed) areas and lands (areas with material remaining). There may be a single cut and a single land area, multiple cuts and lands and the land areas may make collectively or individually, at least about 5%, at least about 10%, at least about 20%, at least about 50% of the circumference or exterior area of the vertical member. The land areas could provide added safety and stability as the vertical members are being cut. The size and locations of the lands would be known and predetermined, thus their load bearing capabilities and strength would be determinable. Thus, for example, once all the perforation cuts have been made, the heavy lifting crane may be attached to the jacket section to be removed, a predetermined lifting force applied by the crane to the section, and the lands cut freeing the section for removal. The lands may also be configured to be a predetermined size and strength that the crane is used to mechanically break them as the section is lifted away from the remaining portion of the jacket. This ability to provide predetermined cutting patterns or cuts, provides many new and beneficial opportunities for the use of the laser cutting system in the removal of offshore structures and other structures.

The lands of a laser perforation cut, are distinguishable and quite different from the missed cuts that occur with abrasive water jet cutters. The location, size, consistency, and frequency of the abrasive water jet cutter's missed cuts are not known, planned or predetermined. As such, the abrasive water jet's missed cuts are a significant problem, detriment and safety concern. On the other hand, the laser perforated cuts, or other predetermined custom laser cutting profiles, that may be obtained by the laser removal system of the present inventions, are precise and predetermined. In this manner the laser perforation, or other predetermined, cuts may enhance safety and provide the ability to precisely know where the cuts and lands are located, to know and predetermine the structural properties and dynamics of the member that is being cut, and thus, to generally know and predetermine the overall structural properties and dynamics of the offshore structure being removed.

Turning to FIGS. 1, and 1A to 1E, there is shown an embodiment of a laser decommissioning tool and process for the decommissioning of a damaged well. Thus, turning to FIG. 1, there is a borehole 102 having a well head 104, and an assembly to maintain and manage pressure 105 while conveying the laser tool and other structures down hole. The well head is located at the surface of the earth 103, which may be at the bottom of a body of water, and thus be the sea floor. The borehole 102 is located in the earth 106. The borehole has a casing 108. The borehole 102 has a damaged section 109, which can be viewed as separating the borehole into an upper section 102*a* and a lower section 102*b*.

FIGS. 1, and 1B to 1E are greatly simplified and not drawn to scale, for the purpose of clarity. It being understood that the borehole 102 may have additional tubulars associated with it, and these tubulars may extend through the damaged section and may be damaged themselves. It also being understood that the damaged section is only a schematic representation of damage.

Turning to FIG. 1A, there is shown a perspective schematic view of an embodiment of a laser decommission tool 100. The tool 100 has a conveyance structure 101 in mechanical, optical, and if needed fluid, communication with an upper motor section 121 by way of a conveyance structure connector 120. The upper motor section 121 is connected to the motor section 122, below the motor section 122 is a lower motor section 123, and below the lower motor section 123 is a laser-mechanical bit 124. It being recognized that additional general components may be added or used and that, applying the teachings of this specification, the order and arrangement of these components may be varied, without departing from the spirit of the inventions.

Depending upon the degree of opening, e.g., how long, wide or in general how much material needs to be cut or removed, that is required for the decommissioning operation, e.g., for tools and cement conveyance structure to move through the damaged section, a system for handling cuttings and returns may be required, otherwise the cutting and any laser fluids, e.g., fluids used to support or assist the laser beam deliver, may be permitted to drop to the bottom (or, if the laser fluid is a gas float to the top) of the bore hole.

Preferably the tool 100 has monitoring and steering capabilities for providing precise steering of the tool 100, directing of the laser-mechanical bit 124, directing of the laser laser beam and combinations and various of these. Thus, for example, the tool 100 may have down hole cameras, imaging or sensing instruments, to direct, and in particular to assist in directing the tool through the damaged area and into the lower portions of the borehole. These imaging and sensing instruments, may be camera based, sonic based, radiation bases, magnetic bases, laser based, and for example could be an X-ray diagnostics and inspection-logging device, such as the VISUWELL provided by VISURAY or could be a down hole camera device, such as an OPTIS or NEPTUS camera system provided by EV.

In general, and by way of example, the upper section of the tool 100 may contain a flow passage, and flow regulator and control devices, for a fluid that is transported down a channel associated with the conveyance structure. The conveyance structure, preferably is a line structure, which may have multiple channels for transporting different materials, cables, or lines to the tool 100 and the borehole 102. The channels may be in, on, integral with, releasably connected to, or otherwise associated with the line structure, and combinations and variations of these. Further examples of conveyance structures are disclosed and taught in the following US Patent Application Publications: Publication No. US 2010/0044106, Publication No. 2010/0215326, Publication No. 2012/0020631, Publication No. 2012/0068086, and Publication No. 2013/0011102, the entire disclosures of each of which are incorporated herein by reference. The fluid may be a gas, a foam, a supercritical fluid, or a liquid. The fluid may be used to cool the high power optics in the tool 100, to cool the motor, to cool other sections, to keep the laser beam path clear of debris, to remove or assist in removing cuttings and other material from the borehole, the bottom of the borehole or the work area, and other uses for downhole fluids known to the art. Typically, a liquid may be used to cool the electric motor components.

In general the upper section of the tool 100 may further have an optical package, which may contain optical elements, optics and be a part of an optical assembly, a means to retain the end of the high power optical fiber(s), and an optical fiber connector(s) for launching the beam(s) from the fiber into the optical assembly, which connector could range from a bare fiber face to a more complex connector. High power laser connectors known to those of skill in the art may be utilized. Further, examples of connectors are disclosed and taught in the US Patent Application Publication No. 2013/0011102, the entire disclosure of which is incorporated herein by reference. The upper section of the tool 100 may further have electrical cable management means to handle and position the electrical cable(s), which among other uses, are for providing electric power to the motor section. These electric cable(s) may be contained within, or otherwise associated with, the conveyance structure.

The upper section of the tool 100 also may contain handling means for managing any other cables, conduits, conductors, or fibers that are needed to support the operation of the tool 100. Examples of such cables, conduits, conductors, or fibers would be for connection to, or association with: a sensor, a break detector, a LWD (logging while drilling assembly), a MWD (measuring while drilling assembly), an RSS (rotary steerable system), a video camera, or other section, assembly component or device that may be included in, or with, the tool 100.

In general, the motor section can be any electric motor that is capable, or is made capable of withstanding the conditions and demands found in a borehole, during drilling or opening, and as a result of the drilling or opening process. The electric motor preferably may have a hollow rotating drive shaft, i.e., a hollow rotor, or should be capable of accommodating such a hollow rotor. By way of example, an electronic submersible pump ("ESP") may be used, or adapted to be used, as a motor section for a tool 100.

The general, the lower section contains an optical package, which may contain optical elements, optics and be a part of an optical assembly, for receiving and shaping and directing the laser beam into a particular pattern. The upper section optical package and the lower section optical package may form, or constitute, an optics assembly, and may be integral with each other. The lower section optical package, in part, launches (e.g., propagates, shoots) the beam into a beam path or beam channel within the drill bit so that the beam can strike the bottom, the side, a damaged or obstructed section, of the borehole without damaging the bit. The lower section may also contain equipment, assemblies and systems that are capable of, for example, logging, measuring, videoing, sensing, monitoring, reaming, or steering. Additional lower sections may be added to the tool 100, that may contain equipment, assemblies and systems that are capable of, for example, logging, measuring, videoing, sensing, monitoring, reaming, or steering.

In general, the laser-mechanical bit that is utilized with an electric motor, tool 100, or a laser drilling or opening system, may be any mechanical drill bit, such as a fixed cutter bit or a roller cone bit that has been modified to accommodate a laser beam, by providing a laser beam path, or is associated with a laser beam and/or optics package. Further examples of laser-mechanical boring tools, laser-mechanical bits, their usage, and the laser-mechanical boring process are disclosed and taught in the following US Patent Applications and US Patent Application Publications: Publication No. US 2010/0044106, Publication No. US 2010/0044105, Publication No. US 2010/0044104, Publication No. US 2010/0044103, Publication No. US 2010/0044102, Publication No. 2012/0267168 and Publication No. US 2012/0255774, the entire disclosure of each of which are incorporated herein by reference.

In general, an optical assembly, an optical package, an optical component and an optic, that is utilized with an electric motor, tool 100, or a laser drilling or opening system, may be generally any type of optical element and/or system that is capable of handling the laser beam (e.g., transmitting, reflecting, etc. without being damaged or quickly destroyed by the beam's energy), that is capable of meeting the environmental conditions of use (e.g., down hole temperatures, pressures, vibrates, etc.) and that is capable of effecting the laser beam in a predetermined manner (e.g., focus, de-focus, shape, collimate, steer, scan, etc.). Further examples of optical assemblies, optical packages, optical components and optics are disclosed and taught in the following US Patent Application Publications: Publication No. US 2010/0044105, Publication No. US Publication No. 2010/0044104, Publication No. US 2010/0044103, Publication No. 2012/0267168 and Publication No. US 2012/0275159, the entire disclosure of each of which are incorporated herein by reference.

Turning to FIG. 1B the laser tool 100 has been advanced by the conveyance structure 101 through the pressure management device 104, into the borehole 102, through an upper, undamaged section 102*a*, and to the damaged area 109 of the borehole 102. At this point the laser beam is fired and the drill bit rotated. The laser beam and drill bit remove any formation 106 material, or structures, that obstruct passage into the lower section 102*b* of the borehole, which is below the damaged area 109.

Figure 1C:
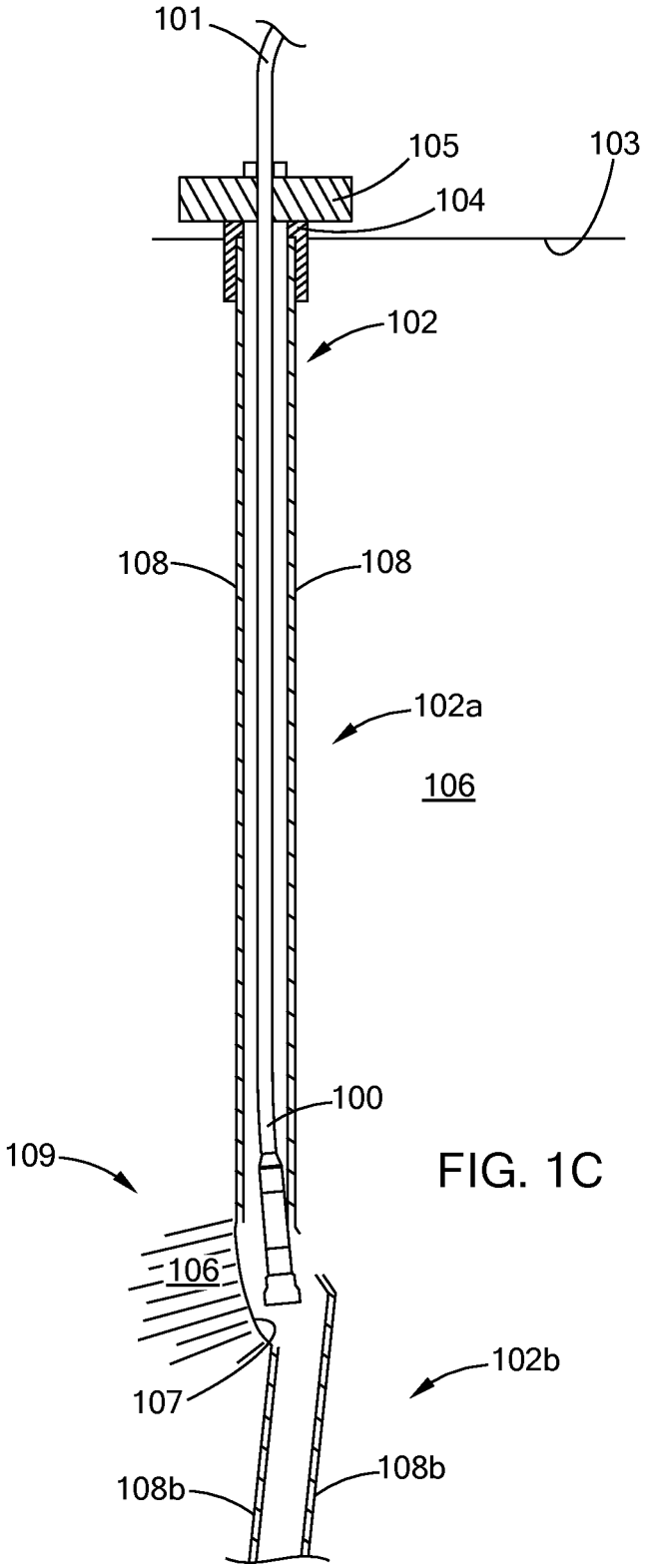

Thus, turning to FIG. 1C. the laser tool has progressed into the damage area 109, and is laser-mechanically removing the formation 106, and any other obstructing materials, that are obstructing the passage of tools. The laser tool 100 is creating a laser affected surface 107 that connects the upper section 102*a* and lower section 102*b* of the borehole 102. It being understood that this laser affected surface 107 could extend around the entire outer wall of the borehole, or may be less than that, as shown for example in the embodiment depicted in FIG. 1C. Additionally, the damage may be such that only inner tubulars need to be removed, e.g., opened up, with the laser tool, and thus, none of the formation need be cut by the laser. The nature and type of damage may vary widely; and it is an advantage of the laser tool and laser decommissioning in general, that these systems can address, handle and open up such varied and unpredictable conditions that may be found in a well that is being decommissioned.

Figure 1D:
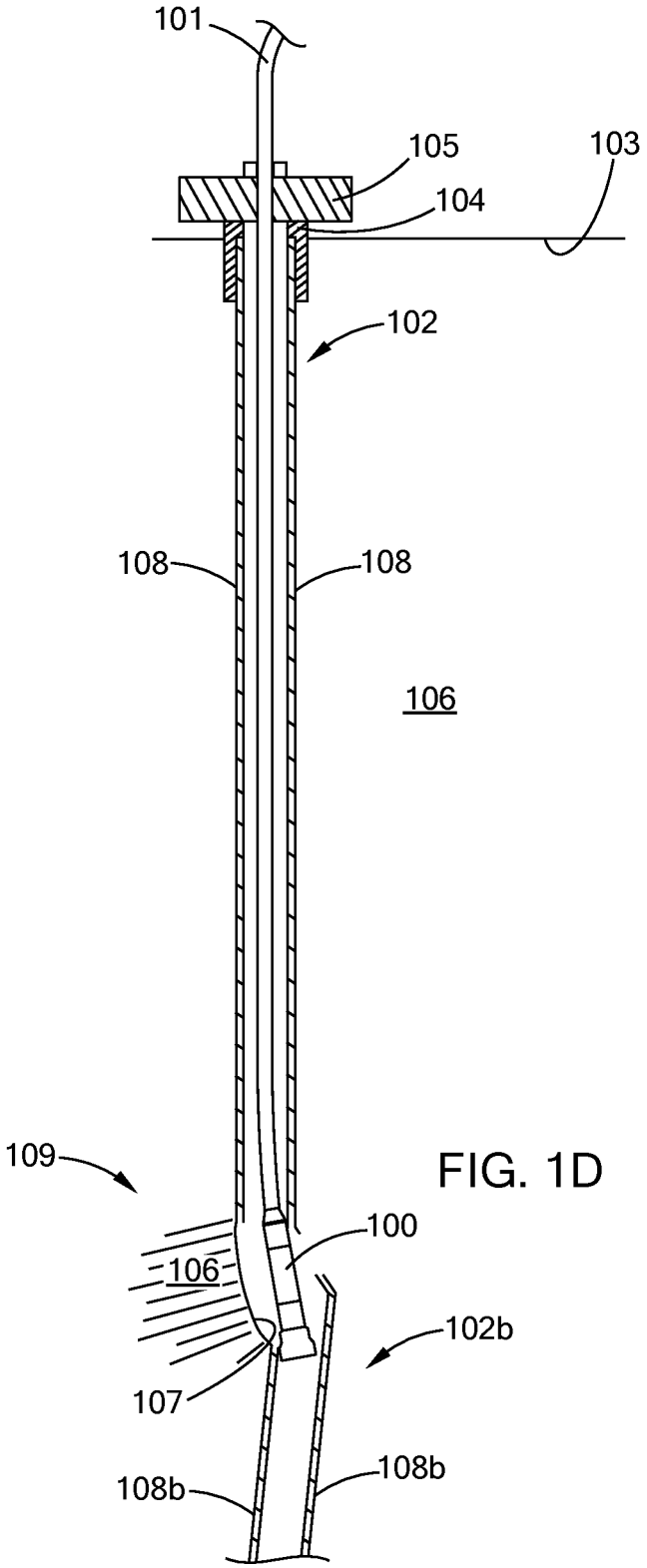

Turning to FIG. 1D, the laser tool 100 is progressing through the damaged section 109, and into the casing 108*b*, which cases the lower section 102*b* of borehole 102. Thus, in this embodiment some of the casing 108 and 108*b* is removed by the action of the laser-mechanical bit 124.

Figure 1E:
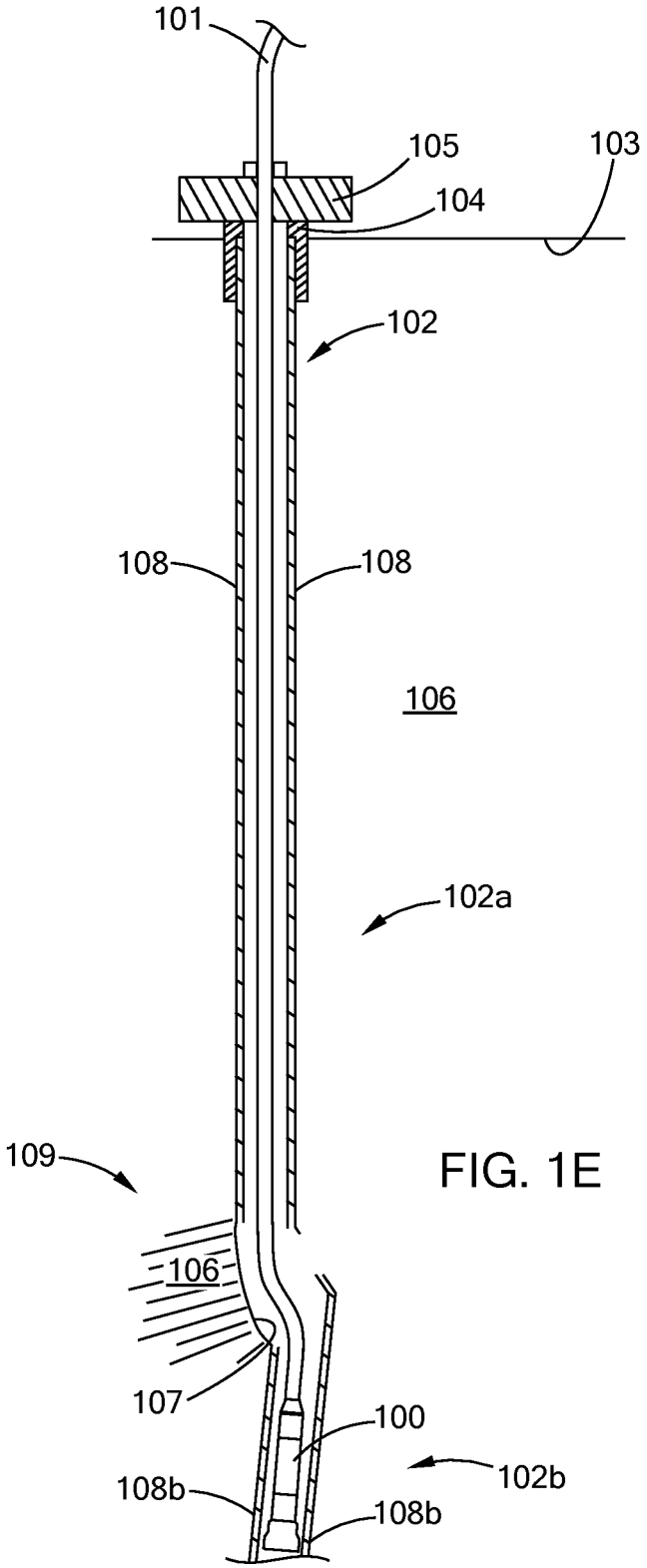

Turning then to FIG. 1E, the laser tool is shown progressing deeper into the borehole 102, having successfully opened up the damages section 109. This, or similar, laser-mechanical operations can be performed on lower damaged areas or obstructions. In this manner the laser tool 100 can open up the entire required length of the borehole, for subsequent cutting and plugging operations to take place.

Figure 2:
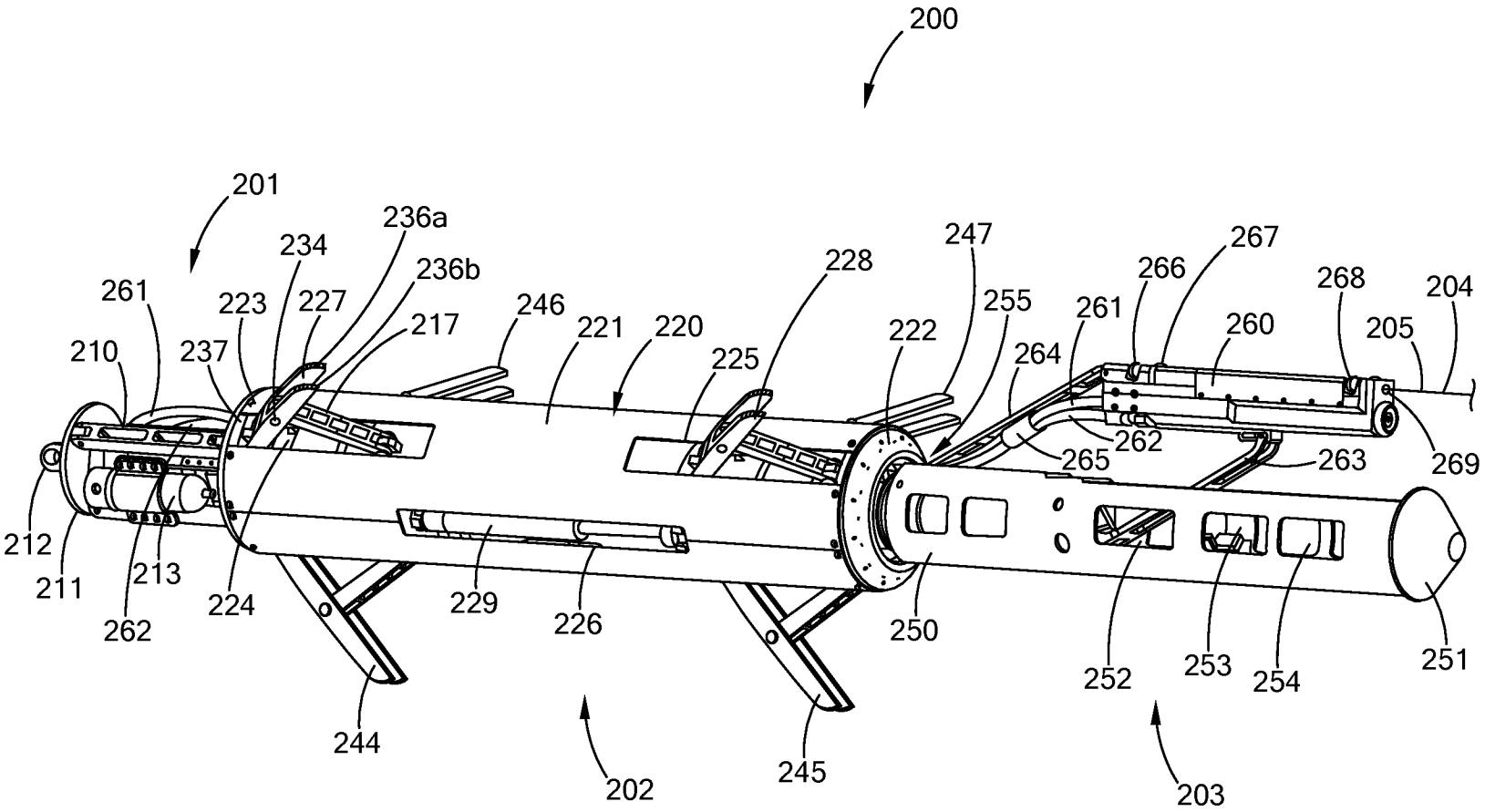
FIG. 2 is a perspective view of an embodiment of a laser decommissioning and opening tool in accordance the present inventions.

Turning to FIG. 2 a perspective view of an embodiment of a laser tool 200 is shown in a deployed configuration, e.g., the anchors and laser cutter pad are extend and positioned in a manner that would be seen inside of the tubular when a laser cut is being performed. The high power laser decommissioning tool 200 has three sections: an upper section 201, a middle section 202, and a lower section 203. Generally, and unless specified otherwise, the upper section will also be the distal end, which is closest to and may connect to the laser beam source, and the lower section is the proximal end and will be the end from which the laser beam is delivered to an intended target area or material to be cut. Thus, in the case of a vertical tubular to be opened with an inside cut and then potentially further cut with an inside-out cut, when the laser tool 200 is positioned in the tubular to perform the laser cut, the lower section 203 would be oriented further in, lower, or down, or closer to the damaged section of the tubular or well, than the middle section 202 and the upper section 203.

In this embodiment of a laser decommissioning tool, these sections 201, 202, 203, are discrete and joined together by various mechanical attachment means, such as flanges, screws, bolts, threated connection members, rotary seals, and the like. Further in this embodiment the lower section 203 rotates with respect to the middle 202 and upper sections 201, which are preferably fixed, or remain relatively stationary, with respect to the tubular to be cut during the laser cutting or opening operation. Other embodiments having different fixed and rotating sections may be utilized, as well as, more or less sections; and having one or more, or all, sections being integral with each other, also mechanical cutters may be combined with this embodiment. Further, the laser beam, or multiple laser beams, may be delivered from more than one section, from the middle section, from the upper section, from an additional section, from multiple and different sections, and combinations and variations of these. Additionally, as well as being delivered axially, e.g., downwardly toward, or into the damaged section to open that section up, the laser beam may be directed radially, or an other laser beam may be directed radially to perform cuts in the tubulars, formation and both to create passage ways for plug materials to form a plug, and preferably to from a rock-to-rock seal.

The upper section 201 has a frame 210, a cap 211, an attachment member, e.g., an eye hole, 212, a fluid filter 213, a second fluid filter (not seen in the view of FIG. 2). The fluid can be a gas or a liquid, and if a gas can be air, nitrogen, an inert gas, oxygen, or other gasses that are, or may be, used in the laser cutting processes. In this embodiment the gas is preferably nitrogen or air, and more preferably nitrogen. The middle section 202 has a body 220. The middle section 202 body 220 has a middle section cover or housing 221, which is associated with a lower end cap 222 and an upper end cap 223. The housing 221 has several openings, e.g., 224, 225, which permit the anchoring legs, e.g., 227, 228, which may be actuated, e.g., hydraulically, electronically or both, to extend out from the body 220 and anchor the tool against a tubular. The housing 221 also has several openings 226, which accommodate, e.g., provide space for, the pistons, e.g., 229, which are used to extend the anchoring legs and engage the inside surface of a tubular. The anchoring legs and pistons with their cylinders are a part of an anchoring assembly.

The lower section 203 has a housing 250 that rotates with respect to the middle section body 220. The lower section housing 250 has openings, e.g., 252, 253, 254, and an end cone 251. The laser cutter pad 260, when in the retracted configuration or position, is contained within the housing 250. Port 255 provides a pathway for the high power laser fiber, gas line, and other cables, e.g., data and information wires, to extend into the middle section 220 from the laser cutter pad 260. Port 155 allows the high power laser cable, gas line, conduit or hose, and any information and data lines and cables to pass into the middle section 202, where the housing 221 protects them from the exterior conditions and provides for the rotation of the lower section to perform a laser cut of a tubular.

Using anchoring leg 227 for illustrative purposes, recognizing that in this embodiment the other anchoring legs are similar (although in other embodiments they may not all be the same or similar), the anchoring legs have a pivot assembly providing a pivot point at the end of a ridged member. The ridged member has a second pivot assembly 234, which provides a second pivot point about a little less than midway along the length of the ridged member. The ridged member extends beyond pivot assembly 234 to an end section that has two engagement feet 236*a*, 236*b*, which feet engage, or abut against the inner wall of a tubular, or other structure in the tubular. A second ridged member 217 extends between, and mechanically connects, pivot assembly 234 to a pivot assembly. The pivot assembly is associated with sliding ring and another pivot assembly is associated with flange 237. In this manner as the sliding ring is moved toward a stop by piston and piston arm, e.g., 229, the ridged members will move in a somewhat scissor like manner extending feet, e.g., 236*a*, 236*b* outward and away from inner body.

Thus, for example the tool 200 can be positioned in a well at a damaged section of a tubular; anchored; and the laser beam delivered as the lower section 103 is rotated cutting out any obstruction, or otherwise opening up the damaged section. Mechanical action may not be required as the cut free section, e.g., a core section, can fall to the bottom of the borehole. However, it is contemplated that mechanical removal devices, such as a jet, abrasive jet, drill or scraper may be used and the laser cut is made, with the tool 200 being removed, or more preferably the mechanical removal device is a part of the tool 200 and operates in coordination with the laser cutting.

In general, the laser beam can clean, cut, penetrate and remove target material(s) by melting them, vaporizing them, softening them, causing laser induced break down of them, ablating them, weakening them, spalling them, thermally or otherwise fracturing them, and combinations and variations of these and other ways of affecting material(s), alone and in combination with mechanical forces, and combinations and variations of these. These laser induced phenomena and processes are also disclosed and discussed in US Patent Publ. No. 2012/0074110, Ser. No. 13/782,869, Ser. No. 14/080,722 (the entire disclosures of each of which are incorporated herein by reference) and in particular, how they relate to removing, opening, cutting, severing or sectioning of material(s), object(s) or targeted structure(s), the entire disclosure of which is incorporated herein by reference.

Turning back to FIG. 2 there is shown a prospective view of the tool 200 with the anchoring legs 227, 244, 245, 246, 247 extended and with the laser cutter pad 260 extended, e.g., as configured or positioned to perform a cutting operation in a tubular. In the view of this figure the gas lines 262 and the high power optical fiber and cable 261 are seen. (The monitoring and sensor wires are not shown for clarity purposes.)

The laser cutter pad 260 is extended by pad arm 263 and pad arm 264 from the lower section 203 housing 250. The laser beam 204 is fired from a nozzle 269 and travels along laser beam path 205. This assembly forms a modified four bar linkage that provides for the lower, or proximal end of the pad, to be at an equal or smaller distance to the inner surface of tubular, than any other portion of the pad. In this way as the pad is extended and the lower section 203 is rotated for a cutting operation the stand off distance, e.g., the distance that the laser beam 204 has to travel along its laser beam path 205 after leaving the pad 260 until it strikes the target surface, is maintained relatively constant, and preferably kept constant as the pad is rotated around the inner surface of the tubular. The pad 260 has four rollers 266, 267, 268, (the fourth roller is not seen) that are for engagement with, and rolling along, the inner surface of the tubular as the pad is rotated within a tubular. The high power optical fiber cable 261, having the high power optical fiber, and the gas line 261 (as well as any data, information, sensors or other conductors) extend from the upper end (the distal end) of the pad 260, and are partially retained by bracket 265 against arm 264 and run into the middle section 202. The optical cable 261 and the gas line 262 travel into the middle section 202 through port 255. Inside of the middle section 202 they are wrapped about inner components of that section, so that during rotation of the lower section they may be unwrapped and wrapped again, permitting the lower assembly to rotate first in one direction and then back in the other direction, without the need for an optical slip ring.

The laser fiber cable and the gas line exit the laser cutter pad 260 and travel along pad arm 264 until the enter middle section 202 via port 255. Once inside of the middle section 202, the laser fiber cable 261 and the gas line 262 are positioned in annuls. The annulus is formed between an inner body and motor section assembly. The annulus can be subjected to the environmental conditions of the tool, e.g., it is open to the outside or ambient environment of the tool, which would include the environment within the tubular to be cut. The laser fiber cable and gas line are wrapped around motor section assembly, preferably in a helix. In this manner, the lower section 203 can be rotated in one direction unwinding the helix and then rotated back in the other direction winding the helix. In this manner multiple laser cutting passes can be made around the interior of a tubular, and for example if the damaged or clogged area is deep, the depth of the cut can be increased by these repeated passes (also if needed a jet or other means can be used to keep the laser cut clear of debris or dross). Embodiments of the laser cutting tools and laser jets for use with laser cutting tools of various types of embodiments are taught and disclosed in US Patent Application Publ. No. 2012/0074110 and Publ. No. 2013/0319984, the entire disclosures of each of which are incorporated herein by reference.

Figure 3:
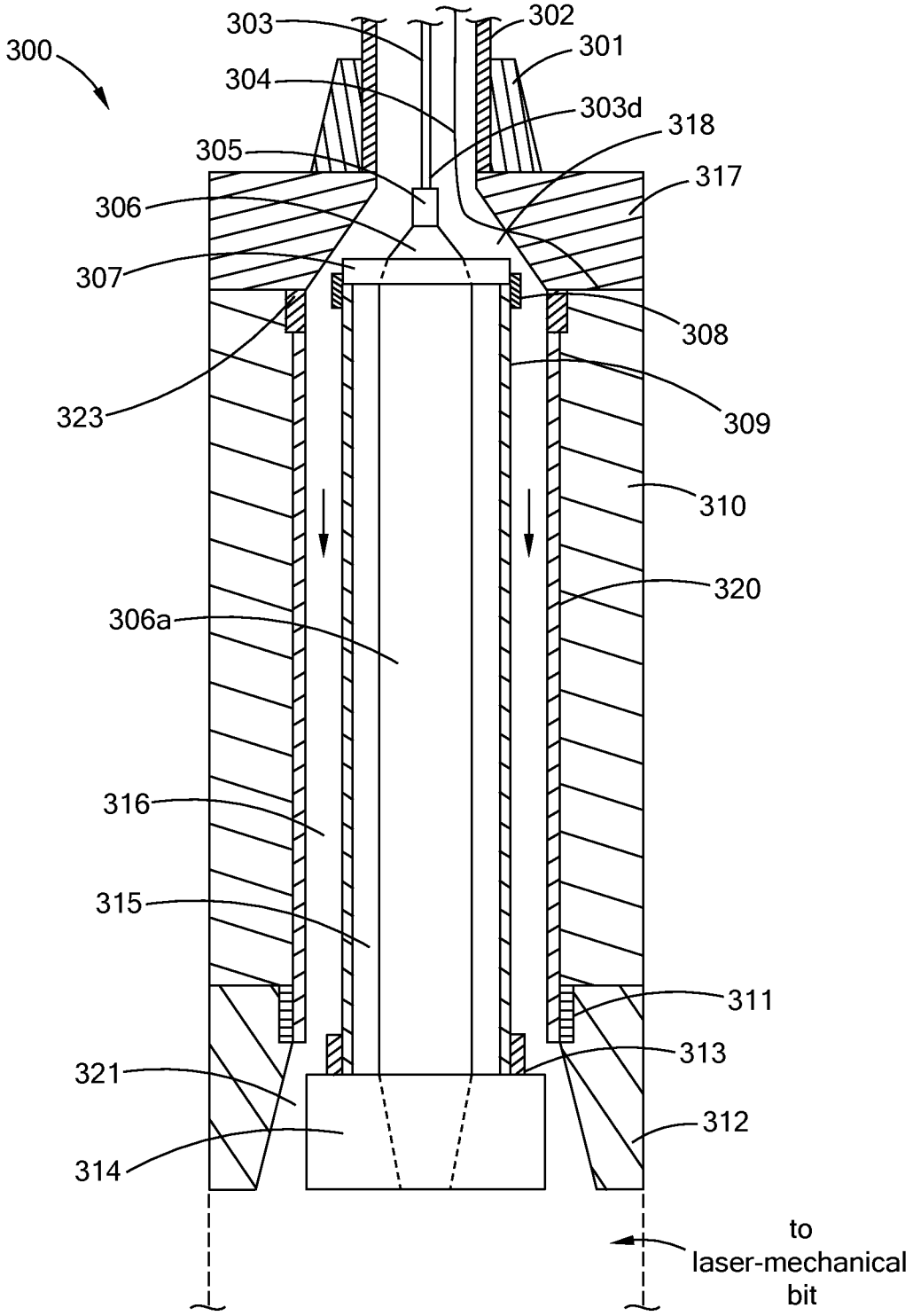
FIG. 3 is a cross sectional schematic view of an embodiment of a laser decommissioning and opening tool in accordance the present inventions.

Turning to FIG. 3 there is shown a cross-section view of an embodiment of a laser decommissioning and opening tool 300. Thus, there is provided a tool 300 having an upper section 317, a motor section 310, and a lower section 312.

The upper section 317 has a channel 318, which may be annular. Channel 318 is in fluid communication with the conveyance structure 302 and motor channel 316, which may be annular. The upper section 317 also may house, or contain, the distal end 303*d* of the optical fiber 303, a connector 305 and optical package 307. The laser beam 306 in FIG. 3 is being launched from (e.g., propagated) from connector 305 into optical package 307. In operation, a high power laser (not shown) generates a high power laser beam that is coupled (e.g., launched into) the proximal end (not shown) of the high power optical fiber 303. The high power laser beam is transmitted down the optical fiber 303 and is launched from the distal end 303*d* of the optical fiber 303, into a connector 305, and/or into the optical package 307. The laser beam travels along path 306 as it is launched into the optical package 307. The laser beam leaves, is launched from, the optical package 307 and travels along beam path 306*a* through an electric motor beam channel 315 to optical package 314.

In the embodiment of FIG. 3, a connector 305 is used, it being understood that a fiber face or other manner of launching a high power laser beam from a fiber into an optical element or system may also be used. The optical package 307, in this embodiment of FIG. 3, includes collimating optics; and as such, the laser beam traveling along beam path 306*a* through the electric motor beam channel 315 is collimated, this beam path 306*a* may also be referred to as collimated space. In this manner, the electric motor beam channel 315 is in, coincides with, collimated space.

The optical package 314 may be beam shaping optics, as for example are provided in the above incorporated by reference patent applications, or it may contain optics and/or a connector for transmitting the beam into another high power fiber, for example for transmitting the beam through additional lower section and/or over greater lengths.

The construction of the motor section preferable should take into consideration the tolerances of the various components of the electric motor when operating and under various external and internal conditions, as they relate to the optical assemblies, beam path and the transmission of the laser beam through the electric motor. Preferably, these tolerances are very tight, so that variations in the electric motor will not adversely, detrimentally, or substantially adversely, affect the transmission of the laser beam through the electric motor. Further, the optical assemblies, including the optical packages, optics, and optical elements and systems and related fixtures, mounts and housing, should take into consideration the electric motor tolerances, and may be constructed to compensate for, or otherwise address and mitigate, higher electric motor tolerances than may otherwise be preferably desirable.

The first optical package 307 and the second optician package 314, constitute and optical assembly, and should remain in alignment with respect to each other during operation, preferably principally in all three axes. Axial tolerances, e.g., changes in the length of the motor, i.e., the z axis, when the optical assembly, or the electric motor beam path channel, encompass collimated space, may be larger than tolerances in the x,y axis and tolerances for tilt along the x,y axis, without detrimentally effecting the transmission of the laser beam through the electric motor. Thus, preferably a centralization means, such as a centralizer, a structural member, etc., can be employed with to the optical package 314. Thus, it is preferable that the motor section 310 be stiff, i.e., provide very little bending. Additionally, the length of the motor section in which the optical packages and the optical assembly are associated, may be limited by the distance over which the laser beam, e.g., 306*a*, can travel within the beam path channel 315.

The motor 310 has a beam path channel 315, which is contained within a beam path tube 309. The beam path tube 309 is mechanically and preferably sealing associated with the optical package 307 by attachment means 308, and with optical package 314 by attachment means 313. The beam path tube 309 may rotate, e.g., move with the rotation of the rotor 320, be fixed to, with, the optical package 307 and thus not rotate, or be rotatable but not driven by, or not directly mechanically driven by the rotor 320.

Preferably, when using a fluid that is not transmissive or substantially not transmissive to the laser beam, or that may have contamination, e.g., oils or dirt, which could foul or harm an optical element, a beam path tube may be utilized. The beam path tube isolates, or separates, the beam path channel, and thus the laser beam and associated optical elements, from such a laser incompatible fluid. Additionally, flow channels through, around, or entering after, the non-rotating components of the motor section may be used, to provide the fluid to the drill bit, or other components below the motor section, while at the same time preventing that fluid from harming, or otherwise adversely effecting the laser beam path and its associated optical elements.

The attachment means 313 and 308 may be any suitable attachment device for the particular configuration of beam path tube, e.g., rotating, fixed, rotatable. Thus, various arrangements of seals, bearings and fittings, known to those of skill in the motor and pump arts may be employed. A further consideration, and preferably, is that the attachment means also provides for a sealing means to protect the beam path channel 315 from contamination, dirt and debris, etc, both from the fluid as well as from the attachment means itself. The faces of the optic elements of the optical packages 314, 307, as well as, the interior of the beam path channel 315 should be kept as free from dirt and debris as is possible, as the present of such material has the potential to heat up, attach to, or otherwise damage the optic when a high power laser beam is used, or propagated through them.

The motor 310 has a rotor 320 that is hollow along its length, and has a rotor channel 316. The rotor channel 316 is in collimated space. The rotor channel 316 is in fluid communication with the upper section channel 318 and the lower section channel 321. During operation the rotor 320 is rotated, and thus rotates the lower section 312 and whatever additional section(s) are mechanically connected to the lower section, such as for example a bit. The rotor, and/or the motor section are attached to the upper and lower section by way of attachment means 311 and 323. Thus, various arrangements of seals, bearings and fittings, known to those of skill in the motor and pump arts may be employed. Further connecting, attachment and sealing means may be employed between the various sections of the tool 100 to meet the pressure, temperature and other down hole conditions and environments. Thus, various arrangements of seals, bearings and fittings, known to those of skill in the motor and pump arts may be employed.

By way of example, in a preferred mode of operation electric power from line 304 is provided to the motor 310, which causes rotor 320 to rotate. The exterior of motor 310 does not rotate. A fluid transported down hole by the conveyance structure 302 flows from the conveyance structure through the first section channel 318, into the rotor channel 316 and into the lower section channel 321 and on to other channels, ports, nozzles, etc. for its intended use(s). The optical package 314 is mechanically fixed with the rotating portions of the lower section 312, and thus, is rotated, either directly or indirectly, by the rotor 320. For example, the optics may be attached to the lower section by way of spoke-like members extending across channel 321.

The motor may also be configured such that it operates as an inside-out motor, having the exterior of motor 310 rotate and the rotor 320 remain stationary. In this situation a corresponding connection for the non-rotation rotor to the conveyance structure, which also is non-rotating, may be employed.

In determining the size of the various channels, the flow requirements for the particular use of the tool 300 must be considered, e.g., the size of the damaged section, the nature of the obstruction, the presence of borehole or other fluids, and other consideration present at the damaged section or sections of the well. These requirements should also be balanced against the laser power requirements and the size of the beam that will be launched between the non-rotating portions of the tool 300, e.g., 317, 307 and the rotating portions, e.g., 312, 314.

In the embodiment shown in FIG. 3, the preferred transitional zone between rotation and non-rotating optical components of the optical assembly is the motor section 310. In this section the beams travel through free space, i.e., not within a fiber or waveguide, and further the free space is collimated space. Collimated space for this transitional zone is preferred; non-collimated space, e.g., defocus, use of an imaging plane, etc., may be also be utilized. A fiber could also be used to convey the laser beam between the rotation and non-rotating components. In this case an optical slip ring type of assembly would be employed, in the rotating or non-rotating sections or between those sections.

Although the components of each section, and each section of the device are shown in the drawings as being completely contained within each section and/or having a clear line of demarcation, such distinctions are only for the purpose of illustration. Thus, it is contemplated that the various sections may have some overlap, that the components of the various section may extend from one section into the next, or may be located or contained entirely within the next or another section.

In general, in the laser-mechanical opening of damaged boreholes or drilling process, even when advancing the borehole through hard and very hard rock formations, e.g., 25 ksi (thousand pounds per square inch) and greater, very low weight on bit ("WOB"), and torque may be needed. Thus, the reactive torque from the rotation of the bit may be managed by the conveyance structure. If for some reason, it was determined that high(er) WOB and/or torque(s) are needed, or for sum other reason it is viewed as undesirable to have some or all of the reactive torque managed by the conveyance structure, stabilizers and/or anchor type devices could be added to the outer sides of the motor section and/or upper section, which would engage the sides of the borehole, preventing and/or reducing the tendency of that section to rotate in response to the forces created by the bits' rotational engagement with the borehole surface.

Additionally, and in general, gearboxes may be used in embodiments of a laser decommissioning and cutting tool. The gearboxes may be included, as part of the motor section, or may be added to the assembly as a separate section and may include a passage for an optical fiber and or a beam path channel. In addition to the use of a gearbox multiple motor sections may be utilized. Thus, the motors may be stacked, in a modular fashion one, above, or below the other. Electrical power and the high power laser optics may be feed through the central hollow shafts if the stack of motors, for example. Additionally, an "inside out", e.g., the outside of the motor rotates and the inside hollow shaft remains stationary, motors may be used, in conjunction with a traditional motor. In this manner creating a stack of alternating conventional and inside out motor sections, which a fiber and/or free space beam channel going through the stack.

Further, although use with a line structure, or other continuous type of tube is preferred as the conveyance structure, the motor sections and/or the tool can be used with jointed pipe (to lower and raise the tool and to added additional rotational force if needed) and/or with casing, (e.g., for patching or bridging a damaged area, along the lines of casing while drilling operations).

Figure 4:
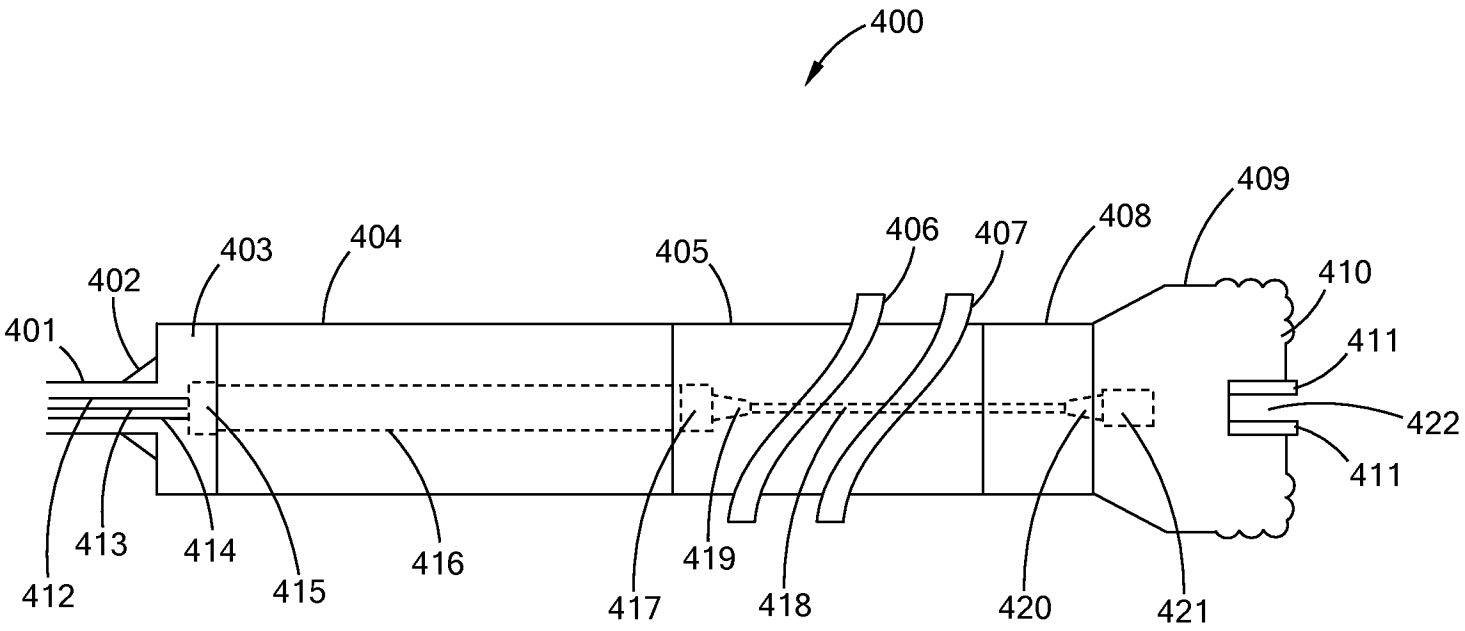
FIG. 4 is a cross sectional schematic view of an embodiment of a laser decommissioning and opening tool in accordance the present inventions.

Turning to FIG. 4 there is provided an embodiment of a laser decommissioning and opening tool having a tractor section. Thus, there is shown an laser decommissioning and opening tool 400 having an upper section 403, a motor section 404, a first lower section, which is a tractor section 405, a second lower section 408, and a bit section 409. There is also shown a conveyance structure connector 402 and conveyance structure 401. The conveyance structure may be any suitable line structure or tubular as described above. The relationship and placement of the optical assemblies and optical paths, with respect to the motor sections is shown by phantom lines. Thus, three high power optical fibers 412, 413, 414, (one, two, three, four, five or more fibers may be utilized, with each fiber transmitting a laser beam having about 10 kW, about 15 kW, about 20 kW and greater powers), which were contained within, or otherwise associated with, conveyance structure 401, are optically associated to an optical package 415. The laser beam path, and the laser beam when the laser is fired, travels through a beam path channel that is formed by beam path tube 416. Beam path tube 416 connects to optical package 417, which connects to a connector 419, which in turn connects to an optical fiber(s) 418. Fiber(s) 418 travel through, are contained within, tractor section 405, and then are optically associated with connector 420, which in turn is optically connected to optical package 421. The laser beam is shaped and focused to a desired and predetermined pattern by the optical package and launched from the associated optical elements, which could for example be a window, toward the surface of the borehole. In this manner the laser beam would travel from the optical package 421 through a channel within the bit, existing through a beam slit 422, which in this embodiment is framed by beam path blades 411. In this embodiment the bit would utilize PDC cutters, e.g., 410. The motor section may have any type of down hole motor drilling motor or motors used in milling tools, such as, a mud motor, positive displacement motor, air motor, and electric motor (noting that because of the laser's weakening of the material to be cut, lower and significantly lower torque requirements are need, then would be anticipated for conventional drilling, milling or machining applications); preferably the motor section has an electric motor.

Tractor section 405 has external blades 406, 407 these blades are configured around the exterior of the section 405, such they engage the side wall of the borehole and when rotated in one direction, (which is also the direction of rotation for the bit to drill) they advance, drive, the laser decommissioning and opening tool forward, i.e., in a direction toward the bottom of the borehole. Similarly, when the blades 406, 407 are rotated in the other direction they move the laser decommissioning and opening tool back, up, or away from the bottom of the borehole.

In the embodiment of FIG. 4 is noted that preferably optical components, 417, 419, 418, 420, and 421 rotate with the sections 405, 408, 409. Thus, the transition for non-rotating optical components to rotating optical components takes place within the motor section 404 and at least partially within the free space of a beam path channel. Embodiments of tool 400 where this transition occurs at other locations are contemplated. For example, an optical fiber could be extended through the motor section 404, and the first lower section 405, where in would enter an optical slip ring type assembly, which would be associated with the rotating optics 421, in the bit section. Still further, those rotating optics 421 could be located in section 408 and the length of the channel in the bit for transmitting the laser beam through the bit increased.

Figure 5:
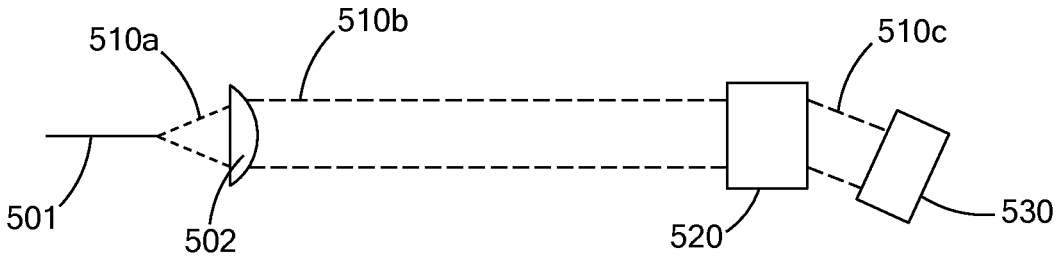
FIGS. 5, 5A and 5B are cross sectional schematic views of embodiments of optical paths for laser decommissioning and opening tools in accordance the present inventions.
Figure 5A:
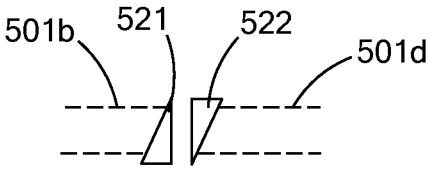
Figure 5B:
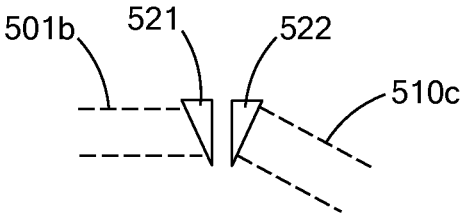

Turning to FIGS. 5, 5A and 5B there are shown schematics of embodiments of the beam paths and optical components for a bent sub in association with a decommissioning and opening laser tool. A fiber 501 launches a laser beam along beam path 510*a* into a collimating optic 502. The laser beam exists collimating optic 502 and travels along beam path 510*b*, which is in collimated space and enters steering collar 520. The beam exist steering collar 520 and travels along beam path 510*c*, which is in collimated space, and at an angle to beam path 510*b*, and enters optics 530 that are rotating in the bent section of the bent sub. The steering collar 520 contains a beam steering assembly that has two wedges 521 and 522. These wedges, or at least one of these wedges are movable with respect to each other. Thus, as shown in FIG. 5A, the wedges 521, 522 are positioned to provide for a straight, coaxial propagation of the laser beam along beam path 510*d*. As shown in FIG. 5B the wedges 520, 521 are configured to provide for an angled propagation of the laser beam, that would be utilized for example during direction drilling and opening with a bent sub. In this manner the wedge, or wedges can be configured, positioned or adjusted to direct a collimated laser beam along a beam path that follows the shape of a bent sub or directional drilling and opening assembly. In this manner the optical wedge(s) may be adjusted in parallel with, or in concert with, the mechanical wedges, or other mechanical means for determining the angle of the bend for the bent sub. Further, connectors, optics and fibers may be associated with the wedge assemblies to transmit the laser beam further, over greater lengths, before or after the mechanical bend in the assembly.

Figure 6:
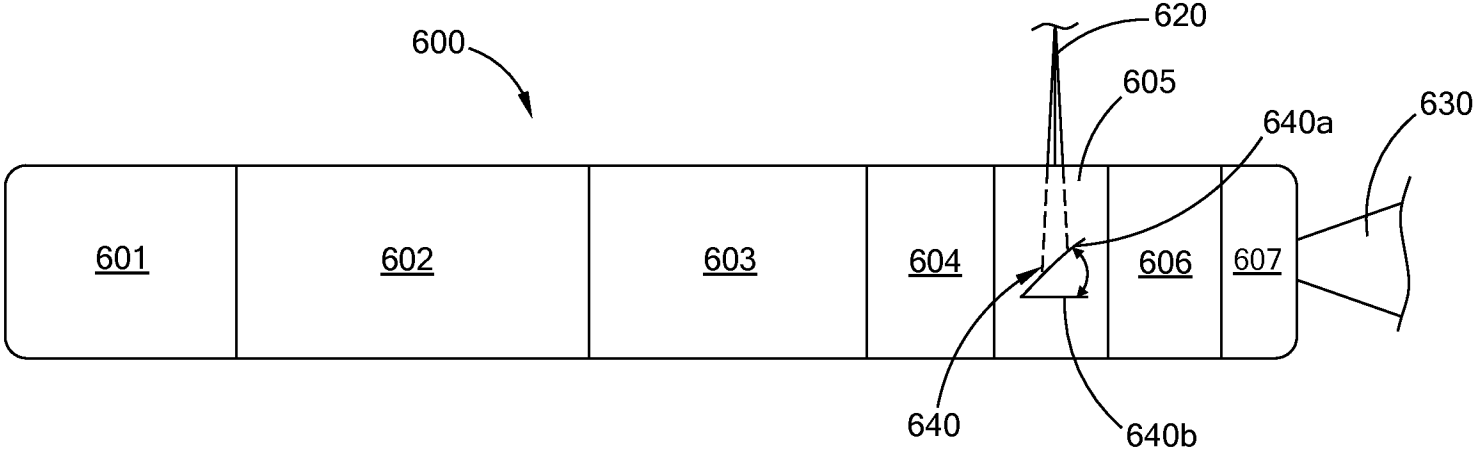
FIG. 6 is a schematic view of an embodiment of a laser decommissioning and opening tool in accordance the present inventions.

Turning to FIG. 6, there is shown an embodiment of a laser decommissioning and opening tool 600. The laser tool 600 has a conveyance termination section 601, an anchoring and positioning section 602, a motor section 603, an optics package 604, an optics and laser cutting head section 605, a second optics package 606, and a second laser cutting head section 607. The conveyance termination section would receive and hold, for example, a composite high power laser umbilical, a coil tube having for example a high power laser fiber and a channel for transmitting a fluid for the laser cutting head, a wireline having a high power fiber, or a slick line and high power fiber. The anchor and positioning section may have a centralizer, a packer, or shoe and piston or other mechanical, electrical, magnetic or hydraulic device that can hold the tool in a fixed and predetermined position both longitudinally and axially. The section may also be used to adjust and set the stand off distance that the laser head is from the surface to be cut. The motor section may be an electric motor, a step motor, a motor driven by a fluid or other device to rotate one or both of the laser cutting heads or cause one or both of the laser beam paths to rotate. Motor, optic assemblies, and beam and fluid paths of the types that are disclosed and taught in the following U.S. patent application Ser. No. 13/403,509; Ser. No. 61/403,287; Publication No. 2012/0074110; Ser. No. 61/605,429; Ser. No. 61/605,434; and, Ser. No. 13/403,132, may be utilized, the entire disclosures of each of which are incorporated herein by reference. There is provided an optics section 604, which for example, may shape and direct the beam and have optical components such as a collimating element or lens and a focusing element or lens. Optics assemblies, packages and optical elements disclosed and taught in the following U.S. patent application Ser. No. 13/403,132; and, Ser. No. 13/403,509 may be utilized, the entire disclosure of each of which is incorporated herein by reference. The optics and laser cutting head section 605 has a mirror 640. The mirror 640 is movable between a first position 640*a*, in the laser beam path, and a second position 640*b*, outside of the laser beam path. The mirror 640 may be a focusing element. Thus, when the mirror is in the first position 640*a*, it directs and focuses the laser beam along beam path 3020. When the mirror is in the second position 640*b*, the laser beam passes by the mirror and enters into the second optics section 606, where it may be shaped into a larger circular spot (having a diameter greater than the tools diameter), a substantially linear spot, or an elongated epical pattern, as well as other spot or pattern shapes and configurations, for delivery along beam path 630. The tool of the FIG. 6 embodiment may be used, for example, in the opening, boring, radially cutting and, sectioning methods discussed herein, wherein beam path 630 would be used for axial opening and boring of a damaged well and beam path 620 would be used for the radial and axial cutting and segmenting of the well, casings tubulars and formation, to form e.g., plug channels. The laser beam path 620 may be rotated and moved axially. The laser beam path 630 may also be rotated and preferably should be rotated if the beam pattern is other than circular and the tool is being used for opening or boring. Thus, the embodiment of FIG. 6 may preferably be used to clear, pierce, cut, or remove junk or other obstructions from the bore hole to, for example, facilitate the passage of decommissioning tools and the pumping and placement of cement plugs during the plugging or decommissioning of a bore hole.

Figure 7:
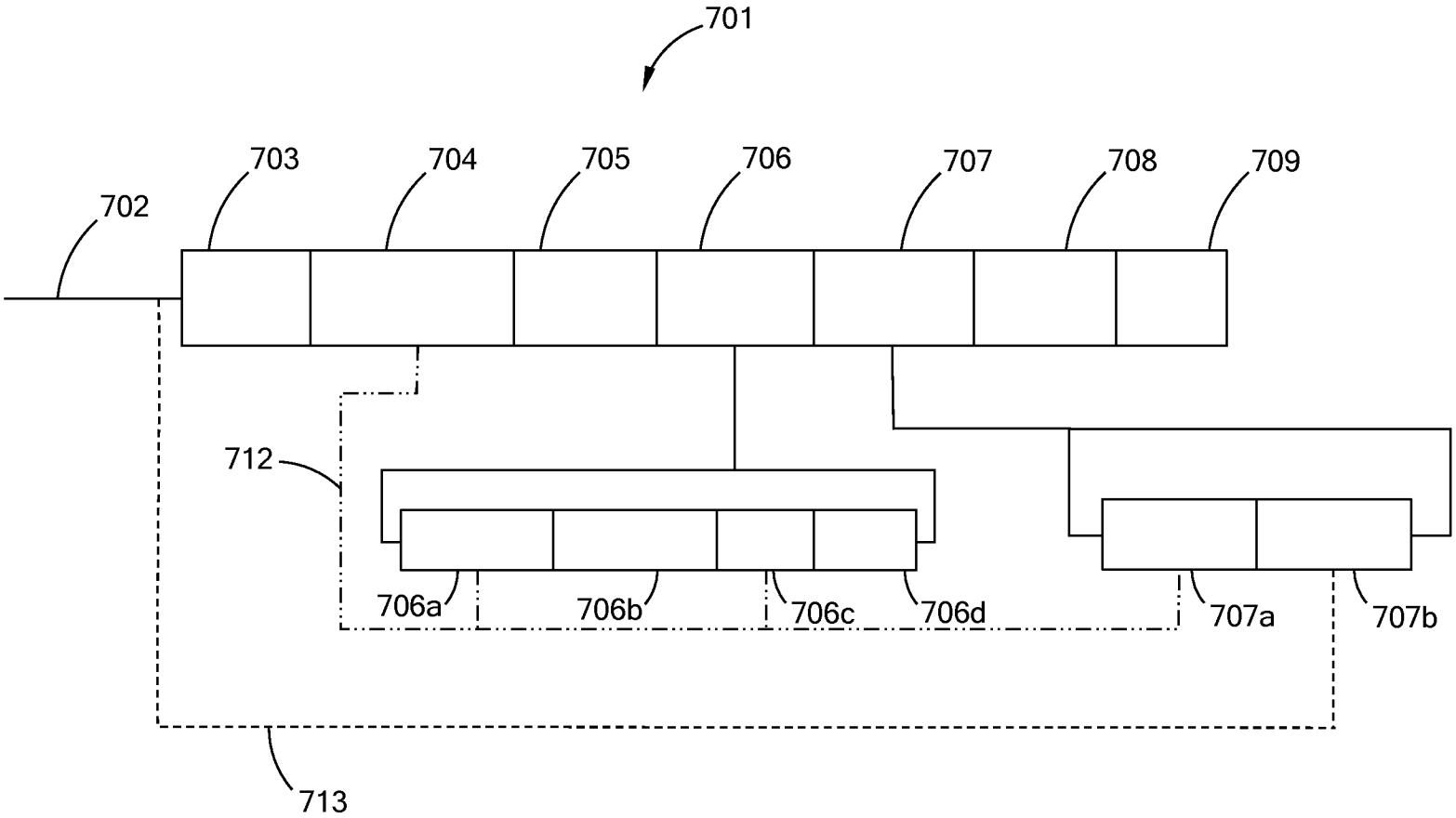
FIG. 7 is a schematic view of an embodiment of a laser decommissioning and opening tool in accordance the present inventions.

Turning to FIG. 7, there is provided a schematic of an embodiment of a laser opening and cutting tool 701. The laser tool 701 has a conveyance structure 702, which may have an E-line, a high power laser fiber, and an air pathway. The conveyance structure 702 connects to the cable/tube termination section 703. The tool 701 also has an electronics cartridge 704, an anchor section 705, a hydraulic section 706, an optics/cutting section (e.g., optics and laser head) 707, a second or lower anchor section 708, and a lower head 709. The electronics cartridge 704 may have a communications point with the tool for providing data transmission from sensors in the tool to the surface, for data processing from sensors, from control signals or both, and for receiving control signals or control information from the surface for operating the tool or the tools components. The anchor sections 705, 708 may be, for example, a hydraulically activated mechanism that contacts and applies force to the borehole. The lower head section 709 may include a junk collection device, or a sensor package or other down hole equipment. The hydraulic section 706 has an electric motor 706*a*, a hydraulic pump 606*b*, a hydraulic block 706*c*, and an anchoring reservoir 706*d*. The optics/cutting section 707 has a swivel motor 707*a* and a laser head section 707*b*. Further, the motors 704*a* and 706*a* may be a single motor that has power transmitted to each section by shafts, which are controlled by a switch or clutch mechanism. The flow path for the gas to form the fluid jet is schematically shown by line 713. The path for electrical power is schematically shown by line 712. The laser head section 707*b* preferably may have any of the laser fluid jet heads provided in this specification, it may have a laser beam delivery head that does not use a fluid jet, and it may have combinations of these and other laser delivery heads that are known to the art.

Figure 8A:
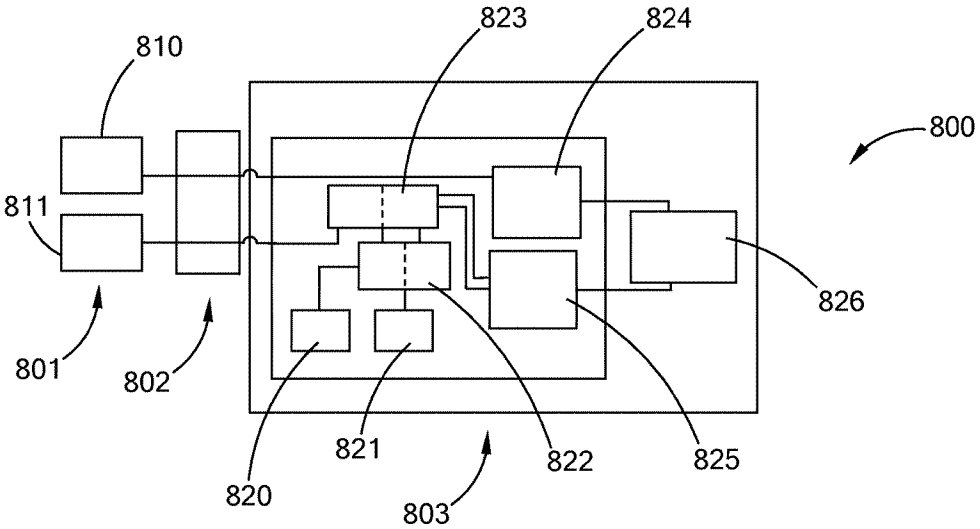
FIG. 8A is a schematic view of an embodiment of a laser decommissioning and opening tool in accordance the present inventions.
Figure 8B:
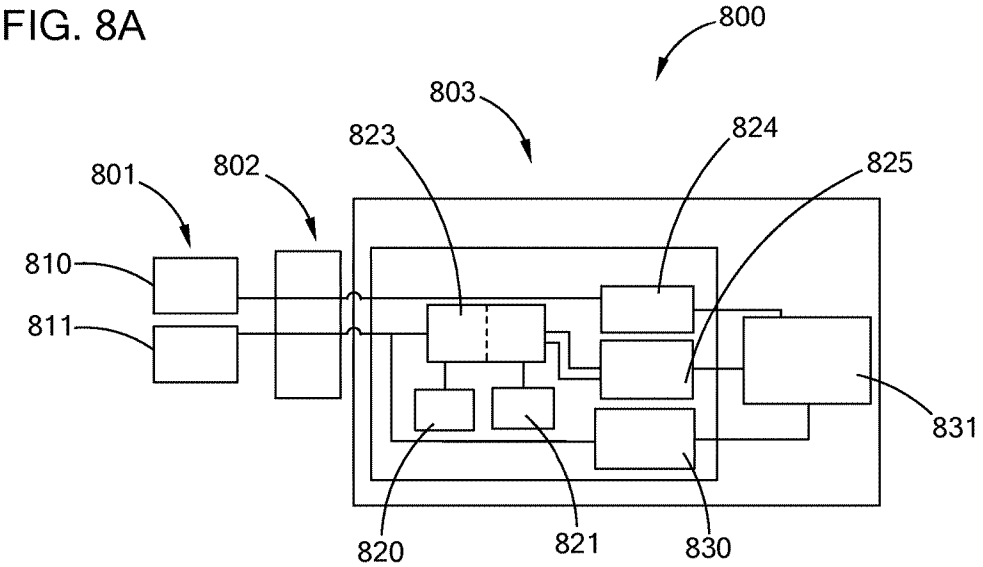
FIG. 8B is a schematic view of an embodiment of a laser decommissioning and opening tool in accordance the present inventions.

FIGS. 8A and 8B show schematic layouts for embodiments of cutting systems using a two fluid dual annular laser jet. Thus, there is an uphole section 801 of the system 800 that is located above the surface of the earth, or outside of the borehole. There is a conveyance section 802, which operably associates the uphole section 801 with the downhole section 803. The uphole section has a high power laser unit 810 and a power supply 811. In this embodiment, the conveyance section 802 is a tube, a bunched cable, or umbilical having two fluid lines and a high power optical fiber. In the embodiment of FIG. 8A, the downhole section has a first fluid source 820, e.g., water or a mixture of oils having a predetermined index of refraction, and a second fluid source 821, e.g., an oil having a predetermined and different index of refraction from the first fluid. The fluids are fed into a dual reservoir 822 (the fluids are not mixed and are kept separate as indicated by the dashed line), which may be pressurized and which feeds dual pumps 823 (the fluids are not mixed and are kept separate as indicated by the dashed line). In operation the two fluids 820, 821 are pumped to the dual fluid jet nozzle 826. The high power laser beam, along a beam path enters the optics 824, is shaped to a predetermined profile, and delivered into the nozzle 826. In the embodiment of FIG. 8B a control head motor 830 has been added and controlled motion laser jet 831 has been employed in place of the laser jet 826. Additionally, the reservoir 822 may not be used, as shown in the embodiment of FIG. 8B.

If a fluid is used as part of the laser beam path, to fill an isolated section of a borehole for transmission of a laser beam, to assist the laser beam as, for example, in a laser fluid jet, or in conjunction with a laser drill bit, the fluid may be a gas, a liquid, a foam or a supercritical fluid, and may include, for example, water, brine, kerosene, air, nitrogen, argon, oxygen, and $D_2O$. The fluids could be any of the fluids disclosed in US Patent Application Publication No. US 2012/0074110 and U.S. Patent Application Ser. No. 61/798,597, the entire disclosures of each of which are incorporated herein by reference.

Figure 9:
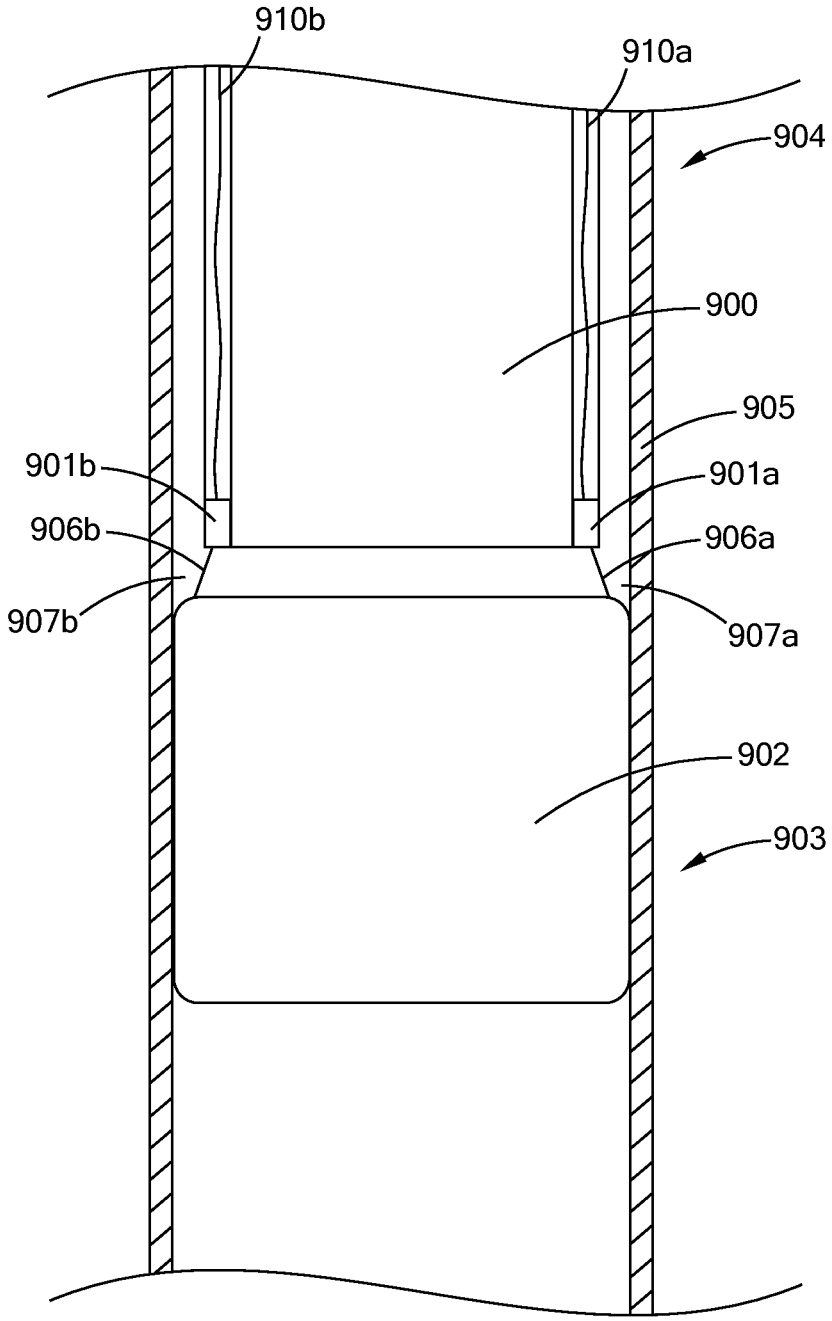
FIG. 9 is a schematic cross sectional view of an embodiment of a laser decommissioning and opening tool in accordance the present inventions.

Turning to FIG. 9 there is shown a schematic diagram of an embodiment of a laser opening and decommissioning tool 900 in a well 904, having a casing 905. In a damaged well, a packer, debris, pinched or crushed casings or tubulars, and other materials may be lodged, partially obstructing, or obstructing a well. The laser decommissioning tool opens the well to provide for the passage of decommissioning tools and cement conveyance for placing plugs down hole from, e.g., below, the damaged area. There is provided a high power laser opening and decommissioning tool 900, which has one or more high power laser cutters 901*a*, 901*b*, that deliver laser beams 906*a*, 906*b*, along laser beam paths 907*a*, 907*b*, which tool 900 lowered to the obstruction 902, in a damaged section 903, of a well 904. The laser cutters 901*a*, 901*b* are optically connected to a high power laser by way of high power optical cables 910*a*, 910*b*. The high power laser tool then delivers the high power laser beams 906*a*, 906*b*, and cuts the outer area of the obstruction, e.g., the area adjacent to the casing 905, (or if a pinched or collapsed casing the casing and potentially the formation itself), weakening the obstruction for removal. The laser tool 900, which preferably could be along the lines of a laser kerfing assembly to direct the laser energy along the outer edges, e.g., the gauge area of the borehole. The laser cutter may further be a series of laser cutters that are rotate by the tool, or by a downhole motor.

Figure 10:
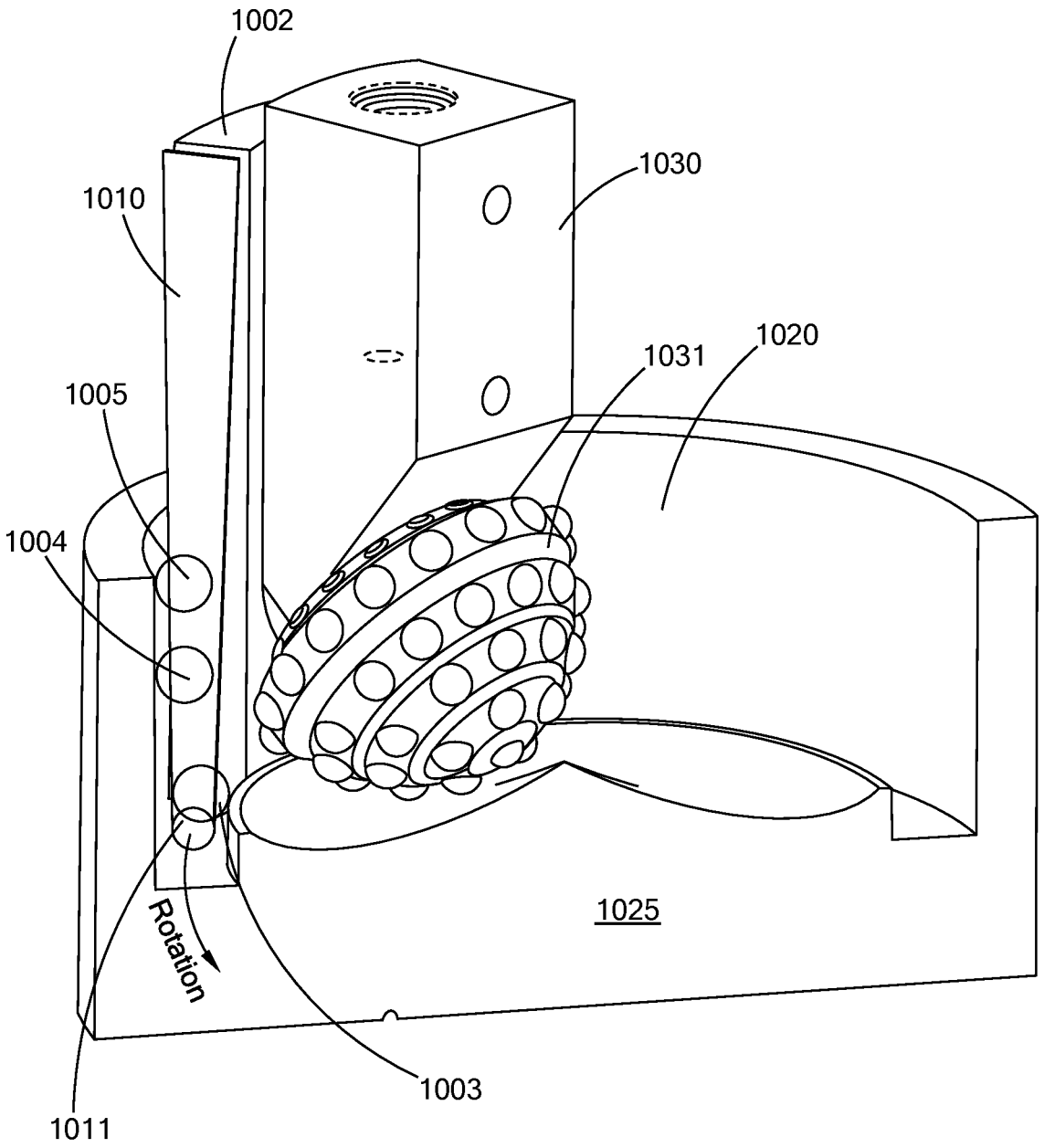
FIG. 10 is a sectional perspective view an embodiment of a laser decommissioning and opening tool in accordance the present inventions.

In FIG. 10 there is provided an embodiment of a portion of a bottom section of a laser-mechanical bit for use in conjunction with a laser decommissioning and opening tool and for use with a narrow laser beam, providing an illumination spot. The bit has a bit body and other structural components of a laser-mechanical bit as shown and taught generally in this specification (which components are not shown in this figure). The bottom section of the bit has a leg 1002 that has gauge cutter 1003, and gauge reamers 1004, 1005. These structures are shown in relation to a schematic cutaway representation of a borehole 1020 having a damaged area 1025. The leg 1002 and its respective cutter follow behind a laser beam 1010, forming a laser spot 1011, which is rotated around the gauge of the top of an obstruction or damage area 1025 of the borehole 1020. Thus, the leg 1002 follows behind the laser spot 1011 and cutter 1003 removes laser-affected material from the obstruction 1025. The bit bottom also has a leg 1030, which support a roller cone 1031. The roller cone provides mechanical force to the top region of the borehole obstruction 1025 that is bounded by path of the laser spot 1011. The obstruction in this area would not be directly affected by the laser, as it was not illuminated by the laser, and is weakened, or otherwise made more easily removed by the mechanical action of the roller cone. The beam paths and the laser beams should be close to, but preferably not touch the structures or the bits including the cutters. When using high power laser energy, and in particular laser energy greater than 5 kW, 10 kW, 20 kW, 40 kW, 80 kW and greater, if the beam path, and in particular the laser beam, contacts a leg, a cutter, or other bit component, it will melt or otherwise remove that section of the component that is in the beam path, and potentially damage the remaining sections of the bit.

Figure 11:
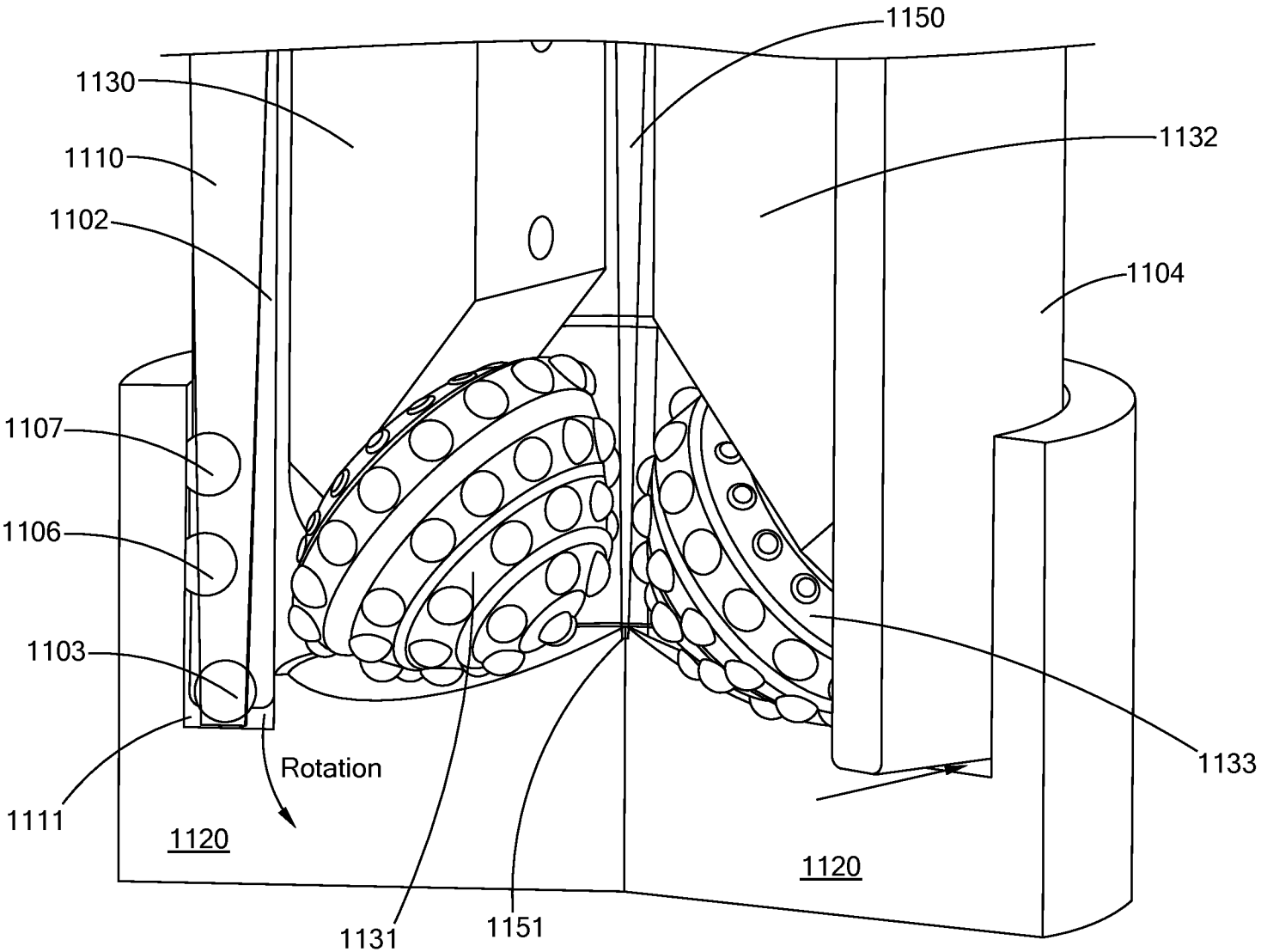
FIG. 11 is a sectional perspective view an embodiment of a laser decommissioning and opening tool in accordance the present inventions.

In FIG. 11 there is provided a partial cutaway cross sectional view of an embodiment of a laser-mechanical bit for use in conjunction with a laser decommissioning and opening tool using a narrow laser beam, providing an illumination spot, in a damaged well. The bit has a bit body and other structural components of a laser-mechanical bit as generally shown and taught herein (which components are not shown in this figure). The bottom section of the bit has legs 1102, 1104 that have gauge cutters, e.g., 1103, and another gauge cutter not shown in the figure, and gauge reamers, e.g., 1106, 1107 and other gauge reamers not shown in the figure (the cutters for leg 1104 are on the side of the leg facing into the page and thus are not seen). These structures are shown in relation to a schematic cutaway representation of the top of a damaged section 1120 of a borehole. The legs 1102, 1104, and their respective cutters follow behind a laser beam, e.g., 1110, forming a laser spot 1111, which is rotated around the gauge of the bottom of the borehole 1120. Thus, the leg 1102 follows behind the laser spot 1111 and cutter 1103 removes laser-affected material in the damaged section 1120. A laser beam and spot are similarly positioned and moved in front of leg 1104, but are not seen in the view of FIG. 11. Additionally, a laser beam 1150 provides a laser spot 1151 in the center of the borehole.

The bit bottom also has a leg 1130, which supports a roller cone 1131 and leg 1132, which support roller cone 1133. The roller cones provide mechanical force to the top region of the damaged section 1120 of the borehole that is bounded by the path of the laser spots. The material in this area would not be directly affected by the laser, as it was not illuminated by the laser, but may nevertheless be weakened, or otherwise made more easily removed by the mechanical action of the roller cone. The beam paths and the laser beams should be close to, but preferably not touch the structures or the bits including the cutters. When using high power laser energy, and in particular laser energy greater than 5 kW, 10 kW, 20 kW, 40 kW, 80 kW and greater, if the beam path, and in particular the laser beam, contacts a leg, a cutter, or other bit component, it will melt or otherwise remove that section of the component that is in the beam path, and potentially damage the remaining sections of the bit.

In general, the laser mechanical bits that may be used in laser decommissioning and opening tools may have beam blades, beam path slots and beam paths that may be used with other structures for providing mechanical force to open a damaged borehole. These other mechanical devices include, for example, apparatus found in other types of mechanical bits, such as, rotary shoe, drag-type, fishtail, adamantine, single and multi-toothed, cone, reaming cone, reaming, self-cleaning, disc, tricone, rolling cutter, cross-roller, jet, core, impreg and hammer bits, and combinations and variations of the these.

Figure 12B:
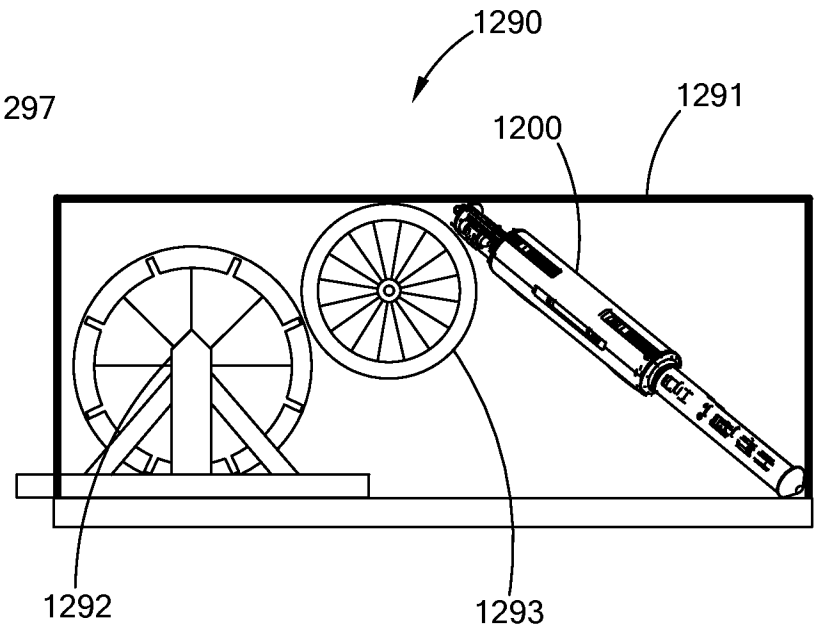
FIG. 12B is a cross sectional view a laser system in accordance the present inventions.

Turning to FIG. 12B there is provided a schematic view of an embodiment of a laser decommissioning and opening system 1290 using a laser tool 1200. The system 1290 has a frame 1291, which protects the components and allows them to be readily lifted, moved or transported. They system 1290 has an umbilical (not shown) that is on a spool 1292 (the spool may have a level wind, drive motors, controllers, fittings, monitoring equipment and other apparatus associated with it, which are not shown in the figures) and a guide wheel 1293. Preferably, the umbilical is connected to the laser tool 1200, passes over the guide wheel 1293 and is wrapped around spool 1292 when the system 1290 leaves the yard (e.g. storage facility) for transport to a decommissioning location. In this manner minimal assembly or fiber splicing is required. The source of the laser beam, and the source for fluids, e.g., hydraulics, gas for the jet, and control and monitoring data and information, can be plugged into the spool at the job site.

Figure 12A:
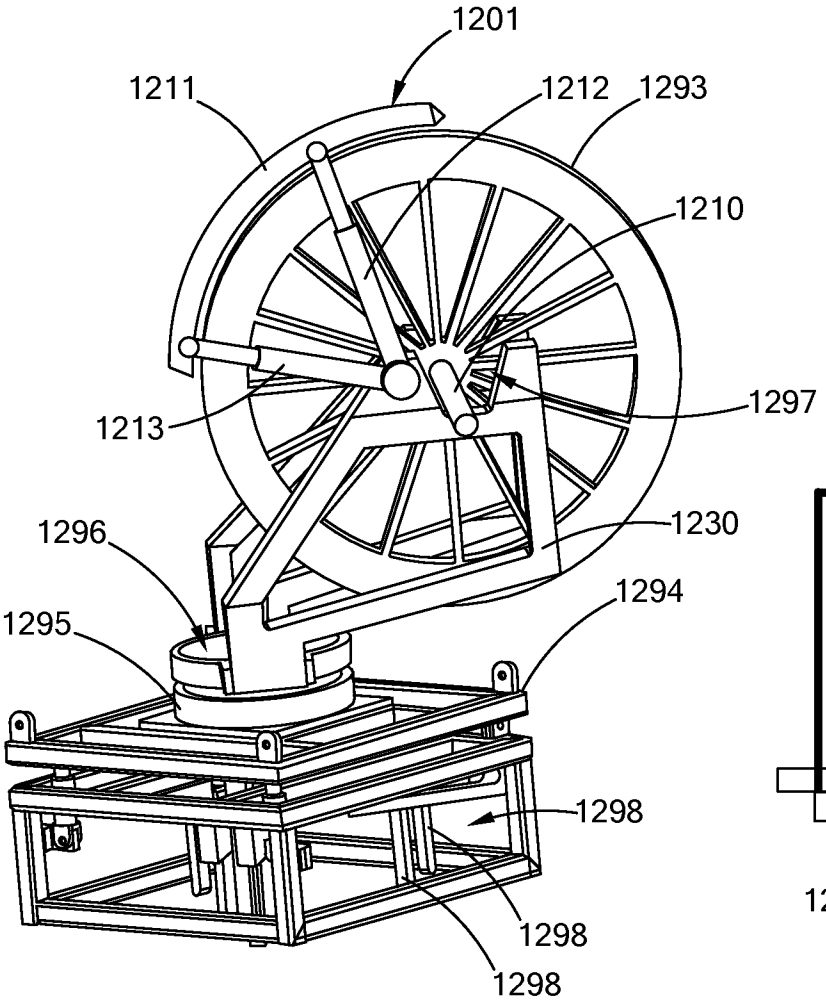
FIG. 12A is a perspective view of an embodiment of a mounting system in accordance the present inventions.

Turning to FIG. 12A there is provided a perspective view of an embodiment of a mounting assembly 1294. The mounting assembly 1294 is attached to the top of a pile or tubular associated with a damaged well that is to be opened for decommissioning. The mounting assembly 1294 has a frame 1230, having mounting slots 1297 for receiving the wheel 1293. (Preferably, mounting slots 1297 are fitted with cradle assemblies for receiving and locking the wheel 1293 in place by for example receiving and holding the wheel's axil 1210). The frame 1230 is mounted on a swivel 1295, that has an opening 1296 for extending the tool 1200 and the umbilical (not shown in the figure) into the pile, member or tubular. The mounting assembly 1294 has several (preferably more than one, and at least three or four) clamp assemblies, e.g., 1298, having an inner claiming finger 1298*a* and an outer clamping finger 1298*b*.

The wheel 1293 has a breaking assembly 1201, having a breaking member 1211 to contact the umbilical, the wheel frame or both, and apparatus to draw the breaking member into engagement, such as hydraulic cylinders 1212, 1213 (note that although not shown, preferably the other side of the wheel has similar hydraulic cylinders.) The breaking assembly 1201 can be activated to hold, or lock, the umbilical and wheel in a fixed position with respect to the wheel 293 and the member to be cut, e.g., a pile.

By way of example, a laser decommission transport frame and system can be fitted with a spool and an umbilical. The umbilical has conduits and lines for providing electrical power, sending and receiving data and control information, hydraulics, and a gas supply line. The umbilical has a high power laser fiber having, for example, a core having a diameter of from about 200 μm to about 1,000 μm, about 500 μm and about 600 μm. Preferably the sealed optical cartridge is connected to both the tool and the umbilical before the frame and system are delivered to the decommissioning site. At the decommissioning site a mounting assembly, e.g., 1294 is positioned with a crane over the member, e.g., pile, to be cut, decommissioned, or removed. The mounting assembly is locked onto the pile. Once locked on to the pile, the mounting assembly is positioned and ready to receive the laser tool. Thus, using the crane, and preferably rigging to a deployment assembly, e.g., guide wheel 1293, and with the wheel break set, the wheel, and thus the umbilical and the tool are positioned over the frame. As this wheel is being moved from the deck of the decommissioning vessel to the pile, by the crane, the spool unwinds the umbilical according to provide sufficient length to reach the pile. The tool is then lowered into the pile as the wheel is set in the mounting slots, e.g., 1297. At this point, the break can be released and the tool lowered to the appropriate depth, by unwinding the umbilical from the spool. Once lowered to the appropriate depth the wheel break is set, preventing the umbilical from raising or lowering within the pile. The centralizers on the laser decommissioning tool are then extended, centering and fixing the tool in position. If the spool is located on a floating platform heave compensation, if needed, may be accomplished: by using the the fish belly, e.g., dip or slack, in the umbilical between the spool and frame to take up the movement; by setting the tension on the spool so that the fish belly of the umbilical between the pile and the frame is taken up or let out according to compensate for the heave of the vessel; by other heave compensation devices known to the offshore drilling arts; and combinations and variation of these. The laser cut of the pile can then be made. It being understood that other sequences of activities, e.g., placing, locking, cutting, may be used, desirable or preferred depending upon the particular decommissioning activity and conditions.

Figure 13A:
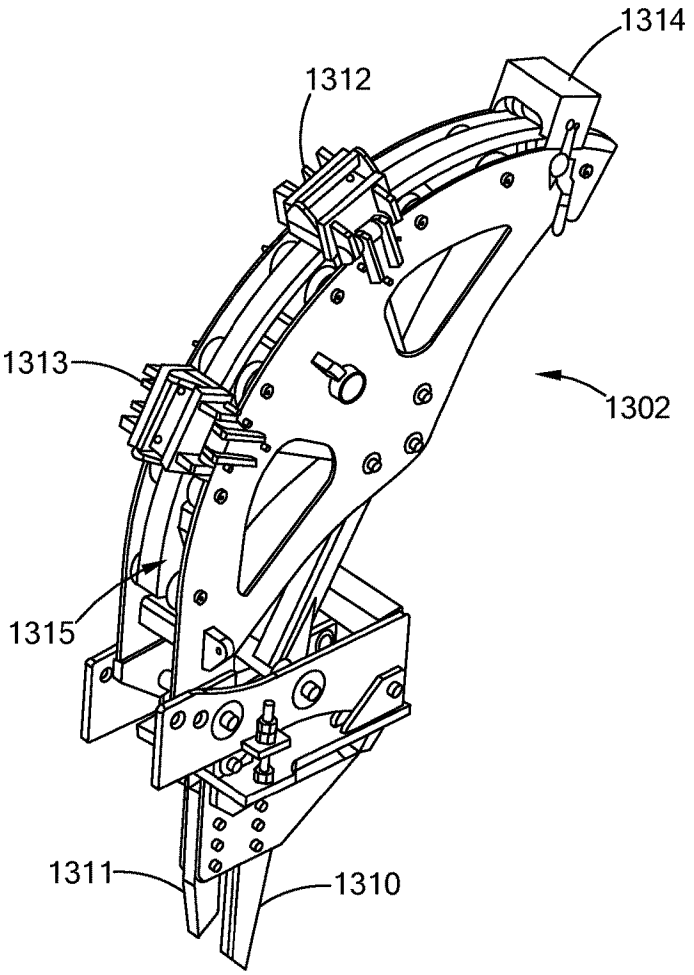
FIG. 13A is a perspective view an embodiment of a mounting system in accordance the present inventions.
Figure 13:
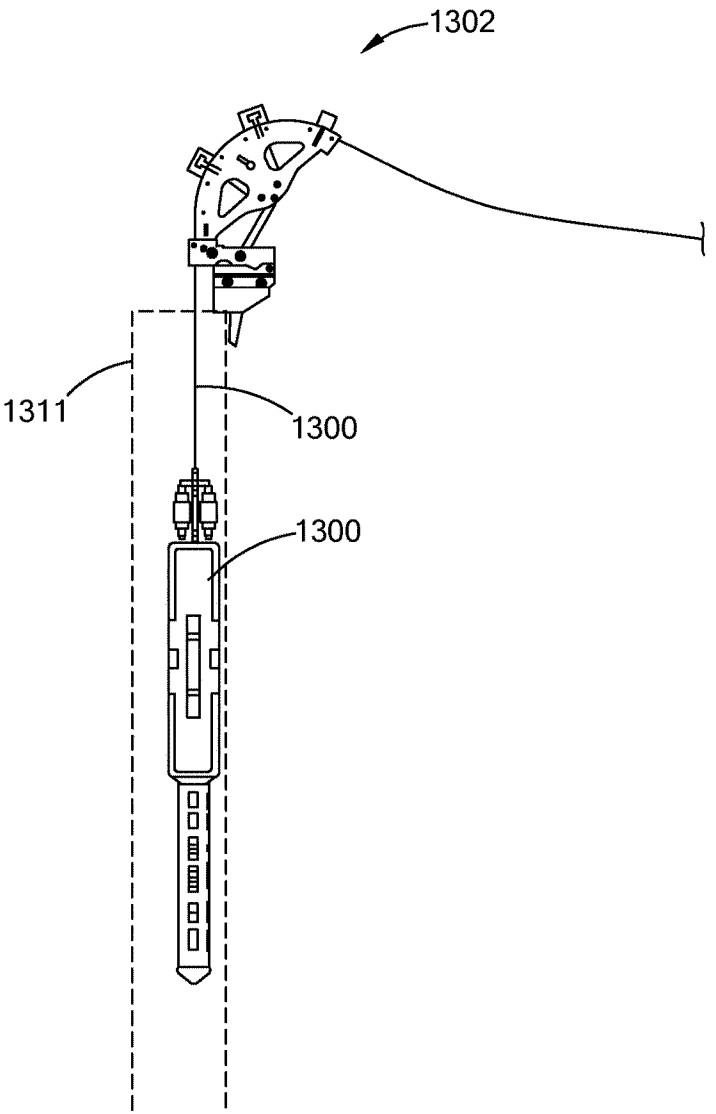
FIG. 13 is a cross sectional view of an embodiment of a deployment of an embodiment of a system in accordance the present inventions.

Turning to FIG. 13 there is provided a schematic cross sectional view of an embodiment of a laser opening and decommissioning tool 1300 deployed into a tubular 1311, which is to opened and cut. In the embodiment of this system the deployment assembly is a guide-arc 1302. The laser tool 1300 is shown as being lowered into the tubular 1311, and has not yet been anchored or centralized. The umbilical 1340 is extending over the guide-arc 1302 and into the tubular 1311 and back toward the spool and support vessel (not shown in this figure). Turning to FIG. 13A there is provided a detailed perspective view of the guide-arc 1302, without the umbilical being present. The guide-arch 1302 has an inlet guide device 1314, which allows the umbilical to lay within arcuate channel 1315. The arcuate channel 1315 has rollers, or other friction reducing devices, to permit the umbilical to move over, or in, the guide-arch channel 1315. Breaks, or clamps, 1312, 1313 are located above the channel 1315, and over the umbilical (when present). Breaks 1312, 1313 clamp down on the umbilical fixing it with respect to the guide-arch 1302. The guide-arch 1302 has clamping fingers 1311, 1310 for engaging the inner and outer surfaces of the tubular 401 respectively.

It is noted that the laser decommissioning and opening systems, methods, tools and devices of the present inventions may be used in whole, or in part, in conjunction with, in addition to, or as an alternative, in whole, or in part, to existing methodologies for the decommissioning of wells, both onshore and offshore, and the removal of structures, both onshore and offshore without departing from the spirit and scope of the present inventions. Further, it is noted that the laser decommissioning and opening system, methods, tools and devices of the present inventions may be used in whole, or in part, in conjunction with, in addition to, or as an alternative, in whole or in part, to existing methodologies to remove or repair only a portion of a well without departing from the spirit and scope of the present inventions. Additionally, it is noted that the sequence or time of the various steps, activities and methods or removal (whether solely based on the laser removal system, methods, tools and devices or in conjunction with existing methodologies) may be varied, repeated, sequential, consecutive and combinations and variations of these, without departing from the spirit and scope of the present inventions.

It is preferable that the assemblies, conduits, support cables, laser cutters and other components associated with the operation of the laser tools, should be constructed to meet the pressure and environmental requirements for the intended use. The laser cutter head and optical related components, if they do not meet the pressure requirements for a particular use, or if redundant protection is desired, may be contained in or enclosed by a structure that does meet these requirements. For deep and ultra-deep uses, the laser cutter and optics related components should preferably be capable of operating under pressures of 1,000 psi, 2,000 psi, 4,500 psi, 5,000 psi or greater. The materials, fittings, assemblies, useful to meet these pressure requirements are known to those of ordinary skill in the offshore drilling arts, related sub-sea Remote Operated Vehicle ("ROV") arts, and in the high power laser art.

For plugged, damaged, collapsed and partially collapsed tubulars, as well as, for other solid, or occluded, structures that need to be removed from above the seafloor, below the seafloor, below the surface of the earth, and combinations and variations of these, an embodiment of a boring, radially cutting, and sectioning method may be employed. In this embodiment of the method the laser beam path is first directed along the length, and preferably along the axis, of the structure to be removed, e.g., the laser beam would be directed downwardly at the center of the obstruction. The laser would bore a hole, preferably along the axis of the structure, and the laser cutting tool would move into and down this axial hole. At a point where the axial hole was of sufficient depth the tool would perform a radial cut of the obstruction, i.e., an inside-to-outside cut with the laser beam path traveling from inside the axial hole, to the interior surface of the axial hole, through the obstruction, and through the outer surface of the obstruction. This radial cut would sever (or partially sever in a predetermined manner as discussed above) the obstruction. The laser tool would be removed to a safe position and the severed section of the obstruction removed. The depth of the axial hole may be used to determine the size of the severed section that will be removed. Thus, in general longer axial holes will give rise to larger and heavier severed sections. Preferably, the radial cut does not occur at precisely the bottom of the axial hole. Instead, if the radial cut is performed slightly above, or above, the bottom of the axial hole, the remaining portion of the hole, after the severed section is removed, may be used as a pilot hole to continue the axial hole for the removal at the next section of the obstruction.

Generally, and preferably, the laser cutting tools may have monitoring and sensing equipment and apparatus associated with them. Such monitoring and sensing equipment and apparatus may be a component of the tool, a section of the tool, integral with the tool, or a separate component from the tool but which still may be operationally associated with the tool, and combinations and variations of these. Such monitoring and sensing equipment and apparatus may be used to monitor and detect, the conditions and operating parameters of the tool, the position of the tool, the tool's location relative to a damaged well section, the tool's entry into a well section bellow a damaged section, the high power laser fiber, the optics, any fluid conveyance systems, the laser cutting head, the cut, and combinations of these and other parameters, locations and conditions. Such monitoring and sensing equipment and apparatus may also be integrated into or associated with a control system or control loop to provide real time control of the operation of the tool.

Such monitoring and sensing equipment may include by way of example: the use of an optical pulse, train of pulses, or continuous signal, that are continuously monitored that reflect from the distal end of the fiber and are used to determine the continuity of the fiber; the use of the fluorescence and black body radiation from the illuminated surface as a means to determine the continuity of the optical fiber; monitoring the emitted light as a means to determine the characteristics, e.g., completeness, of a cut; the use of ultrasound to determine the characteristics, e.g., completeness, of the cut; the use of a separate fiber to send a probe signal for the analysis of the characteristics, e.g., of the cut; and a small fiber optic video camera may be used to monitor, determine and confirm that a cut is complete. These monitoring signals may transmit at wavelengths substantially different from the high power signal such that a wavelength selective filter may be placed in the beam path uphole or downhole to direct the monitoring signals into equipment for analysis. Further imaging and sensing instruments can be used, such as a camera based, sonic based, radiation based, magnetic based, and laser based systems. For example an X-ray diagnostics and inspection-logging device, such as the VISUWELL provided by VISURAY could be used; or a down hole camera device, such as an OPTIS or NEPTUS camera system provided by EV could be used. The monitoring system may also utilize laser radar systems as for example describe in this specification.

To facilitate some of these monitoring activities an Optical Spectrum Analyzer or Optical Time Domain Reflectometer or combinations thereof may be used. For example, an AnaritsuMS9710C Optical Spectrum Analyzer having: a wavelength range of 600 nm-1.7 microns; a noise floor of 90 dBm @ 10 Hz, −40 dBm @ 1 MHz; a 70 dB dynamic range at 1 nm resolution; and a maximum sweep width: 1200 nm and an Anaritsu CMA 4500 OTDR may be used.

The efficiency of the laser's cutting action, as well as the completion of the cut, can also be determined by monitoring the ratio of emitted light to the reflected light. Materials undergoing melting, spallation, thermal dissociation, or vaporization will reflect and absorb different ratios of light. The ratio of emitted to reflected light may vary by material further allowing analysis of material type by this method. Thus, by monitoring the ratio of emitted to reflected light material type, cutting efficiency, completeness of cut, and combinations and variation of these may be determined. This monitoring may be performed uphole, downhole, or a combination thereof. Further, a system monitoring the reflected light, the emitted light and combinations thereof may be used to determine the completeness of the laser cut. These, and the other monitoring systems, may be utilized real-time as the cut is being made, or may be utilized shortly after the cut has been made, for example during a return, or second rotation of the laser tool, or may be utilized later in time, such as for example with a separate tool.

An embodiment of a system for monitoring and confirming that the laser cut is complete and, thus, that the laser beam has severed the member, is a system that utilizes the color of the light returned from the cut can be monitored using a collinear camera system or fiber collection system to determine what material is being cut. In the offshore environment it is likely that this may not be a clean signal. Thus, and preferably, a set of filters or a spectrometer may be used to separate out the spectrum collected by the downhole sensor. This spectra can be used to determine in real-time, if the laser is cutting metal, concrete or rock; and thus provide information that the laser beam has penetrated the member, that the cut is in progress, that the cut is complete and thus that the member has been severed.

The conveyance structure may be: a single high power optical fiber; it may be a single high power optical fiber that has shielding; it may be a single high power optical fiber that has multiple layers of shielding; it may have two, three or more high power optical fibers that are surrounded by a single protective layer, and each fiber may additionally have its own protective layer; it may contain or have associated with the fiber a support structure which may be integral with or releasable or fixedly attached to optical fiber (e.g., a shielded optical fiber is clipped to the exterior of a metal cable and lowered by the cable into a borehole); it may contain other conduits such as a conduit to carry materials to assist a laser cutter, for example gas, air, nitrogen, oxygen, inert gases; it may have other optical or metal fiber for the transmission of data and control information and signals; it may be any of the combinations and variations thereof.

The conveyance structure transmits high power laser energy from the laser to a location where high power laser energy is to be utilized or a high power laser activity is to be performed by, for example, a high power laser tool. The conveyance structure may, and preferably in some applications does, also serve as a conveyance device for the high power laser tool. The conveyance structure's design or configuration may range from a single optical fiber, to a simple to complex arrangement of fibers, support cables, shielding on other structures, depending upon such factors as the environmental conditions of use, performance requirements for the laser process, safety requirements, tool requirements both laser and non-laser support materials, tool function(s), power requirements, information and data gathering and transmitting requirements, control requirements, and combinations and variations of these.

The conveyance structure may be, for example, coiled tubing, a tube within the coiled tubing, wire in a pipe, fiber in a metal tube, jointed drill pipe, jointed drill pipe having a pipe within a pipe, or may be any other type of line structure, that has a high power optical fiber associated with it. As used herein the term "line structure" should be given its broadest meaning, unless specifically stated otherwise, and would include without limitation: wireline; coiled tubing; slick line; logging cable; cable structures used for completion, workover, drilling, seismic, sensing, and logging; cable structures used for subsea completion and other subsea activities; umbilicals; cables structures used for scale removal, wax removal, pipe cleaning, casing cleaning, cleaning of other tubulars; cables used for ROV control power and data transmission; lines structures made from steel, wire and composite materials, such as carbon fiber, wire and mesh; line structures used for monitoring and evaluating pipeline and boreholes; and would include without limitation such structures as Power & Data Composite Coiled Tubing (PDT-COIL) and structures such as those sold under the trademarks Smart Pipe® and FLATpak®.

High power long distance laser fibers and laser systems, which are disclosed in detail in US Patent Application Publication Nos. 2010/0044106, 2010/0044103, 2010/0044105, 2010/0215326, and 2012/0020631, the entire disclosures of each of which are incorporated herein by reference, break the length-power-paradigm, and advance the art of high power laser delivery beyond this paradigm, by providing optical fibers and optical fiber cables (which terms are used interchangeably herein and should be given their broadest possible meanings, unless specified otherwise), which may be used as, in association with, or as a part of conveyance structures, that overcome these and other losses, brought about by nonlinear effects, macro-bending losses, micro-bending losses, stress, strain, and environmental factors and provides for the transmission of high power laser energy over great distances without substantial power loss.

In general, the laser cutting tools and devices may have one, or more, optics package or optics assemblies, which shape, focus, direct, re-direct and provide for other properties of the laser beam, which are desirable or intended for a cutting or opening process. Embodiments of high power laser optics, optics assemblies, and optics packages are disclosed and taught in US Patent Application Publication Nos. 2010/0044105, 2012/0275159, 2012/0267168, 2012/0074110, 2013/0228557 and U.S. patent application Ser. No. 61/786,687, and Ser. No. 13/768,149, the entire disclosures of each of which is incorporated herein by reference.

In general, the laser tools and devices may also have one or more laser cutting heads, having for example a fluid jet, or jets, or fluid channel associated with the laser beam path that laser beam takes upon leaving the tool and traveling toward the material to be cut, e.g., the inside of a tubular. Embodiments of high power laser tools, devices and cutting heads are disclosed and taught in the following US Patent Applications Publication Nos. 2012/0074110; 2013/0228557; 2012/0067643; 2013/0228372; 2013/0228557; and Ser. Nos. 61/786,687; 61/798,597 and Ser. No. 13/565,434, the entire disclosures of each of which are incorporated herein by reference, as well as in, US Patent Applications Publication Nos. 2010/0044104; 2012/0074110; 2012/0067643; 2012/0275159; 2012/0255933; and 2012/0266803, the entire disclosures of each of which are incorporated herein by reference.

In general, these associated fluid jets in the laser cutting heads find greater applicability and benefit in cutting applications that are being conducted in, or through, a liquid or debris filled environment, such as e.g., an outside-to-inside cut where sea water is present, or an inside-to-outside cut where drilling mud is present. The fluid jets may be a liquid, a gas, a combination of annular jets, where the inner annular jet is a gas and the outer is a fluid, where the inner annular jet and outer annular jets are liquids having predetermined and preferably different indices of refraction. The fluid jets may be a series of discrete jets that are substantially parallel, or converging fluid jets and combinations and variations of these.

Thus, for example an annular gas jet, using air, oxygen, nitrogen or another cutting gas, may have a high power laser beam path within the jet. As this jet is used to perform a linear cut or kerf, a second jet, which trails just behind the gas jet having the laser beam, is used. The paths of these jets may be essentially parallel, or they may slightly converge or diverge depending upon their pressures, laser power, the nature of the material to be cut, the stand off distance for the cut, and other factors.

Downhole tractors and other types of driving or motive devices may be used with the laser tools to both advance or push the laser tool down into or along a member to be cut, or to pull the laser tool from the member. Thus, for example a coil tubing injector, an injector assembly having a goose neck and/or straightener, a rotating advancement and retraction device, a dog and piston type advancement and retraction device, or other means to push or pull a coil tubing, a tubular, a drill pipe, integrated umbilical or a composite tubing, which is affixed to the laser tool, may be utilized. In this manner the tool may be precisely positioned for laser cutting.

A further consideration, however, is the management of the optical affects of fluids or debris that may be located within the beam path between laser tool and the work surface, e.g., the surface of the material to be cut. Thus, it is advantageous to minimize the detrimental effects of such fluids and materials and to substantially ensure, or ensure, that such fluids do not interfere with the transmission of the laser beam, or that sufficient laser power is used to overcome any losses that may occur from transmitting the laser beam through such fluids. To this end, mechanical, pressure and jet type systems may be utilized to reduce, minimize or substantially eliminate the effect of these fluids on the laser beam.

For example, mechanical devices may be used to isolate the area where the laser operation is to be performed and the fluid removed from this area of isolation, by way of example, through the insertion of an inert gas, or an optically transmissive fluid, such as a water, brine, or water solutions. The use of a fluid in this configuration has the added advantage that it is essentially incompressible.

Preferably, if an optically transmissive fluid is employed the fluid will be flowing. In this manner, the overheating of the fluid, from the laser energy passing through it, or from it residing at the cut site, may be avoided or lessened; because the fluid is flowing and not dwelling or residing for extended times in the laser beam or at the cut site, where heating from laser and the laser cut material may occur.

The mitigation and management of back reflections when propagating a laser fluid jet through a fluid, from a cutting head of a laser tool to a work surface, may be accomplished by several methodologies. The methodologies to address back reflections and mitigate potential damage from them would include the use of an optical isolator, which could be placed in either collimated space or at other points along the beam path after it is launched from a fiber or connector. The focal point may be positioned such that it is a substantial distance from the laser tool; e.g., greater than 4 inches, greater than 6 inches and greater than 8 inches. Preferably, the focus point may be beyond the fluid jet coherence distance, thus, greatly reducing the likelihood that a focused beam would strike a reflective surface formed between the end of the fluid jet and the medium in which it was being propagated, e.g., a gas jet in water. The laser beam may be configured such that it has a very large depth of focus in the area where the work surface is intended to be, which depth of focus may extend into and preferably beyond the cutting tool. Additionally, the use of an active optical element (e.g., a Faraday isolator) may be employed. Methods, configurations and devices for the management and mitigation of back reflections are taught and disclosed in US Patent Applications Publication No. 2012/0074110; 2013/0228557 and U.S. patent application Ser. No. 13/768,149, the entire disclosures of each of which are incorporated herein by reference.

Moreover, a mechanical snorkel like device, or tube, which is filled with an optically transmissive fluid (gas or liquid) may be extended between or otherwise placed in the area between the laser tool and the work surface or area. Similarly mechanical devices such as an extendable pivot arm may be used to shorten the laser beam path keeping the beam closer to the cutting surface as the cut is advanced or deepened.

A jet of high-pressure gas may be used with the laser beam. The high-pressure gas jet may be used to clear a path, or partial path for the laser beam. The gas may be inert, it may be air, nitrogen, oxygen, or other type of gas that accelerates, enhances, or controls the laser cutting processes.

The use of oxygen, air, or the use of very high power laser beams, e.g., greater than about 1 kW, greater than about 10 kW, and greater than about 20 kW, could create and maintain a plasma bubble, a vapor bubble, or a gas bubble in the laser illumination area, which could partially or completely displace the fluid in the path of the laser beam. If such a bubble is utilized, preferably the size of the bubble should be maintained as small as possible, which will avoid, or minimize the loss of power density.

A high-pressure laser liquid jet, having a single liquid stream, may be used with the laser beam. The liquid used for the jet should be transmissive, or at least substantially transmissive, to the laser beam. In this type of jet laser beam combination the laser beam may be coaxial with the jet. This configuration, however, has the disadvantage and problem that the fluid jet may not act as a wave-guide. A further disadvantage and problem with this single jet configuration is that the jet must provide both the force to keep the drilling fluid away from the laser beam and be the medium for transmitting the beam.

A compound fluid jet may be used in a laser tool. The compound fluid jet has an inner core jet that is surrounded by annular outer jets. The laser beam is directed by optics into the core jet and transmitted by the core jet, which functions as a waveguide. A single annular jet can surround the core, or a plurality of nested annular jets can be employed. As such, the compound fluid jet has a core jet. This core jet is surrounded by a first annular jet. This first annular jet can also be surrounded by a second annular jet; and the second annular jet can be surrounded by a third annular jet, which can be surrounded by additional annular jets. The outer annular jets function to protect the inner core jet from the drill fluid present between the laser cutter and the structure to be cut. The core jet and the first annular jet should be made from fluids that have different indices of refraction.

The angle at which the laser beam contacts a surface of a work piece may be determined by the optics within the laser tool or it may be determined the positioning of the laser cutter or tool, and combinations and variations of these. The laser tools have a discharge end from which the laser beam is propagated. The laser tools also have a beam path. The beam path is defined by the path that the laser beam is intended to take, and can extend from the laser source through a fiber, optics and to the work surface, and would include as the laser path that portion that extends from the discharge end of the laser tool to the material or area to be illuminated by the laser.

In the situation where multiple annular jets are employed, the criticality of the difference in indices of refraction between the core jet and the first (inner most, i.e., closes to the core jet) annular jet is reduced, as this difference can be obtained between the annular jets themselves. However, in the multi-annular ring compound jet configuration the indices of refraction should nevertheless be selected to prevent the laser beam from entering, or otherwise being transmitted by the outermost (furthest from the core jet and adjacent the work environment medium) annular ring. Thus, for example, in a compound jet, having an inner jet with an index of refraction of $n_1$, a first annular jet adjacent the inner jet, the first annular jet having an index of refraction of $n_2$, a second annular jet adjacent to the first annular jet and forming the outer most jet of the composite jet, the second annular jet having an index of refraction of $n_3$. A waveguide is obtained when for example: (i) $n_1>n_2$; (ii) $n_1>n_3$; (iii) $n_1<n_2$ and $n_2>n_3$; and, (iv) $n_1<n_2$ and $n_1>n_3$ and $n_2>n_3$.

The pressure and the speed of the various jets that make up the compound fluid jet can vary depending upon the applications and use environment. Thus, by way of example the pressure can range from about 100 psi, to about 4000 psi, to about 30,000 psi, to preferably about 70,000 psi, to greater pressures. However, lower pressures may also be used. The core jet and the annular jet(s) may be the same pressure, or different pressures, the core jet may be higher pressure or the annular jets may be higher pressure. Preferably, the core jet is at a higher pressure than the annular jet. By way of example, in a multi-jet configuration the core jet could be 70,000 psi, the second annular jet (which is positioned adjacent the core and the third annular jet) could be 60,000 psi and the third (outer, which is positioned adjacent the second annular jet and is in contact with the work environment medium) annular jet could be 50,000 psi. The speed of the jets can be the same or different. Thus, the speed of the core can be greater than the speed of the annular jet, the speed of the annular jet can be greater than the speed of the core jet and the speeds of multiple annular jets can be different or the same. The speeds of the core jet and the annular jet can be selected, such that the core jet does contact the drilling fluid, or such contact is minimized. The speeds of the jet can range from relatively slow to very fast and preferably range from about 1 m/s (meters/second) to about 50 m/s, to about 200 m/s, to about 300 m/s and greater. The order in which the jets are first formed can be the core jet first, followed by the annular rings, the annular ring jet first followed by the core, or the core jet and the annular ring being formed simultaneously. To minimize, or eliminate, the interaction of the core with the drilling fluid, the annular jet is created first followed by the core jet.

In selecting the fluids for forming the jets and in determining the amount of the difference in the indices of refraction for the fluids, the wavelength of the laser beam and the power of the laser beam are factors that should be considered. Thus, for example, for a high power laser beam having a wavelength in the 1070 nm (nanometer) range the core jet can be made from an oil having an index of refraction of about 1.53 and the annular jet can be made from water having an index of refraction from about 1.33 or another fluid having an index less than 1.53. Thus, the core jet for this configuration would have an NA (numerical aperture) from about 0.12 to about 0.95, respectively.

The number of laser cutters utilized in a configuration of the present inventions can be a single cutter, two cutters, three cutters, and up to and including 12 or more cutters. As discussed above, the number of cutters depends upon several factors and the optimal number of cutters for any particular configuration and end use may be determined based upon the end use requirements and the disclosures and teachings provided in this specification. The cutters may further be positioned such that their respective laser beam paths are parallel, or at least non-intersecting within the center axis of the member to be cut.

Focal lengths may vary for example from about 40 mm (millimeters) to about 2,000 mm, and more preferably from about 150 mm to about 1,500 mm, depending upon the application, material type, material thickness, and other conditions that are present during the cutting.

In embodiments of the laser decommission and opening tool, the laser beam path may take a turn, such as a 80 to 100 degree turn, and including for example a 93 to 97 degree turn and a 95 degree turn. For this, a mirror, which may be any high power laser optic that is highly reflective of the laser beam wavelength, can withstand the operational pressures, and can withstand the power densities that it will be subjected to during operation, can be used. For example, the mirror may be made from various materials. For example, metal mirrors are commonly made of copper, rhodium, polished and coated with polished gold, nickel, aluminum, or silver and sometime may have dielectric enhancement. Mirrors with glass substrates may often be made with fused silica because of its very low thermal expansion. The glass in such mirrors may be coated with a dielectric HR (highly reflective) coating. The HR stack as it is known, includes of layers of high/low index layers made of $SiO_2$, $Ta_2O_5$, $ZrO_2$, MgF, $Al_2O_3$, $HfO_2$, $Nb_2O_5$, $TiO_2$, $Ti_2O_3$, $WO_3$, SiON, $Si_3N_4$, Si, or $Y_2O_3$ (All these materials would work for may wave lengths, including 1064 nm to 1550 nm). For higher powers, such as 50 kW actively cooled copper mirrors with gold enhancements may be used. It further may be water cooled, or cooled by the flow of the gas. Preferably, the mirror may also be transmissive to wavelengths other than the laser beam wavelength. In this manner an optical observation device, e.g., a photo diode, a camera, or other optical monitoring and detection device, may be placed behind it.

During operations, and in particular when the laser tool is being operated in a fluid filled or dirty environment, the air flow should be maintained into the laser head and out the nozzle with sufficient pressure and flow rate to prevent environmental contaminants or fluid from entering into the nozzle, or contaminating the mirror or optics. A shutter, or door that may be opened and closed may also be used to protect or seal the nozzle opening, for example, during tripping into and out of a borehole. A disposable cover may also be placed over the nozzle opening, which is readily destroyed either by the force of the gas jet, the laser beam or both. In this manner, the nozzle, mirror and optics can be protecting during for example a long tripping in to a borehole, but readily removed upon the commencement of downhole laser cutting operations, without the need of mechanical opening devices to remove the cover.

The reflective member in embodiments of laser tools and laser cutting heading heads may be a prism, and preferably a prism that utilizes total internal reflection (TIR). Thus, and in general, the prism is configured within the tool such that a high power laser beam is directed toward a first face or surface of the prism. The prism may be made of fused silica, sapphire, diamond, calcium chloride, or other such materials capable of handling high power laser beams and transmitting them with little, low or essentially no absorbance of the laser beam. The plane of first face is essentially normal to the laser beam and has an antireflective (AR) coating. This angle may vary from 90 degrees, by preferably no more than 5 degrees. Large angles of variation are contemplated, but less preferred, because specific AR coatings and other means to address reflection, refraction will need to be utilized. A key advantage in this embodiment is that the AR coatings have a much lower absorption than an (highly reflective) HR coating as a consequence there is substantially less heating in the substrate when using and AR coating. The entrance and exit of the prism should have AR coating matched to the medium of transmission and the angle of incidence of the laser beam should satisfies the TIR condition to cause the beam to be deflected in a different direction. Multiple TIR reflections can be used to make the total desired angle with virtually no loss, and essentially no loss, in power at each interface.

Upon entering the prism, the laser beam travels through the prism material and strikes a second surface or face, e.g., the hypotenuse, of the prism. The material on the outside this second face has an index of refraction, which in view of the angle at which the laser beam is striking the second face, result in total internal reflection (TIR) of the laser beam within the prism. Thus, the laser beam travels from the second face to the third face of the prism and leaves the prism at an angle that is about 90 degrees to the path of the laser beam entering the prism. In this manner, the prism utilizes TIR to change the direction of the laser beam within the tool. Depending upon the position of the prism relative to the incoming laser beam and other factors, the angle of the exiting laser beam from the prism relative to the incoming laser beam into the prism may be greater than or less than 90 degrees, e.g., 89 degrees, 91 degrees, 92 degrees, and 88 degrees, with the minimum angle being dependent on the refractive index of the material and the TIR condition, etc. Further embodiments of TIR prisms in laser tools are taught and disclosed in U.S. patent application Ser. No. 13/768,149 and Ser. No. 61/605,434, the entire disclosures of which are incorporated herein by reference.

By way of example, the types of laser beams and sources for providing a high power laser beam may, by way of example, be the devices, systems, and beam shaping and delivery optics that are disclosed and taught in the following US Patent Applications and US Patent Application Publications: Publication No. 2010/0044106; Publication No. 2010/0044105; Publication No. 2010/0044103; Publication No. 2010/0044102; Publication No. 2010/0215326; Publication No. 2012/0020631; Publication No. 2012/0068086; Publication No. 2012/0261188; Publication No. 2012/0275159; Publication No. 2013/0011102; Publication No. 2012/0068086; Publication No. 2012/0261168; Publication No. 2012/0275159; Publication No. 2013/0011102; Ser. No. 14/099,948; Ser. No. 61/734,809; and Ser. No. 61/786,763, the entire disclosures of each of which are incorporated herein by reference. The source for providing rotational movement, for example may be a string of drill pipe rotated by a top drive or rotary table, a down hole mud motor, a down hole turbine, a down hole electric motor, and, in particular, may be the systems and devices disclosed in the following US Patent Applications and US Patent Application Publications: Publication No. 2010/0044106, Publication No. 2010/0044104; Publication No. 2010/0044103; Ser. No. 12/896,021; Publication No. 2012/0267168; Publication No. 2012/0275159; Publication No. 2012/0267168; Ser. No. 61/798,597; and Publication No. 2012/0067643, the entire disclosures of each of which are incorporated herein by reference.

By way of example, umbilicals, high powered optical cables, and deployment and retrieval systems for umbilical and cables, such as spools, optical slip rings, creels, and reels, as well as, related systems for deployment, use and retrieval, are disclosed and taught in the following US Patent Applications and Patent Application Publications: Publication No. 2010/0044104; Publication No. 2010/0044106; Publication No. 2010/0044103; Publication No. 2012/0068086; Publication No. 2012/0273470; Publication No. 2010/0215326; Publication No. 2012/0020631; Publication No. 2012/0074110; Publication No. 2013/0228372; Publication No. 2012/0248078; and, Publication No. 2012/0273269, the entire disclosures of each of which is incorporated herein by reference, and which may preferably be used as in conjunction with, or as a part of, the present tools, devices, systems and methods and for laser removal of an offshore or other structure. Thus, the laser cable may be: a single high power optical fiber; it may be a single high power optical fiber that has shielding; it may be a single high power optical fiber that has multiple layers of shielding; it may have two, three or more high power optical fibers that are surrounded by a single protective layer, and each fiber may additionally have its own protective layer; it may contain other conduits such as a conduit to carry materials to assist a laser cutter, for example oxygen; it may have conduits for the return of cut or waste materials; it may have other optical or metal fiber for the transmission of data and control information and signals; it may be any of the combinations set forth in the forgoing patents and combinations thereof.

In general, the optical cable, e.g., structure for transmitting high power laser energy from the system to a location where high power laser activity is to be performed by a high power laser tool, may, and preferably in some applications does, also serve as a conveyance device for the high power laser tool. The optical cable, e.g., conveyance device can range from a single optical fiber to a complex arrangement of fibers, support cables, armoring, shielding on other structures, depending upon such factors as the environmental conditions of use, tool requirements, tool function(s), power requirements, information and data gathering and transmitting requirements, etc.

Generally, the optical cable may be any type of line structure that has a high power optical fiber associated with it. As used herein the term line structure should be given its broadest construction, unless specifically stated otherwise, and would include without limitation, wireline, coiled tubing, logging cable, umbilical, cable structures used for completion, workover, drilling, seismic, sensing logging and subsea completion and other subsea activities, scale removal, wax removal, pipe cleaning, casing cleaning, cleaning of other tubulars, cables used for ROV control power and data transmission, lines structures made from steel, wire and composite materials such as carbon fiber, wire and mesh, line structures used for monitoring and evaluating pipeline and boreholes, and would include without limitation such structures as Power & Data Composite Coiled Tubing (PDT-COIL) and structures such as Smart Pipe®. The optical fiber configurations can be used in conjunction with, in association with, or as part of a line structure.

Generally, these optical cables may be very light. For example an optical fiber with a Teflon shield may weigh about ⅔ lb per 1000 ft, an optical fiber in a metal tube may weight about 2 lbs per 1000 ft, and other similar, yet more robust configurations may way as little as about 5 lbs or less, about 10 lbs or less, and about 100 lbs or less per 1,000 ft. Should weight not be a factor, and for very harsh, demanding and difficult uses or applications, the optical cables could weight substantially more.

By way of example, the conveyance device or umbilical for the laser tools transmits or conveys the laser energy and other materials that are needed to perform the operations. It may also be used to handle any waste or returns, by for example having a passage, conduit, or tube incorporated therein or associated therewith, for carrying or transporting the waste or returns to a predetermined location, such as for example to the surface, to a location within the structure, tubular or borehole, to a holding tank on the surface, to a system for further processing, and combinations and variations of these. Although shown as a single cable multiple cables could be used. Thus, for example, in the case of a laser tool employing a compound fluid laser jet the conveyance device could include a high power optical fiber, a first line for the core jet fluid and a second line for the annular jet fluid. These lines could be combined into a single cable or they may be kept separate. Additionally, for example, if a laser cutter employing an oxygen jet is utilized, the cutter would need a high power optical fiber and an oxygen, air or nitrogen line. These lines could be combined into a single tether or they may be kept separate as multiple tethers. The lines and optical fibers should be covered in flexible protective coverings or outer sheaths to protect them from fluids, the work environment, and the movement of the laser tool to a specific work location, for example through a pipeline or down an oil, gas or geothermal well, while at the same time remaining flexible enough to accommodate turns, bends, or other structures and configurations that may be encountered during such travel.

By way of example, one or more high power optical fibers, as well as, lower power optical fibers may be used or contained in a single cable that connects the tool to the laser system, this connecting cable could also be referred to herein as a tether, an umbilical, wire line, or a line structure. The optical fibers may be very thin on the order of hundreds e.g., about greater than 100, of μm (microns). These high power optical fibers have the capability to transmit high power laser energy having many kW of power (e.g., 5 kW, 10 kW, 20 kW, 50 kW or more) over many thousands of feet. The high power optical fiber further provides the ability, in a single fiber, although multiple fibers may also be employed, to convey high power laser energy to the tool, convey control signals to the tool, and convey back from the tool control information and data (including video data) and cut verification, e.g., that the cut is complete. In this manner the high power optical fiber has the ability to perform, in a single very thin, less than for example 1000 μm diameter fiber, the functions of transmitting high power laser energy for activities to the tool, transmitting and receiving control information with the tool and transmitting from the tool data and other information (data could also be transmitted down the optical cable to the tool). As used herein the term "control information" is to be given its broadest meaning possible and would include all types of communication to and from the laser tool, system or equipment.

Generally, it is preferred that when cutting and removing large structures, such as, e.g., multi-string caissons, jackets, piles, and multi-string conductors, requires that after the cut is performed, that the completeness of cut be verified before a heavy lift ship is positioned and attached for the lift, e.g., hooked up, to remove the sectioned portion. If the cut is not complete, and thus, the sectioned portion is still attached to the rest of the structure, the lift ship will not be able to lift and remove the sectioned portion from the structure. Heavy lifting vessels, e.g., heavy lift ships, can have day rates of hundreds-of-thousands of dollars. Thus, if a cut is not complete, the heavy lift ship will have to be unhooked and kept on station while the cutting tool is repositioned to complete the cut and then the heavy lift ship is moved back in and re-hooked up to remove the sectioned portion. During the addition time period for unhooking, completing the cut and re-hooking, the high day rate is being incurred. Additionally, there are safety issues that may arise if a lift cannot be made because of an incomplete cut. Therefore, with a laser cut, as well as with conventional cutting technology it is important to verify the completeness of the cut. Preferably, this verification can be done passively, e.g., not requiring a mechanical probing, or a test lift. More preferably the passive verification is done in real-time, as the cut is being made.

In the laser cutting process, a high power laser beam is directed at and through the material to be cut with a high pressure fluid, e.g., gas, jet for, among other things, clearing debris from the laser beam path. The laser beam may generally be propagated by a long focal length optical system, with the focus either midway through the material or structure to be cut, or at the exit of the outer surface of that material or structure. When the focus is located midway through the material or structure, there is a waist in the hole that the laser forms in that material or structure, which replicates the focal point of the laser. This waist may make it difficult to observe the cut beyond this point because the waist can be quite small. The waist may also be located in addition to midway through, at other positions or points along the cut line, or cut through the material.

A laser radar system using a near diffraction limited diode laser source or q-switched laser can be aligned to be co-linear with the high energy laser beam and it can be used to probe the cut zone and provide passive, real-time monitoring and cut verification. A near-diffraction limited sourced for the laser radar system is preferred, but not essential, because it can create a laser beam that is significantly smaller in diameter than the high power laser beam and as a consequence can probe the entire length of the cut without interference. Although the laser radar laser beam is preferably coaxial with the cutting laser beam, it may also be scanned or delivered on a separate beam path. The laser radar laser beam may also be bigger in diameter than the high energy laser beam to, for example, image the entire cut. The signal that is reflected from the cut zone is analyzed with a multi-channel analyzer, which tracks how many hits are obtained at a specific range and velocity. Any signal returns that indicate a near zero velocity, or a velocity consistent with the penetration rate of the high power laser, will be either the grout or steel surface to be cut. High velocity returns will correspond to the debris being stirred up by the high pressure jet and negative velocities will be the inflow of fluid from the penetration zone.

The laser radar will have a laser source, a very narrow-band filter, a high speed pulse power supply, a high speed detector, a timer, a counter and a multi-channel analyzer system. A multi-channel analyzer system is not essential, but is preferred and provides a convenient means to sort the data into useful information. The laser radar can be a laser source that is a significantly different wavelength than the high power laser ranging from the visible to the infrared wavelengths. As long as the radar laser wavelength is sufficiently outside of the high power laser spectrum band, then the laser radar signal can be isolated with a high quality narrow band-pass filter of 1 nm in width or less. If a laser diode is used as the source, the laser diode will be stabilized in wavelength by an external grating, etalon or dispersive element in the cavity. Bragg Gratings have shown that ability to stabilize a laser diode to 1 pico-meter, significantly more stable than needed for this application.

The laser radar can operate in, for example, two modes: 1) time of flight and 2) phase delay in a pseudo-random continuous modulation format. The laser radar can determine the velocity of the return using, for example, one of two methods: 1) the difference between two consecutive distance measurements divided by the time delay between the two measurements, or 2) a Doppler frequency shift caused by the particle moving either away or toward the observer. The post processing of the raw data can be used to determine if the laser radar is measuring the advancement of the laser cutting zone, the inflow of external mud or the outflow of debris and gas.

The laser radar could also be employed in a liquid jet based design. However, the time of flight is now a strong function of the refractive index of the fluid, which changes with pressure and temperature. Therefore, these characteristics of the liquid media being used during the cutting process should be understood and addressed in the design of the laser radar system for a liquid laser jet cut.

It may also be possible to use cameras and spectrometers to image the exit of the cut once the laser has penetrated the outer casing. Similarly, X-ray Fluorescence, eddy current detectors, Optical Coherence Tomography, and ultra sound as potential solutions, may also be used for real-time and real-time passive cut verification, however, for these approaches the solid angle represents a more significant issue than for the laser radar system, making that system preferable. Further, these systems are, or may be, more complex than the laser radar system, which may make them more difficult to integrate and harden for down-hole deployment and use.

Although not specifically shown in the embodiment of the figures and examples, break detection and back reflection monitory devices and systems may be utilized with, or integrated into the present tools, umbilicals, optical cables, deployment and retrieval systems and combinations and variation so these. Examples of such break detection and monitoring devices, systems and methods are taught and disclosed in the following U.S. patent application Ser. No. 13/486,795, Publication No. 2012/00074110 and Ser. No. 13/403,723, and US Patent Application Publication No. 2010/0044106, the entire disclosures of each of which are incorporated herein by reference.

By way of example, the laser systems of the present invention may utilize a single high power laser, or they may have two or three high power lasers, or more. The lasers may be continuous or pulsed (including, e.g., when the lasing occurs in short pulses, and a laser capable of continuous lasing fired in short pulses). High power solid-state lasers, specifically semiconductor lasers and fiber lasers are preferred, because of their short start up time and essentially instant-on capabilities. The high power lasers for example may be fiber lasers or semiconductor lasers having 5 kW, 10 kW, 20 kW, 50 kW or more power and, which emit laser beams with wavelengths in the range from about 455 nm (nanometers) to about 2100 nm, preferably in the range about 800 nm to about 1600 nm, about 1060 nm to 1080 nm, 1530 nm to 1600 nm, 1800 nm to 2100 nm, and more preferably about 1064 nm, about 1070-1083 nm, about 1360 nm, about 1455 nm, 1490 nm, or about 1550 nm, or about 1900 nm (wavelengths in the range of 1900 nm may be provided by Thulium lasers). Thus, by way of example, the present tools, systems and procedures may be utilized in a system that is contemplated to use four, five, or six, 20 kW lasers to provide a laser beam in a laser tool assembly having a power greater than about 60 kW, greater than about 70 kW, greater than about 80 kW, greater than about 90 kW and greater than about 100 kW. One laser may also be envisioned to provide these higher laser powers. Examples of preferred lasers, and in particular solid-state lasers, such as fibers lasers, are disclosed and taught in the following US Patent Applications and US Patent Application Publications: Publication No. 2010/0044106, Publication No. 2010/0044105, Publication No. 2010/0044103, Publication No. 2013/0011102, Publication No. 2010/0044102, Publication No. 2010/0215326, Publication No. 2012/0020631, 2012/0068006, Publication No. 2012/0068086; Ser. No. 14/099,948, Ser. No. 61/734,809, and Ser. No. 61/786,763, the entire disclosures of each of which are incorporated herein by reference. Additionally, a self-contained battery operated laser system may be used. This system may further have its own compressed gas tanks, and be submergible, and may also be a part of, associated with, or incorporation with, an ROV, or other sub-sea tethered or free operating device.

EXAMPLES

The following examples are provide to illustrate various devices, tools, configurations and activities that may be performed using the high power laser tools, devices and system of the present inventions. These examples are for illustrative purposes, and should not be view as, and do not otherwise limit the scope of the present inventions.

Example 1

Figure 14:
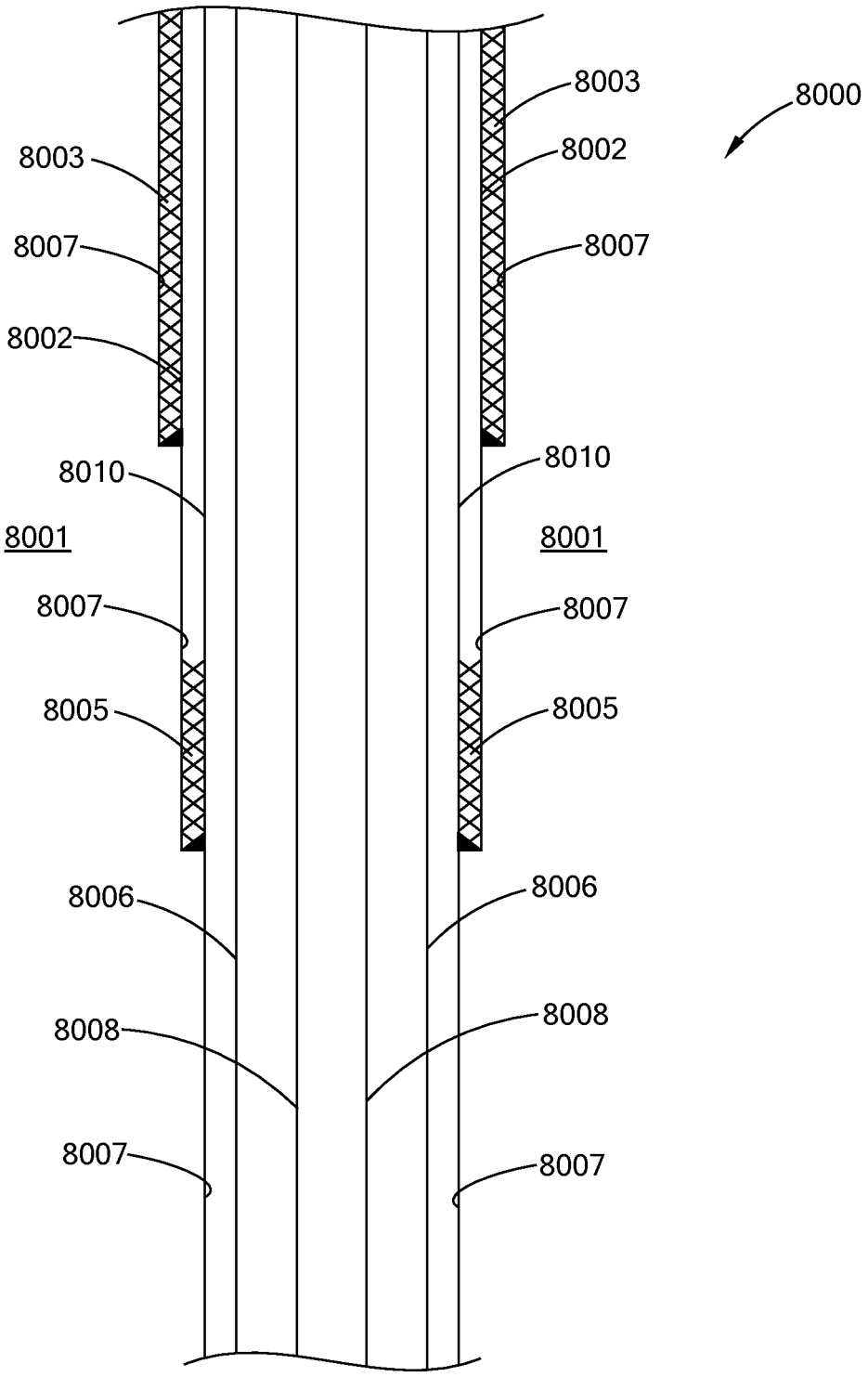
FIG. 14 is a cross sectional schematic view of an embodiment of a well upon which embodiments of laser operations in accordance with the present inventions are to be performed.

A predetermined laser delivery pattern is provided to make a cut in borehole structures to create a plug passageway, that when filled with cement creates a plug that extends into, and fills the entirety of openings in borehole and across the entirety of the borehole diameter for a length of 200 feet. Turning to FIG. 14 there is shown a schematic cross section of a section of a well that is to be plugged. The well 8000 is located in formation 8001. The well is in a telescoping configuration with the well bore wall surface 8007 narrowing in a stepwise manner as the depth of the well increases. The well 8000 has an outer casing 8002, an inner intermediate length casing 8010, an inner longer length casing 8006, and an innermost tubular 8008, e.g., a production casing. Sections of the annular space between the borehole wall 8007 and the casings are filled cement. Thus, cement 8003 is between borehole wall 8007 and casing 8002; and cement 8005 is between borehole wall 8007 and casing 8010. Further areas of cement may also be present in the well such as between casing 8006 and borehole wall 8007 at other depths, not shown in the figure.

Figure 15:
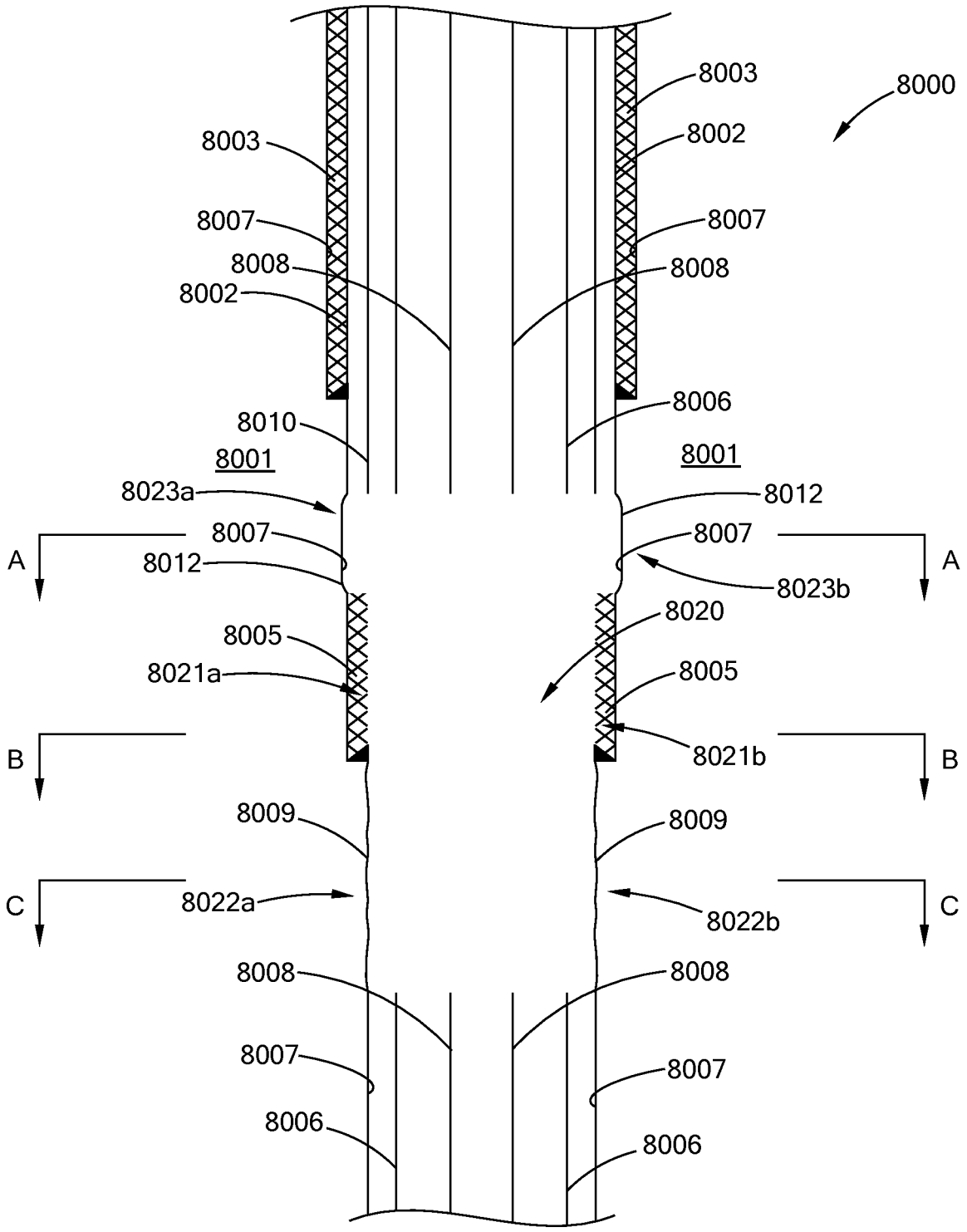
FIG. 15 is an axial cross sectional schematic view of the well of FIG. 14 after an embodiment of a laser delivery pattern of the present inventions has been delivered, in accordance with the present inventions.
Figure 15A:
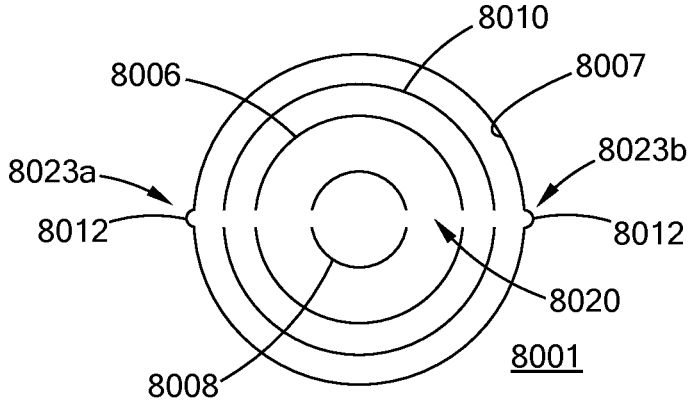
FIGS. 15A to 15C are radial cross sections of the well of FIG. 15 taken respective along lines A-A, B-B and C-C.
Figure 15B:
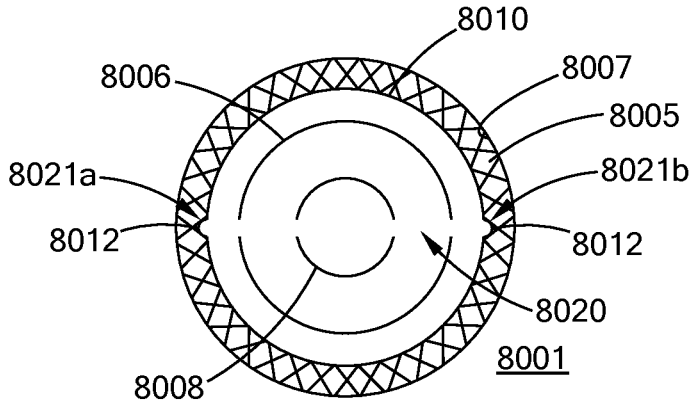
Figure 15C:
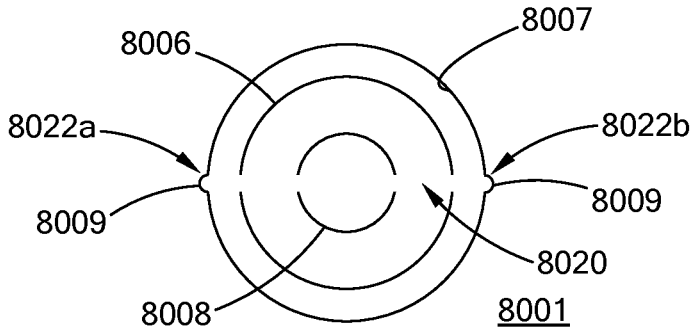
Figure 16:
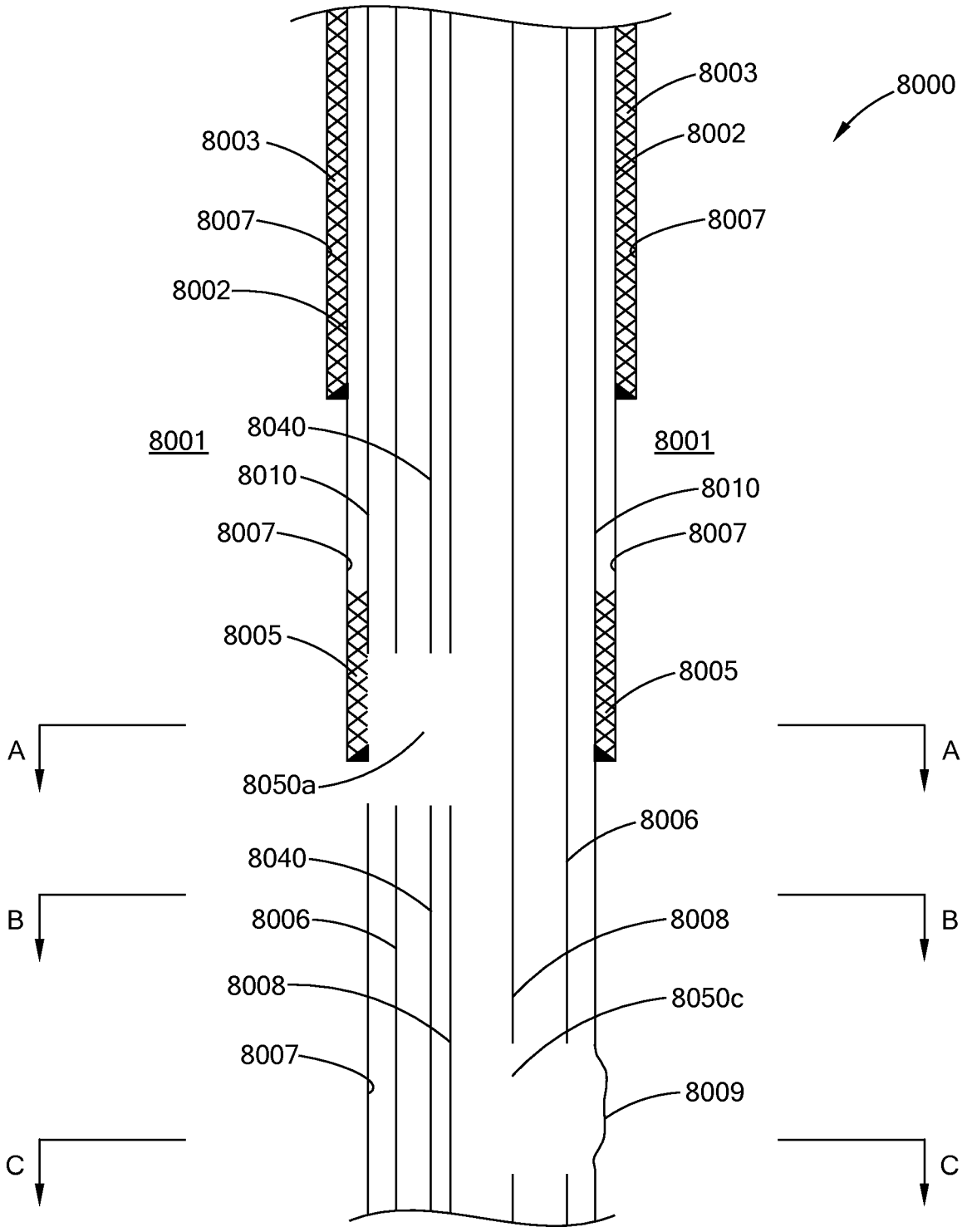
FIG. 16 is an axial cross sectional schematic view of the well of FIG. 14 after an embodiment of a laser delivery pattern of the present inventions has been delivered, in accordance with the present inventions.
Figure 16A:
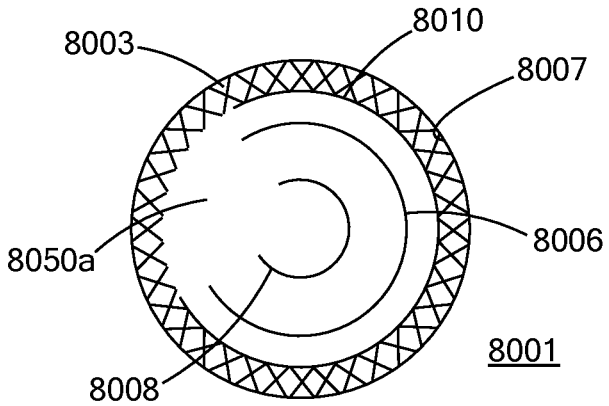
FIGS. 16A to 16C are radial cross sections of the well of FIG. 16 taken respective along lines A-A, B-B and C-C.
Figure 16B:
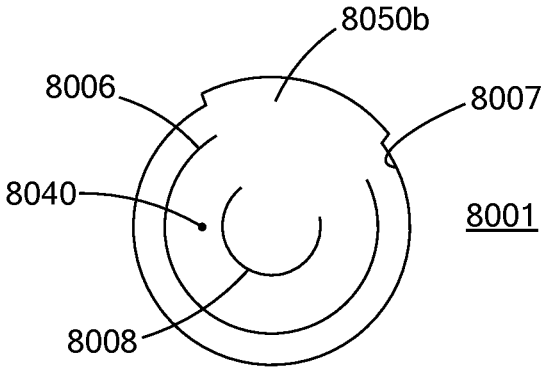
Figure 16C:
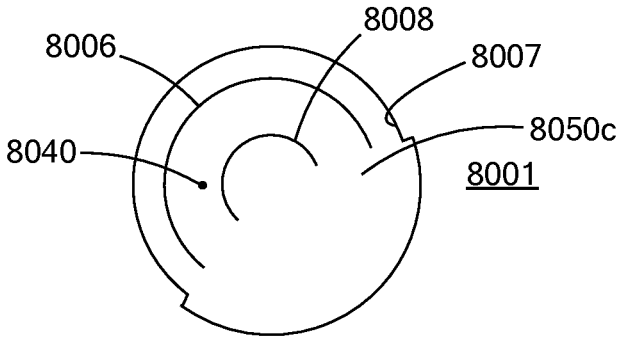

A high power laser tool is positioned in the well 8000 by being advancing to a predetermined location in the wellbore within in tubular 8008. (Tubing 8008 may also be cut and pulled from the well to provide a large diameter opening to advance the laser tool within.) The laser beam is fired in a laser beam pattern to cut two slots in the tubulars. The slots are in a line intersecting the tubulars and borehole wall at 90° and 270° (e.g., 3 o'clock and 9 o'clock looking at FIGS. 15A-C as if it were the face of a clock with 12 o'clock being at the top of the page. It further being understood that the well, and the location where the laser beam pattern is being delivered might be vertical, horizontal and at any other angle). Turning to FIGS. 15 and 15A (cross section of the well of FIG. 14 after the laser cut is complete, and FIGS. 15A, 15B, 15C cross section taken along lines A-A, B-B and C-C of FIG. 15) the the laser beam delivery pattern 8020 cuts slots that are 200 feet long and 1 inch wide in the tubulars in the well. Slots are cut through tubular 8010, 8006 and 8008. The slots, depending upon their location extend into the borehole wall 8007; forming notches 8023*a*, 8023*b*, and notches 8022*a*, 8022*b*; and into cement 8005, creating notches 8021*a*, 8021*b*. The notches into the borehole wall 8007 have surfaces 8009, 8012. A plug can be set below the location where the laser delivery pattern is being delivered and then cement pumped into the well bore, and flowing through the laser slots into the other annular spaces filling them. In this manner the entirety of the borehole diameter from borehole surface to borehole surface, e.g., rock-to-rock, can be filled and plugged over the entire 200 foot length of the slots.

Example 2

Two additional laser cut slots are made in the well of Example 1. These slots are spaced between the other two slots. In this manner four slots are cut in the tubulars at using at 0°, 90°, 180°, 270° (12 o'clock, 3 o'clock, 6 o'clock, and 9 o'clock). The length of these four slots are each about 200 feet long.

Example 3

A disc shaped cut, removing all tubulars at the bottom of the laser delivery pattern is added to the laser patterns of Examples 2 and 3. The size of the disc shaped cut coincides with the size of a packer. In this manner the packer, or similar type device, can be set at the bottom of the laser delivery pattern, filling the space between the exposed borehole wall. Thus, as the cement is pumped into the well to form the plug, the packer at the bottom of the cuts prevents the cement from flowing into and filling annular spaces below the laser cut pattern.

Example 4

Four disc shaped cuts, removing all tubulars at the bottom of the laser delivery pattern is added to the laser patterns of Examples 2 and 3. The disc shaped cuts are staggered along the length of the laser delivery pattern from the top to the bottom. The size of the bottom (lower) most disc shaped cut coincides with the size of a packer. In this manner the packer, or similar type device, can be set at the bottom of the laser delivery pattern, filling the space between the exposed borehole wall. Thus, as the cement is pumped into the well to form the plug, the packer at the bottom of the well will prevent the cement from flowing into and filling annular spaces below the laser cut pattern. In order to remove the material a small hydraulic/pneumatic telescoping push rod located on a laser tool sub may be used to mechanically force the disc/pie shape steel out into the annular space creating a suitable void for pumping of cement.

Example 5

A staggered and interconnected pie shaped laser delivery pattern is provided to a well. Turning to FIGS. 16 and 16A to 16C (showing axial cross section of the well of FIG. 14, and the cross sections along lines A-A, B-B and C-C respectively). Thus, the laser delivery pattern is delivered in three pie shaped pattern 8050*a*, 8050*b*, and 8050*c*. These pie shaped patterns are interconnected. Thus, by staggering, and preferably staggering in an overlapping fashion, the pie shaped patterns assure that any control lines 8040, or other lines in the well bore will be cut by the laser, enabling the cement to fill the area, uninterrupted by the control line.

Example 6

Five staggered, overlapping and interconnected pie shaped patterns are delivered to a well. The size and positioning of the pie shapes are such that they, when stacked on top of each other, will fill the entire borehole. (It being understood that two, three, four, five, six or more pie shaped, rectangular shaped, elliptical shaped, or other shape, that are preferably arranged in an overlapping manner may be used)

Example 7

Figure 17:
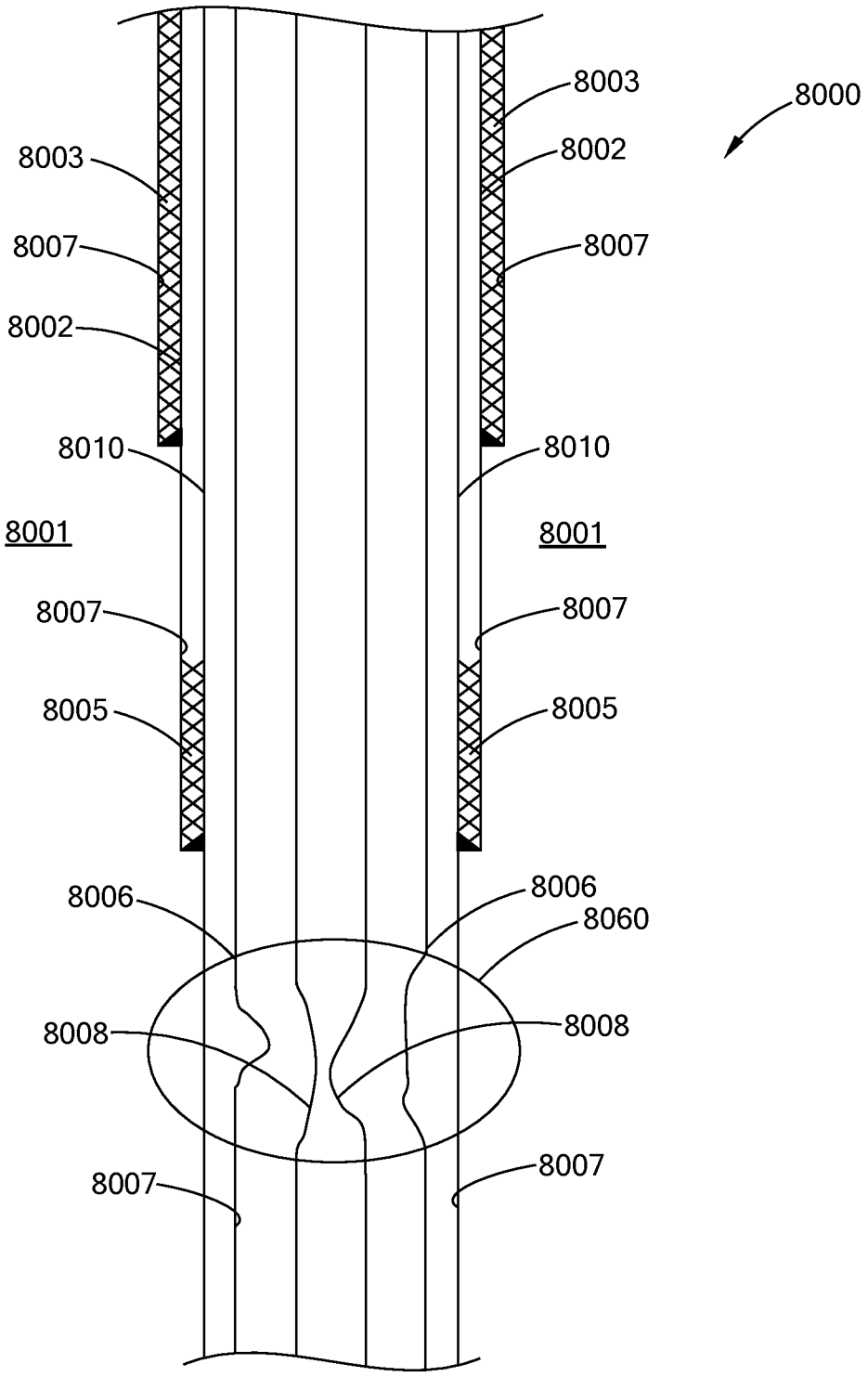
FIG. 17 is a cross sectional schematic view of a damaged well upon which laser operations in accordance with the present inventions are performed.
Figure 17A:
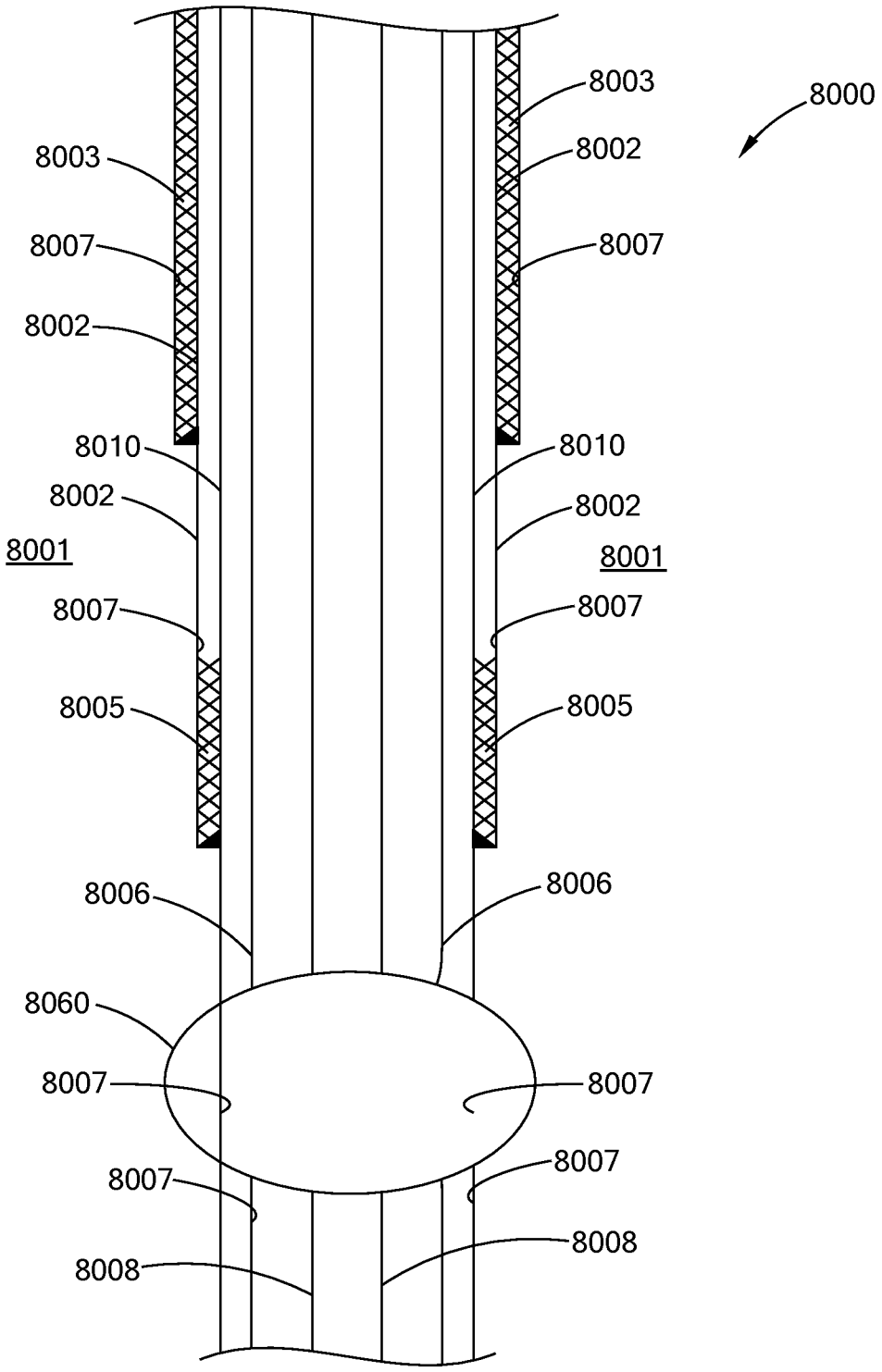
FIG. 17A is a cross sectional view of the well of FIG. 17 after being opened by an embodiment of a laser opening operation in accordance with the present inventions.

Turning to FIG. 17, the well section of FIG. 14 is shown having been damaged by the formation. A laser pattern is delivered to the damage area 8060 removing the damaged tubulars and the formation incursion. Turning to FIG. 17A, showing the well after the laser opening pattern has been delivered to the damaged section 8060 opening it up. (It should be noted that in this Example all incursions into the bore hole are removed, in other situation only the the centermost may need to be removed, or only a particular diameter opening many need to be made for the passage of tools and cement to lower sections of the well.) In this manner the well is cleared, opening up access to lower portions of the well for: laser cutting, plug setting or other operations; for providing a plug of by way of illustration of the types described in Examples 1-6; and combinations and variation of these and other patterns and down hole operations.

Example 8

Figure 18:
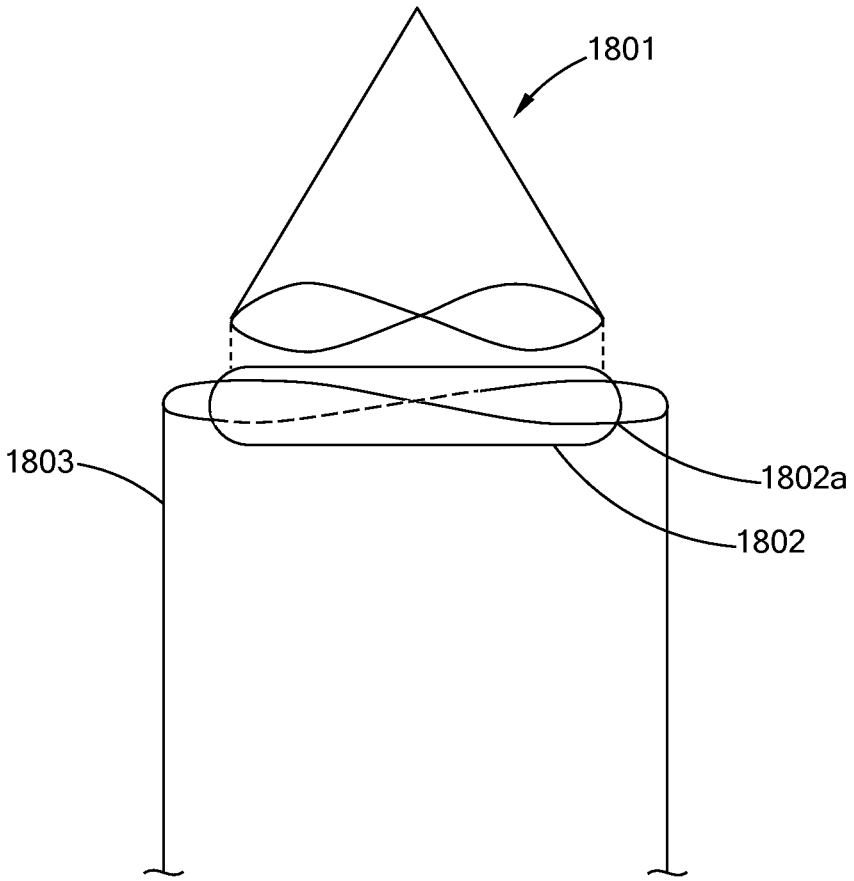
FIG. 18 is an embodiment of a laser beam delivery pattern in accordance with the present inventions.

In cases where the innermost tubular, e.g., 8008, is fully and/or partially collapsed due to formation shearing the laser cutting tool would act in a "milling" fashion by sending a beam in a fan like pattern parallel to the face of the tubular while the tool rotates creating a circular cavity. An embodiment of a laser fan pattern 1801, is shown in FIG. 18. The laser fan pattern 1801, when rotated forms a beam pattern 1802, intersecting a collapsed tubing 1803 at various points, e.g., 1802*a*, to remove the collapsed tubing. The beam would clear metal slag/debris downwards or circulate back thru annulus or circulate back thru the tool as the laser tool is conveyed or pushed vertically downward into the wellbore to create an opening in the tubular 8007 allowing for a setting tool, cement retainer, cast iron bridge plug, coil tubing, or drill pipe to re-enter the lower wellbore (not shown in Figures) and/or lower reservoir zone for proper zonal isolation.

Example 9

Figure 19:
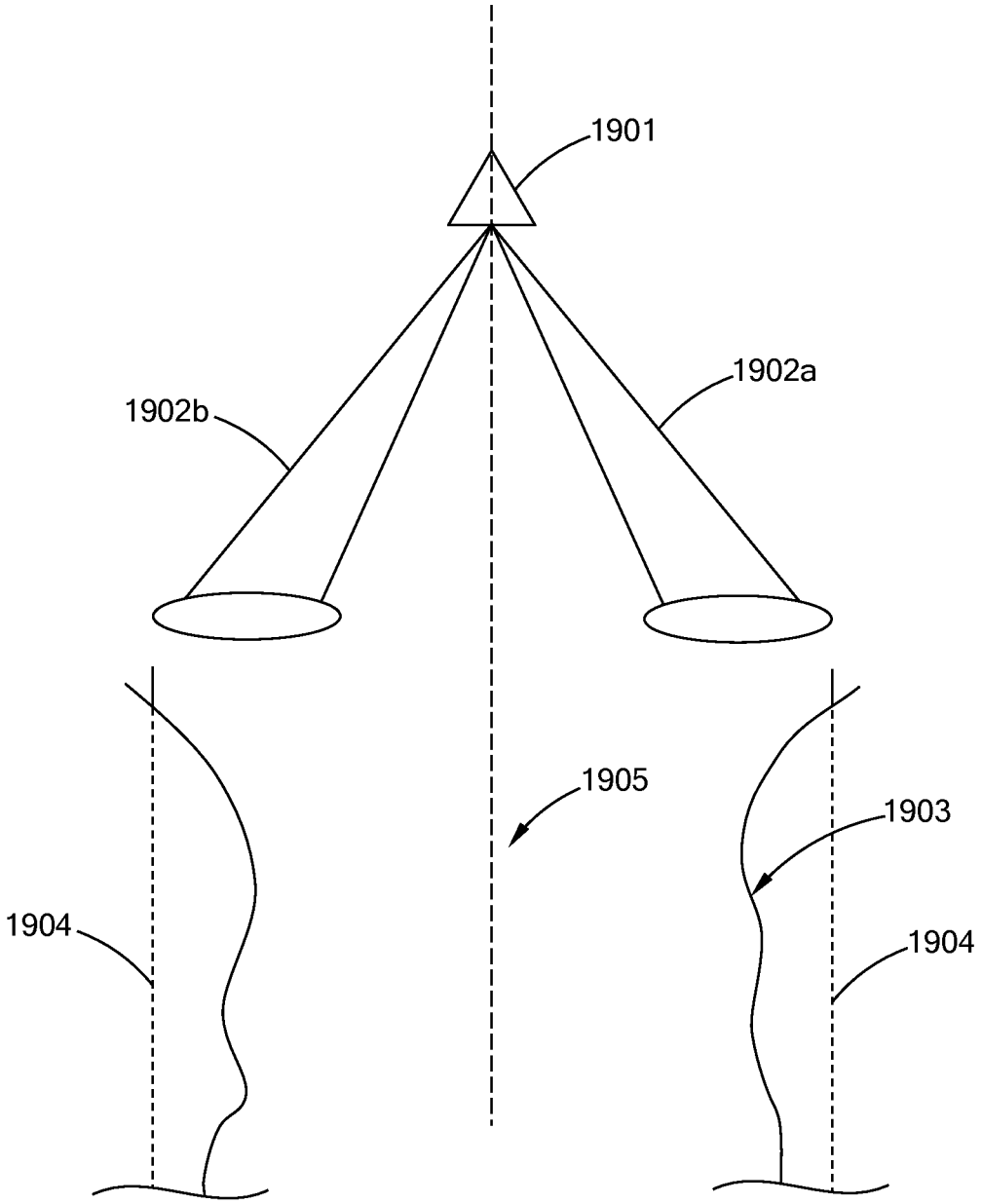
FIG. 19 is an embodiment of a laser beam delivery pattern in accordance with the present inventions.

Using same fully and/or partially collapsed casing scenario, the laser tool would send a beam split, as illustrated in FIG. 19. Thus, beam splitter 1901 splits the laser beam into two conical shaped beams 1902*a*, 1902*b* patterns, with no beam in the center section and rotate on the centerline 1905 of the tool. This beam pattern would create a cavity 1904 internally of the tubular 1903 by shaving off (e.g., metaling or vaporizing) and preferably circulating the solidified dross or waste back up thru the tool or tubular annular space.

Example 10

Tubular 8006 of FIG. 14 is partially collapsed leaving a small enough orifice for a laser tool of lesser diameter to pass thru. The laser tool would locate the pass thru point either with laser locater or previously run lead impression block and azimuthally locate and enter below the restriction to a point where the laser tool shown in FIG. 6 could cut the tubular perpendicular to the tubular wall for removal. The laser tool would be retracted to surface after cut has been performed and tubular pulled to surface. Once tubular is clear a cement plug could be set across the annular zone creating zonal isolation.

Example 11

In this example a laser removal system may be used to assist in the plugging abandonment and decommission of a subsea field. The field is associated with a floating spar platform. Two mobile containers are transported to the spar platform, containing a laser module, and a work container have laser cutting tools, devices, umbilicals and other support materials. The laser module obtains its power from the spar platform's power generators or supplied power generation. The laser cutting tools are lowered by the spars hoisting equipment, to the seafloor, where they are lowered into a first well that has been plugged, the laser tool directs a high power laser beam, having about 15 kW of power, in a nitrogen jet, around the interior of the well. The laser beam and jet in a single pass severs all of the tubulars in the well at about 15 feet below the mud line. This process is repeated for the remaining wells in the field that are to be abandoned.

Example 12

A laser removal system may be used to recover 15,000 feet of 3½" and 4½" tubing from a total of six wells. The laser removal system is used in conjunction with and interfaces with the existing platform and hoisting equipment. As the tubing is pulled it is quickly cut in to lengths of 30 to 35 feet, by a laser cutting device on the platform's floor. This avoids the use and associated cost of a separate rig and could allow for the reuse of tubulars in future projects.

Example 13

A laser decommissioning vessel may be used to remove a subsea 30" multi-string casing stub that is covered with debris (sand bags) and is wedged and bent against an operating pipeline and is located at a depth of 350 feet. The inner casing string, 13¾", in the multi-string stub is jammed with an unknown material starting at about 1 foot below the sea floor that could not be removed by jetting. All strings of casing in the multi-string stub are fully cemented. A laser removal system and tool is used to remove this stub without the need for dredging. A laser tool having two beam paths, a boring beam path and a severing beam path, is used to first bore through the jammed material in the inner casing string. This provides access for the tool down to 18 feet below the sea floor. The tool then severs the multi-string stub in 3-foot sections, until the stub is removed to 15 feet below the sea floor. The smaller, 3 foot sections are used to accommodate the use of a smaller and less expensive hoisting equipment. Additionally, because the structural integrity of the stub is unknown multiple smaller sections are lifted instead of a single 15-foot section.

Example 14

Figure 20:
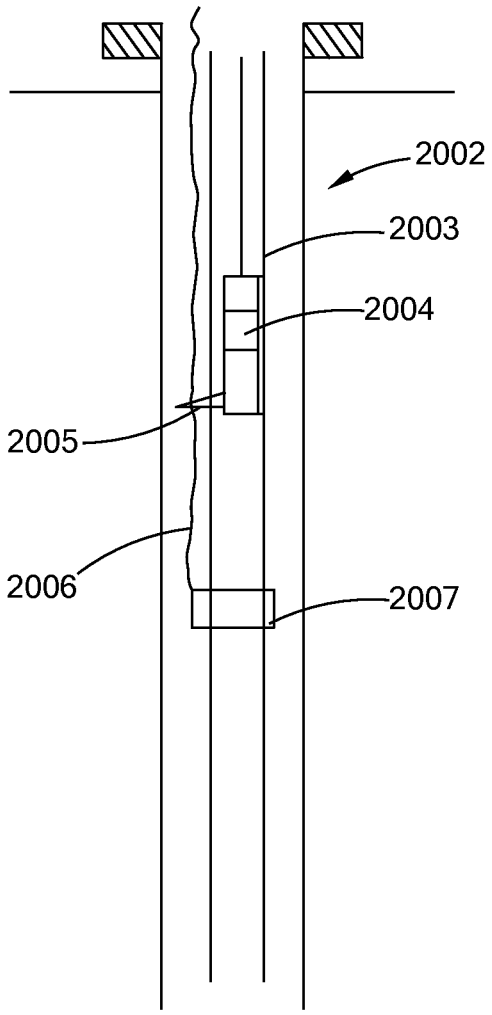
FIG. 20 is a cross sectional view of an embodiment of a laser decommissioning tool in accordance with the present inventions.

Turing to FIG. 20 there is shown a schematic of an embodiment of a laser tool 2004, in a borehole 2002 cutting a control line 2006 with a laser beam 2005 that is being delivered from the tool 2004. The control line controls a safety valve 2007 in the borehole. The laser beam 2005 can be rotated, to the extent necessary to assure that the control line 2006 is severed.

Example 15

Figure 21:
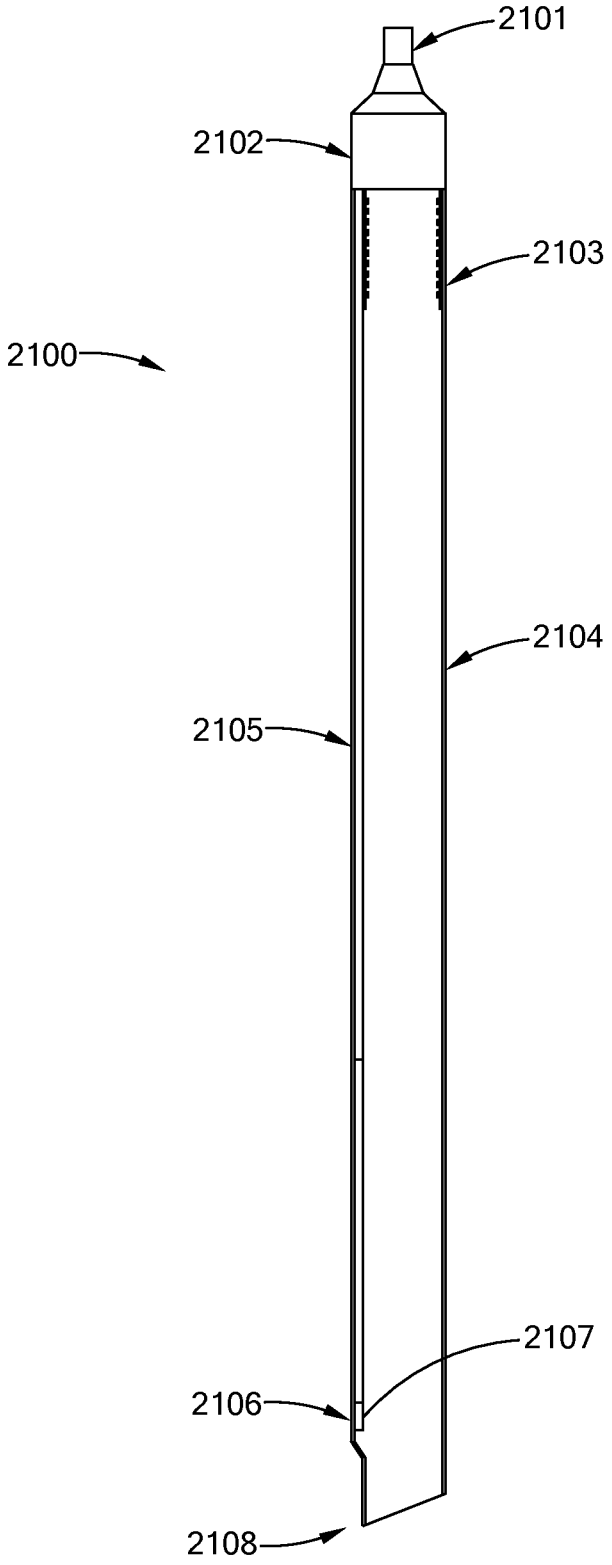
FIG. 21 is a cross sectional view of an embodiment of a laser overshot tool in accordance with the present inventions.

Turning to FIG. 21 there is shown an embodiment of a laser overshot tool 2100 for removing a damaged piece of tubing from a well. The laser tool 2100 has a coiled tubing connector 2101 and a motorized rotating head 2102, which is connected to the overshot body 2104. In side of the overshot body, near the motorized rotating head 2102 is a slip assembly 2103 and at the distal end of the overshot body 2104 there is a guide shoe 2108. The overshot body 2014 has a optical fiber and air channel 2105 that connects to a laser cutting head and nozzle 2106, which fires laser beam 2107. The length of the overshot body 2014 can be varied based upon the length of the damaged casing that is to be retrieved.

Figure 22A:
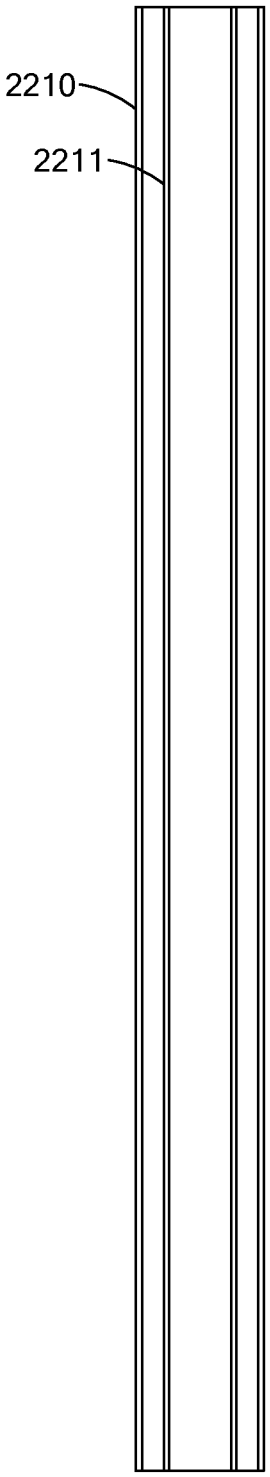
FIG. 22A to 22F are cross sectional snap shot views of the tool of FIG. 21, performing an embodiment of a laser operation in accordance with the present inventions.
Figure 22B:
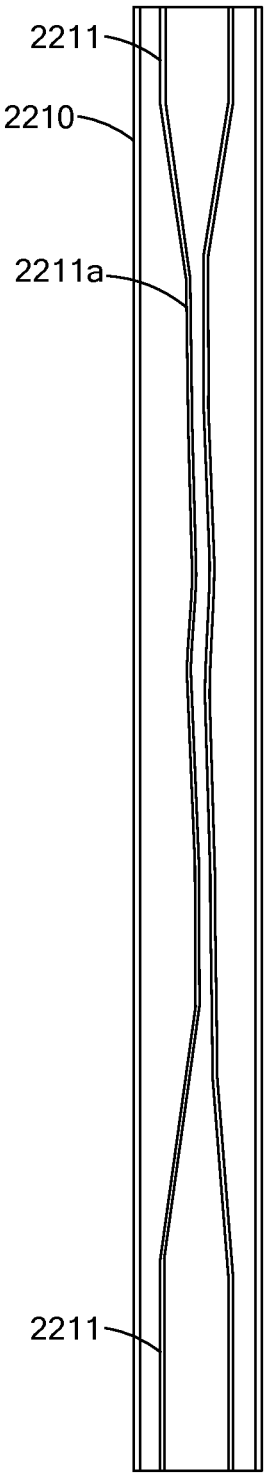
Figure 22C:
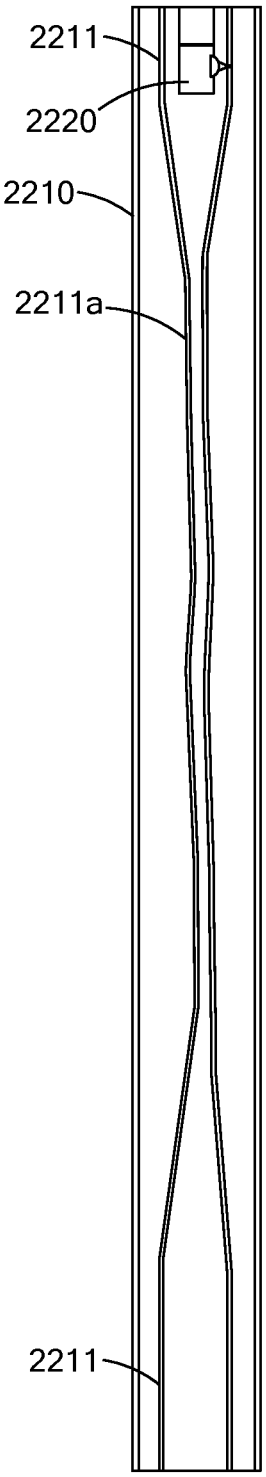
Figure 22D:
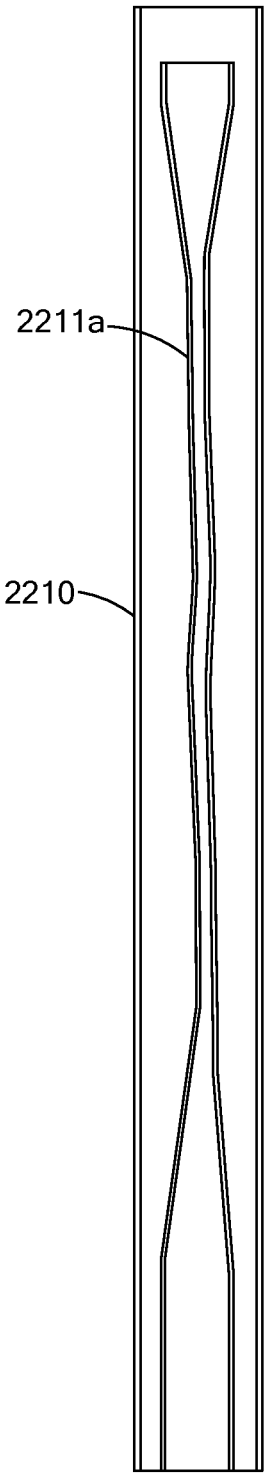
Figure 22E:
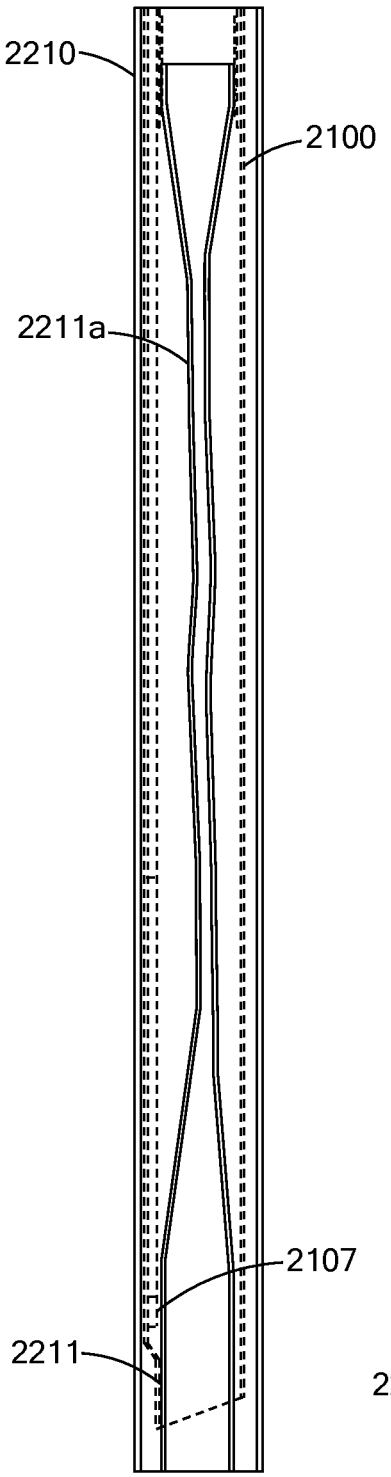
Figure 22F:
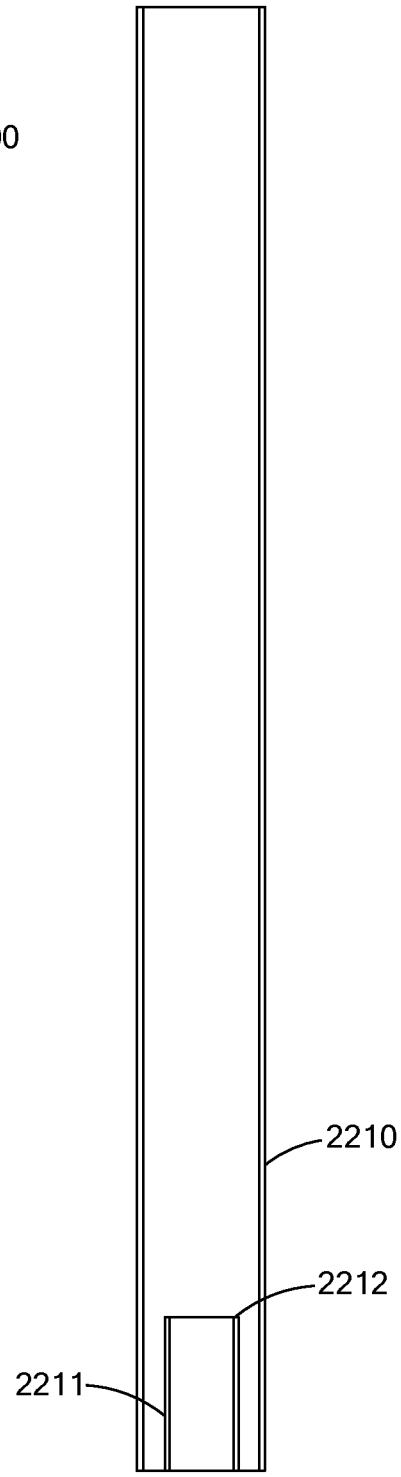
Figure 23:
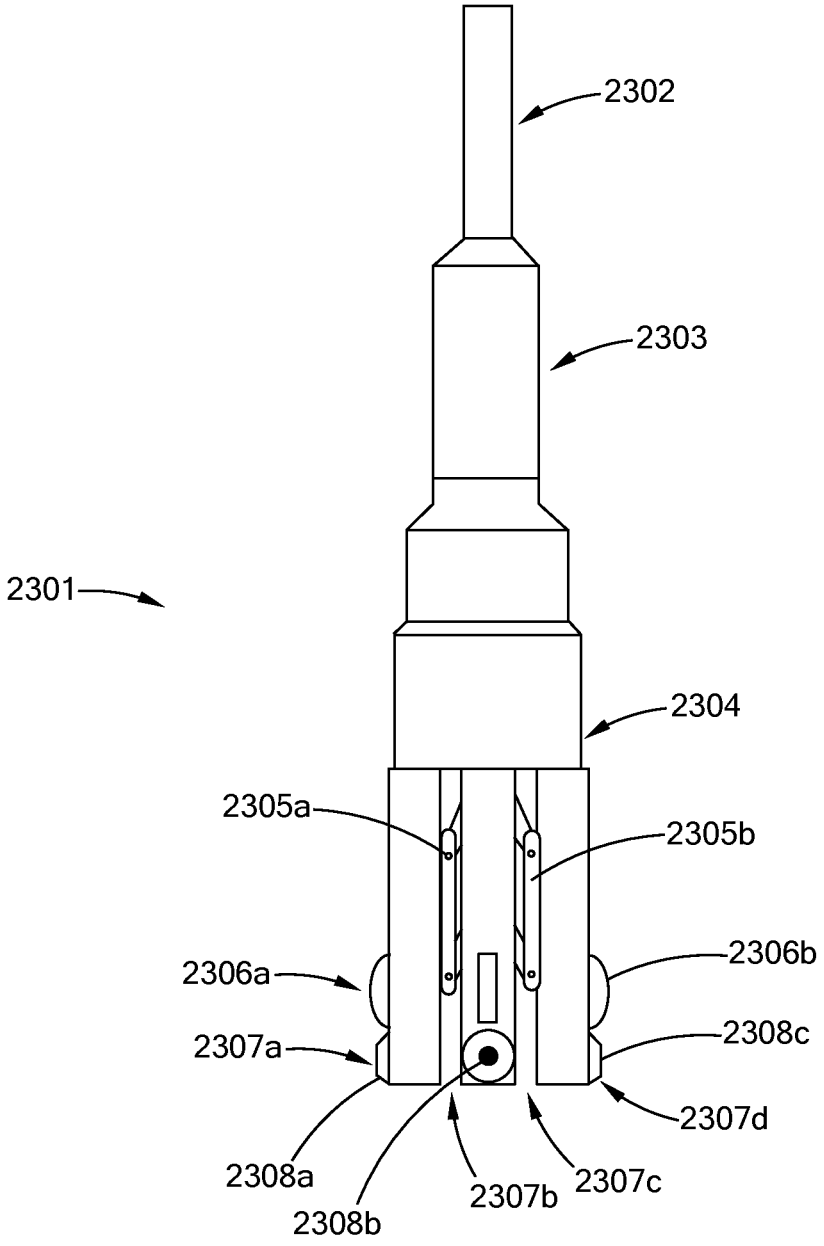
FIG. 23 is a cross sectional an embodiment of a laser cutting tool in accordance with the present inventions.

Turning to FIGS. 22A to 22F there is shown an example of the use of the overshot tool 2100 of the embodiment of FIG. 21. FIG. 22A shows a cross sectional view of section of a normal, e.g., undamaged, down hole well configuration having a 9⅝" outer tubular 2210 with a 5½" inner tubular 2211, located within in the outer tubular 2210. FIG. 22B shows a section of the well where inner tubular has been damaged, e.g., a damaged section 2211*a*. FIG. 22C shows a laser pipe cutting tool 2220 being lower inside of the inner tubing 2211 to a point just above the damaged section 2211*a*, where the laser tool cuts the inner tubular 2211 allowing the inner tubing to be pulled from the well, as shown in FIG. 22D. In FIG. 22E the laser overshot tool 2100 (shown in phantom lines) is lowered over and around the damaged section 2211*a*. From the figure it can be seen that preferably the laser beam 2107 is delivered to a point completely below the damage section 2211*a*, so that only one cut and pull procedure is needed. The motorized rotating head on the overshot tool 2100 is rotated as the laser beam 2107 is fired, in an outside to inside cut of the inner tubular 2211. The overshot tool 2100 is then removed taking the cut damaged section 2211*a* with it. Thus, leaving the undamaged tubular 2211 with a laser cut end 2212, that is preferably smooth and uniform.

Example 16

Turning to 23 is provided a schematic view of an embodiment of a laser tool 2301. The laser tool 2301 is shown connected to a coiled tubing 2302 by way of a coiled tubing connector 2303. The laser tool 2301 has a motorized rotating and extension head assembly 2304. This assembly 2304 has four laser cutting heads 2307*a*, 2307*b*, 2307*c* and 2307*d*. Each laser cutting head has a laser nozzle, e.g., 2308*a*, 2308*b*, 2308*c*. And each laser cutting head has extension stops, e.g., 2306*a*, 2306*b* and extension mechanisms, e.g., 2305*a*, 2305*b* that extend the laser cutter out to the inner surface of a pipe to be cut.

Figure 24A:
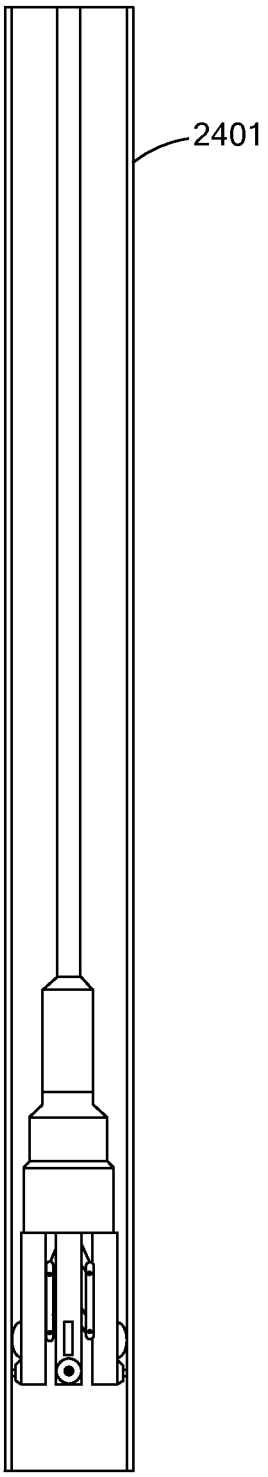
FIG. 24A to 24D are cross sectional snap shot views of the tool of FIG. 23, performing an embodiment of a laser operation in accordance with the present inventions.
Figure 24B:
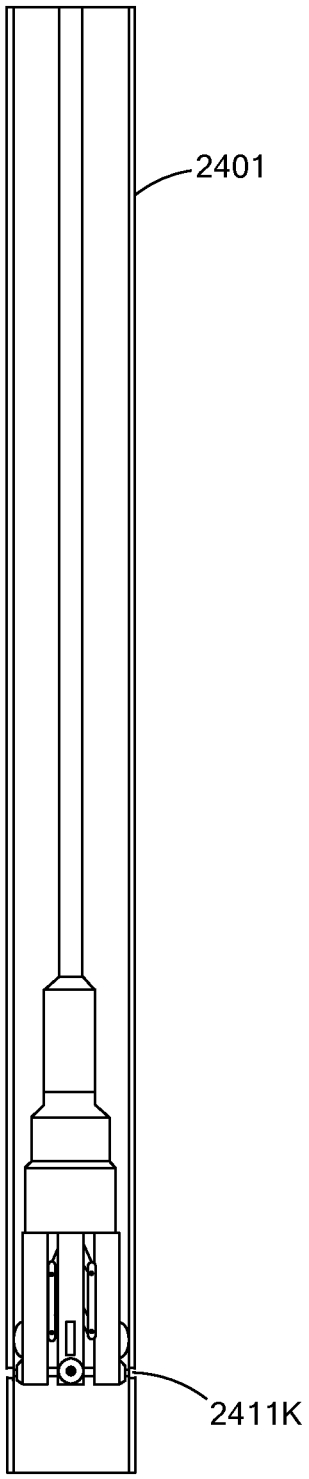
Figure 24C:
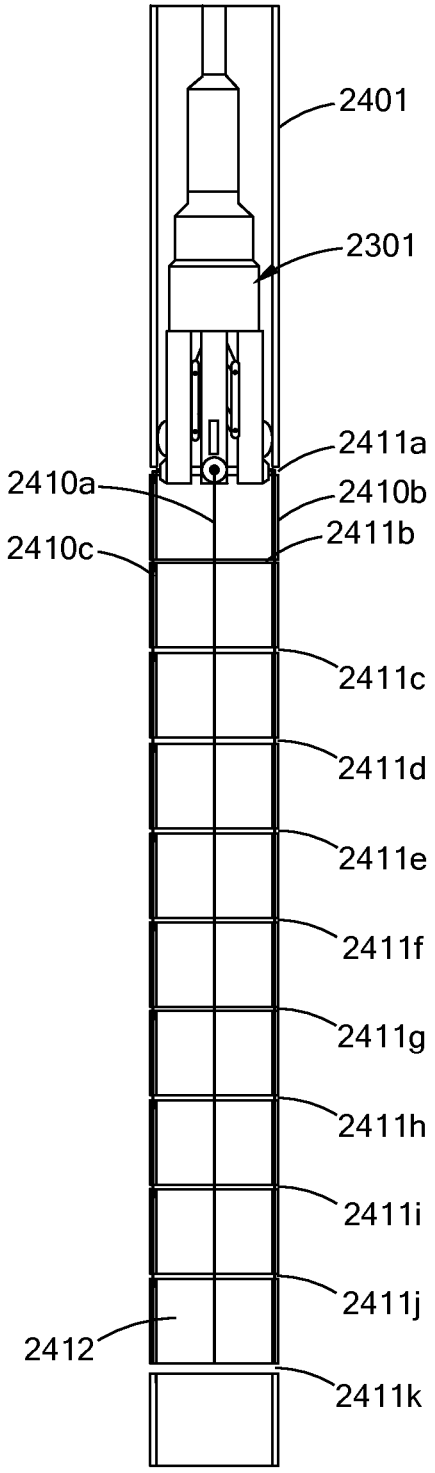
Figure 24D:
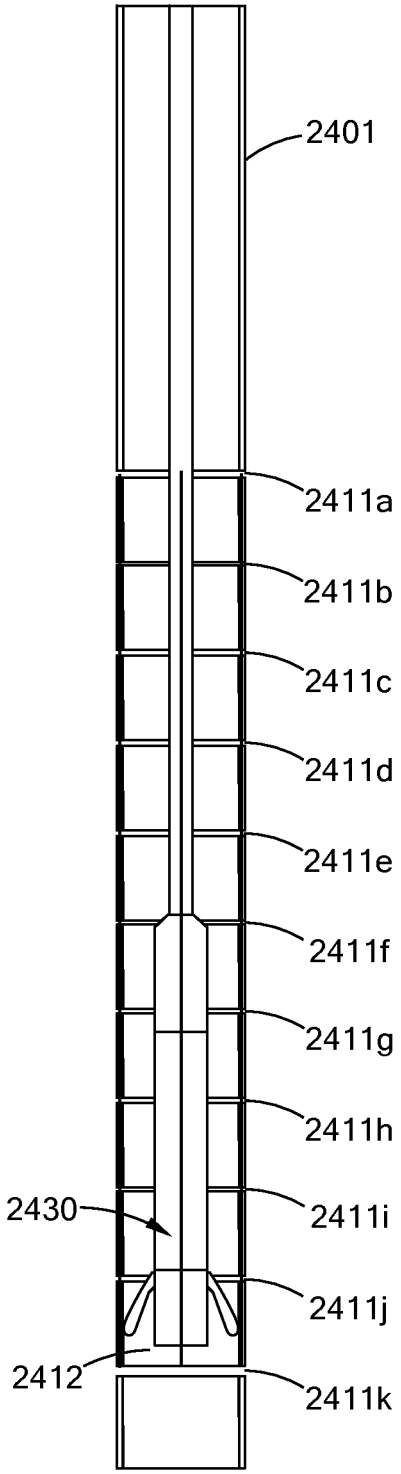

Turning to FIGS. 24A to 25D there is shown an embodiment of a process for removing a pipe from a well using the laser tool 2301. Thus, as shown in FIG. 24A the laser tool 2301 is lowered into a pipe 2401 in a well, and is positioned at the lowest point in the well where the pipe is to be removed. Turning to FIG. 24B the laser tool 2301 is fired and rotated 90 degrees, which creates a circular cut 2411*k* in the pipe 2401. The laser tool 2301 is then raised in the well with all four laser cutters firing, which creates four vertical (along the axis of the well bore or pipe) cuts 2410*a*, 2410*b*, 2410*c* (the fourth cut is not shown). At an interval, e.g., every 6 inches, the axial movement of the tool 2301 is stopped and it is rotated again creating a second circular (horizontal or transverse to the axis of the pipe) cut 2411*j*. This process of making the four axial cuts and making circulars cut is repeated, see FIG. 24C, extending the length of the axial cuts, e.g., 2410*a*, 2410*b*, 2410*c*, and creating a number of circular cuts 2411*k*, 2411*j*, 2411*i*, 2411*h*, 2411*g*, 2411*f*, 2411*e*, 2411*d*, 2411*c*, 2411*b*, 2411*a*. In this manner the pipe 2401 is cut into a number of quarter sections, e.g., 2412, throughout the length to be removed, as shown in FIG. 24C. Once the laser sectioning of the pipe has been completed, the laser tool is removed, and as shown in FIG. 24D, an underreamer 2430 with a slow, high torque motor is run to the bottom of the section, e.g., 2412 to be removed. The underreamer 2430 is then rotated and pulled from the well, while being rotated to insure that all of the sectioned pipe, e.g., 2412, has been removed from the borehole wall. If necessary a magnet can then be run into the well, or positioned below the underreamer, to remove the freed sections, e.g., 2412, that had fallen further down the well. It is understood that more or fewer laser heads, and thus, sections of pipe, can be used.

Figure 25:
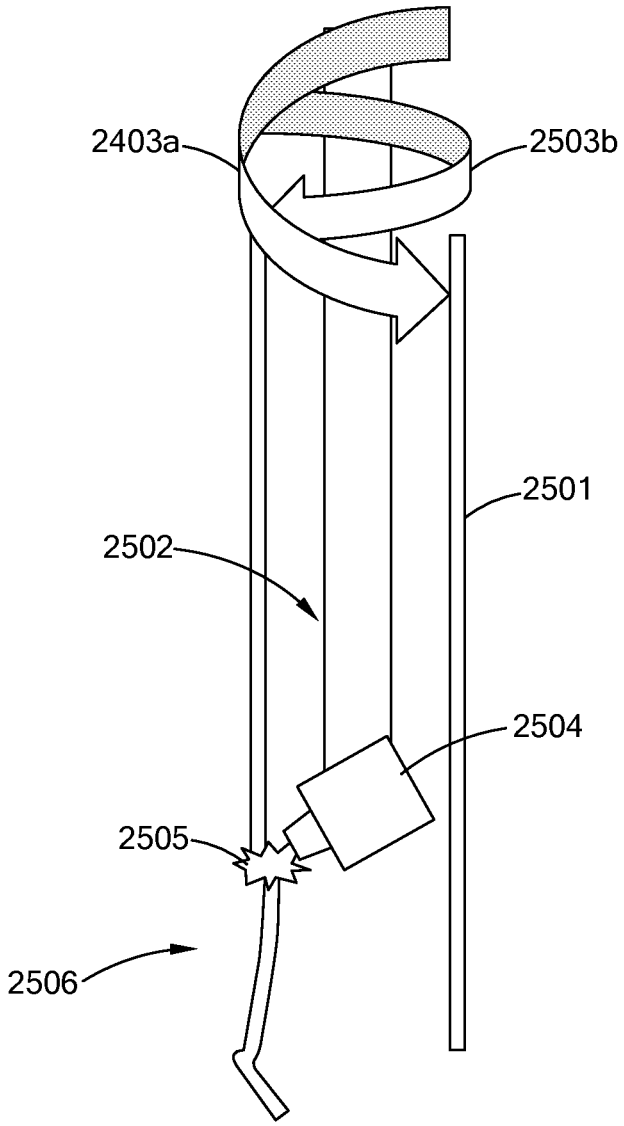
FIG. 25 is a perspective view of a laser tool of the present inventions.

Turning to FIG. 25 there is shown a schematic of an embodiment of a laser tool 2504 in a borehole 2501 having a damaged section 2506. The laser tool 2504 is lowered by a ridged shaft 2502 that is rotated by a motor (not shown) in alternating downward spiraling motions, as shown by arrows 2503*a*, 2403*b*. (the spiraling motions could be upward, or upward and downward) The laser beam 2505 is delivered from the laser tool to remove the damaged section 2506 of the borehole 2501.

In addition to these, examples, the high power laser removal systems, tools, devices and methods of the present inventions may find other uses and applications in activities such as subsea beveling; decommissioning other types of offshore installations and structures; emergency pipeline repairs; cutting and removal of structures in refineries; civil engineering projects and construction and demolitions; removal of piles and jetties; removal of moorings and dolphins; concrete repair and removal; cutting of effluent and discharge pipes; maintenance, cleaning and repair of intake pipes; making small diameter bores; cutting below the mud line; precise, in-place milling and machining; heat treating; cutting elliptical man ways; and cutting deck plate cutting.

The various embodiments of systems, tools, laser heads, cutting heads, nozzles, fluid jets, beam paths and devices set forth in this specification may be used with various high power laser systems and conveyance structures, in addition to those embodiments of the Figures and Examples in this specification. The various embodiments of systems, tools, laser heads, cutting heads, nozzles, fluid jets and devices set forth in this specification may be used with other high power laser systems that may be developed in the future, or with existing non-high power laser systems, which may be modified, in-part, based on the teachings of this specification, to create a laser system. Further the various embodiments of systems, tools, laser heads, cutting heads, nozzles, fluid jets and devices set forth in the present specification may be used with each other in different and various combinations. Thus, for example, the laser heads, nozzles and tool configurations provided in the various embodiments of this specification may be used with each other; and the scope of protection afforded the present inventions should not be limited to a particular embodiment, configuration or arrangement that is set forth in a particular embodiment, or in an embodiment in a particular Figure or Example.

The various embodiments of tools, systems and methods may be used with various high power laser systems, tools, devices, and conveyance structures and systems. For example, embodiments of the present systems, tools and methods may use, or be used in, or with, the systems, lasers, tools and methods disclosed and taught in the following US patent applications and patent application publications: Publication No. 2010/0044106; Publication No. 2010/0215326; Publication No. 2012/0275159; Publication No. 2010/0044103; Publication No. 2012/0267168; Publication No. 2012/0020631; Publication No. 2013/0011102; Publication No. 2012/0217018; Publication No. 2012/0217015; Publication No. 2012/0255933; Publication No. 2012/0074110; Publication No. 2012/0068086; Publication No. 2012/0273470; Publication No. 2012/0067643; Publication No. 2012/0266803; Publication No. 2012/0217019; Publication No. 2012/0217017; Publication No. 2012/0217018; Ser. No. 13/868,149; Ser. No. 13/782,869; Ser. No. 13/222,931; Ser. No. 61/745,661; and Ser. No. 61/727,096, the entire disclosures of each of which are incorporated herein by reference.

It is also noted that the laser systems, methods, tools and devices of the present inventions may be used in whole or in part in conjunction with, in whole or in part in addition to, or in whole or in part as an alternative to existing methodologies for, e.g., monitoring, welding, cladding, annealing, heating, cleaning, drilling, advancing boreholes, controlling, assembling, assuring flow, drilling, machining, powering equipment, and cutting without departing from the spirit and scope of the present inventions. Additionally, it is noted that the sequence or timing of the various laser steps, laser activities and laser methods (whether solely based on the laser system, methods, tools and devices or in conjunction with existing methodologies) may be varied, repeated, sequential, consecutive and combinations and variations of these, without departing from the spirit and scope of the present inventions.

The invention may be embodied in other forms than those specifically disclosed herein without departing from its spirit or essential characteristics. The described embodiments are to be considered in all respects only as illustrative and not restrictive.

What is claimed:

1. A method of servicing a damaged well, the method comprising:

a. advancing a high power laser delivery tool to a damaged section of the well, the damaged section of the well comprising a pinched casing and inner tubular; and, b. directing a high power laser beam from the high power laser delivery tool toward the damaged section of the well in a predetermined laser delivery pattern, the predetermined laser delivery pattern intersecting the pinched casing;

c. whereby the laser beam removes the pinched casing.

2. The method of claim 1, wherein the high power laser delivery tool comprises a bent sub.

3. The method of claim 1, wherein the high power laser delivery tool comprises an optics assembly for use with the bent sub.

4. The method of claim 1, wherein the high power laser delivery tool comprises a pair of prisms.

5. The method of claim 1, wherein the high power laser delivery tool is an overshot laser tool.

6. The method of claim 1, wherein the high power laser delivery tool comprises a laser mechanical bit.

7. A method of slot recovery, for a rig with a slot having a damaged well, the method comprising:

a. the damaged well associated with a slot on the rig;

b. cementing a rock to rock plug in a lower section of a reservoir associated with the well, whereby the lower section is isolated;

c. laser cutting all tubulars in the well at a point above the plug;

d. pulling the laser cut strings from the well;

e. run a whipstock thru the existing well slot until a top of the well is tagged;

f. orienting the whipstock slide in the correct direction; and, g. drilling a new borehole; whereby the slot on the rig has been recovered for use.

8. A method of decommissioning a well, comprising:

a. positioning a high power laser cutting tool in a borehole to be decommissioned;

b. delivering a high power laser beam from the high power laser tool in a predetermined pattern to the borehole, whereby the laser beam volumetrically removes material in the borehole and cuts a control line; and, c. forming a plugging material channel, which includes the cut portion of the control line, the plugging material channel essentially corresponding to the predetermined laser beam delivery pattern; and, d. filling the plugging material channel with cement, wherein a plug is formed, and thereby sealing the well.

* * * * *